US006494453B1

(12) United States Patent
Yamada et al.

(10) Patent No.: US 6,494,453 B1
(45) Date of Patent: Dec. 17, 2002

(54) METHOD AND APPARATUS FOR OUTPUT SHEET HANDLING CAPABLE OF EFFECTIVELY SWITCHING EJECTION TRAYS

(75) Inventors: Kenji Yamada, Tokyo (JP); Shinji Asami, Saitama-ken (JP); Nobuyoshi Suzuki, Tokyo (JP); Hiroki Okada, Kanagawa-ken (JP); Junichi Iida, Kanagawa-ken (JP); Hiromoto Saitoh, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 169 days.

(21) Appl. No.: 09/685,031

(22) Filed: Oct. 10, 2000

(30) Foreign Application Priority Data

Oct. 8, 1999 (JP) ..... 11-288437
Sep. 5, 2000 (JP) ..... 2000-268855

(51) Int. Cl.[7] ..... B65H 29/00
(52) U.S. Cl. ..... 271/288; 271/292; 271/298
(58) Field of Search ..... 271/288, 292, 271/294, 298; 270/58.08, 58.14, 58.19

(56) References Cited

U.S. PATENT DOCUMENTS

| | | | | |
|---|---|---|---|---|
| 5,020,784 A | | 6/1991 | Asami et al. | |
| 5,263,697 A | | 11/1993 | Yamazaki et al. | |
| 5,320,336 A | | 6/1994 | Asami | |
| 5,508,798 A | | 4/1996 | Yamada | |
| 5,570,877 A | | 11/1996 | Asami et al. | |
| 5,655,765 A | | 8/1997 | Asami et al. | |
| 5,762,328 A | | 6/1998 | Yamada et al. | |
| 5,788,229 A | | 8/1998 | Asami et al. | |
| 5,971,383 A | * | 10/1999 | Horikawa et al. | 270/58.11 |
| 6,145,825 A | | 11/2000 | Kunihiro et al. | |
| 6,199,853 B1 | | 3/2001 | Andoh et al. | |
| 6,231,045 B1 | * | 5/2001 | Yamada et al. | 271/292 |
| 6,394,448 B2 | * | 5/2002 | Suzuki et al. | 271/189 |

FOREIGN PATENT DOCUMENTS

| | | |
|---|---|---|
| EP | 0 850 866 | 7/1998 |
| JP | 8-26579 | 1/1996 |
| JP | 8-169627 | 7/1996 |
| JP | 9-110259 | 4/1997 |
| JP | 11-11786 | 1/1999 |

OTHER PUBLICATIONS

Patent Abstracts of Japan, vol. 2000, No. 05, Sep. 14, 2000, JP 2000–053308, Feb. 22, 2000.

* cited by examiner

*Primary Examiner*—David H. Bollinger
(74) *Attorney, Agent, or Firm*—Oblon, Spivak, McClelland, Maier & Neustadt, P.C.

(57) ABSTRACT

A novel output sheet handling apparatus includes outlets, ejection trays, a tray switching mechanism, an outlet switching mechanism, and a controller. Each of outlets ejects a recording sheet. The outlets include at least one straight outlet configured to eject a recording sheet and to eject no stack of recording sheets processed in a complex finishing mode. The ejection trays, at least same plurality as the plurality of outlets, include at least one ejection tray configured to receive the recording sheet from at least two outlets among the outlets. The tray switching mechanism performs a tray switching operation for switching one of the ejection trays in operation to another. The outlet switching mechanism performs an outlet switching operation for switching one of the outlets in operation to another. The controller performs a control operation for controlling the tray and outlet switching mechanisms to minimize a total distance which one of ejection trays in operation and another one are moved during the ejection tray switching operation in accordance with a finishing mode selected when the large capacity ejection mode is selected.

57 Claims, 34 Drawing Sheets

METHOD AND APPARATUS FOR OUTPUT SHEET HANDLING CAPABLE OF EFFECTIVELY SWITCHING EJECTION TRAYS

CROSS-REFERENCE TO RELATED APPLICATIONS

This application claims priority to Japanese patent application Nos. JPAP11-288437 filed on Oct. 8, 1999 and JPAP2000-268855 filed on Sep. 5, 2000 in the Japanese Patent Office, the entire contents of which are hereby incorporated by reference.

BACKGROUND

1. Field

The present invention relates to a method and apparatus for output sheet handling, and more particularly to a method and apparatus for output sheet handling that is capable of effectively switching a plurality of ejection trays.

2. Description of the Related Arts

There have been developed an apparatus for handling a recording sheet output from an image forming apparatus after it prints on the recording sheet. Such an apparatus is referred to as an output sheet handling apparatus, or a finishing apparatus. The image forming apparatuses to output the printed recording sheets are printers, copying machines, facsimile machines, multi-function digital copying machines, etc.

One example of the finishing apparatus is described in Japanese Laid-Open Patent Publication No. 8-26579. This exemplary finishing apparatus is provided with an ejection tray and an inner tray. After a print operation, the apparatus conveys the printed recording sheet either to the inner tray or straight to the ejection tray. In the inner tray, a stack of the recording sheets are jogged and stapled on demand. As an enhancement to this example, to the above-mentioned ejection tray is configured to be movable up and down to have a large loading capacity.

In recent years, the digitalization of the image forming apparatus such as the copying machine has greatly progressed. Under such a circumstance, the multi-function type machines having at least two of a printing function, a copying function, a facsimile function, and so on are becoming widespread. Accordingly, users increasingly demand a facility for sorting jobs on the multi-function equipment according to the functions increases. As a result, many finishing apparatuses have more than one sheet tray. For example, a one-tray type finishing apparatus is provided with an additional proof-tray which is fixed and receives the printed recording sheet passing through a separately-prepared sheet path. For another example, a finishing apparatus is provided with a plurality of sheet trays which are accessible to a single outlet from where the printed recording sheet is ejected, as described in Japanese Laid-Open Patent Publication No. 9-110259.

The former type finishing apparatus having the proof-tray is capable of performing a job interruption, for example, to interrupt an on-going print job with a copying job, that is, a merit of having a second tray. In this apparatus, however, the proof tray is allowed to receive a recording sheet only on a sheet-by-sheet basis. The recording sheet ejected to the proof tray is not processed through a finishing process such as a stapling operation, a punching operation, and so on. In other words, the finishing apparatus substantially has only one tray which enhances the finishing capabilities.

On the other hand, in the latter finishing apparatus having a plurality of ejection trays accessible to a single outlet, every tray can equally be responsible to the enhanced finishing capabilities of the apparatus. Due to this single outlet, however, the trays are required to be changed from one to another each time when the job is switched. This causes a reduction of productivity. In addition, since the trays are usually aligned in a vertical direction due to a space limitation, the lower-positioned tray has a loading capacity which is limited by a downward-movement of the upper-positioned tray. Therefore, the lower-positioned tray has a smaller loading capacity relative to its moving distance to access the common outlet.

SUMMARY

The present invention provides a novel output sheet handling apparatus. In one example, a novel output sheet handling apparatus includes a plurality of outlets, a plurality of ejection trays, a tray switching mechanism, an outlet switching mechanism, and a controller. Each of the plurality of outlets ejects a recording sheet having an image thereon. The plurality of outlets include at least one straight outlet configured to eject a recording sheet and to eject no stack of recording sheets processed in a complex finishing mode. The plurality of ejection trays, at least same plurality as the plurality of outlets, include at least one ejection tray configured to receive the recording sheet from at least two outlets among the plurality of outlets. The tray switching mechanism is configured to perform a tray switching operation for switching one of the plurality of ejection trays in operation to another. The outlet switching mechanism is configured to perform an outlet switching operation for switching one of the plurality of outlets in operation to another. The controller is configured to perform a control operation for controlling the tray switching mechanism and the outlet switching mechanism to minimize a total distance which the one of the plurality of ejection trays in operation and another one are moved during the ejection tray switching operation in accordance with a finishing mode selected when the large capacity ejection mode is selected.

The controller may perform the control operation based on location information of each of the ejection trays.

The controller may prohibit a selection of the large capacity ejection mode when each of the plurality of ejection trays is full.

The controller may perform the control operation in which, when one of the plurality of ejection trays is not full and others are full, the one which is not full is made available to receive the recording sheet ejected.

The controller may prohibit a selection of the large capacity ejection mode when one of the plurality of ejection trays has a greater loading capacity than others and when such one ejection tray is full.

When one of the plurality of ejection trays has a greater loading capacity than others and when such one ejection tray is not full and others are full, the controller may perform the control operation in which the one ejection tray is made available to receive the recording sheet ejected.

The plurality of outlets may include at least one finisher outlet, located at a position lower than a position of the straight outlet, for ejecting a stack of recording sheets which are processed in a complex finishing mode. Also, the plurality of ejection trays may include a first ejection tray configured to be receivable from either the straight outlet or the finisher outlet and a second ejection tray, located under the first ejection tray and having a greater loading capacity, for receiving a stack of recording sheets from the finisher outlet. In this case, under a condition that the second ejection tray is selected, the apparatus selectively may have a normal ejection mode in which an ejection operation is stopped when an event that the second ejection tray is full is detected and a large capacity ejection mode in which, when an event that the second ejection tray is full is detected, the second ejection tray is further moved down to continue to receive either a recording sheet or a stack of recording sheets until a full in the large capacity ejection mode is detected. Further, the controller may perform the control operation in which the first ejection tray is moved to the finisher outlet and an ejection operation is started under a condition that the large capacity ejection mode is selected and a complex finishing mode is selected.

The controller may prohibit a selection of the large capacity ejection mode when the second ejection tray is full and when the first ejection tray is full.

When the second ejection tray is full and when the first ejection tray is not full, the controller may perform the control operation in which the first ejection tray is moved to the finisher outlet and the ejection operation is started.

The controller may prohibit a selection of the large capacity ejection mode when the second ejection tray is full, regardless of a fact as to whether the first ejection tray is full.

When the first ejection tray is full and when the second ejection tray is not full, the controller may perform the control operation in which the second ejection tray is moved to the finisher outlet and the ejection operation is started.

The plurality of outlets may include at least one finisher outlet, located at a position lower than a position of the straight outlet, for ejecting either a recording sheet or a stack of recording sheets which are processed in a complex finishing mode. Also, the plurality of ejection trays may include a first ejection tray configured to be receivable from either the straight outlet or the finisher outlet and a second ejection tray, located under the first ejection tray and having a greater loading capacity, for receiving either a recording sheet or a stack of recording sheets from the finisher outlet. In this case, under a condition that the second ejection tray is selected, the apparatus may selectively have a normal ejection mode in which an ejection operation is stopped when an event that the second ejection tray is full is detected and a large capacity ejection mode in which, when an event that the second ejection tray is full is detected, the second ejection tray is further moved down to continue to receive either a recording sheet or a stack of recording sheets until a full in the large capacity ejection mode is detected. Further, the controller may perform the control operation in which the second ejection tray is moved to the finisher outlet and an ejection operation is started under a condition that the large capacity ejection mode is selected and a complex finishing mode is not selected.

When the first ejection tray is set at the straight outlet, the controller may perform the control operation in which an outlet in operation is switched from the finisher outlet to the straight outlet upon a time when the full in the large capacity ejection mode is detected and the ejection operation is continued to the first ejection tray through the straight outlet.

The controller may prohibit a selection of the large capacity ejection mode when the second ejection tray is full and when the first ejection tray is full.

When the second ejection tray is full and when the first ejection tray is not full, the controller may perform the control operation in which the first ejection tray is moved to the straight outlet and the ejection operation is started.

The controller may prohibit a selection of the large capacity ejection mode when the second ejection tray is full, regardless of a fact as to whether the first ejection tray is full.

When an event that one of the plurality of ejection trays in operation is full and others are full is detected, the controller may perform the control operation in which the ejection operation is automatically entered into the large capacity ejection mode.

In the above-mentioned output sheet handling apparatus, a receiving position for the finisher outlet may be a home position of the second ejection tray and a receiving position for the straight outlet may a home position of the first ejection tray.

The first ejection tray may include an end fence, integrally formed with the first ejection tray, for jogging a trailing edge of the stack of recording sheets placed on the first ejection tray, and the apparatus may further include a tray sensor, mounted to the end fence, for detecting an event that the first ejection tray is full.

Further, the present invention provides a method for output sheet handling having a large capacity ejection mode. In one example, a method for output sheet handling having a large capacity ejection mode the steps of forming, making, providing, arranging, and performing. The forming step forms a straight outlet for ejecting a recording sheet and no stack of recording sheets which are processed in a complex finishing mode. The making step makes a finisher outlet, arranged under the straight outlet, for ejecting either a recording sheet or a stack of recording sheets which are processed in a complex finishing mode. The providing step provides a first ejection tray which is movable to the straight outlet and to the finisher outlet to receive the recording sheet from either the straight outlet or the finisher outlet. The arranging step arranges a second ejection tray arranged under the first ejection tray and having a greater loading capacity than the first ejection tray, the second ejection tray being movable to the finisher outlet to receive the recording sheet from the finisher outlet, a standby position at which the second ejection tray stays at idle while the first ejection tray is in operation at the finisher outlet, and a bottom position at which the second ejection tray loaded with a full capacity is detected, the bottom position being under the standby position. The performing step performs a control operation to minimize a total distance which one of the first and second ejection trays in operation and the other are moved during an ejection tray switching operation in accordance with a finishing mode selected when the large capacity ejection mode is selected.

The performing step may perform the control operation based on location information of the first and second ejection trays.

The performing step may prohibit a selection of the large capacity ejection mode when each of the first and second trays is full.

The performing step may perform the control operation in which, when one of the first and second ejection trays is not full and the others is full, the one which is not full is made available to receive the recording sheet ejected.

The performing step may prohibit a selection of the large capacity ejection mode when one of the first and second ejection trays has a greater loading capacity than the other and when such one ejection tray is full.

When one of the first and second ejection trays has a greater loading capacity than the other and when such one ejection tray is not full and the other is full, the performing step may perform the control operation in which the one ejection tray is made available to receive the recording sheet ejected.

Under a condition that the second ejection tray is selected, the performing step may selectively perform a normal ejection mode in which an ejection operation is stopped when an event that the second ejection tray is full is detected and a large capacity ejection mode in which, when an event that the second ejection tray is full is detected, the second ejection tray is further moved down to continue to receive either a recording sheet or a stack of recording sheets until a full in the large capacity ejection mode is detected. In this case, the performing step may perform the control operation in which the first ejection tray is moved to the finisher outlet and an ejection operation is started under a condition that the large capacity ejection mode is selected and a complex finishing mode is selected.

The performing step may prohibit a selection of the large capacity ejection mode when the second ejection tray is full and when the first ejection tray is full.

When the second ejection tray is full and when the first ejection tray is not full, the performing step may perform the control operation in which the first ejection tray is moved to the finisher outlet and the ejection operation is started.

The performing step may prohibit a selection of the large capacity ejection mode when the second ejection tray is full, regardless of a fact as to whether the first ejection tray is full.

When the first ejection tray is full and when the second ejection tray is not full, the performing step may perform the control operation in which the second ejection tray is moved to the finisher outlet and the ejection operation is started.

The performing step may perform the control operation in which the second ejection tray is moved to the finisher outlet and an ejection operation is started under a condition that the large capacity ejection mode is selected and a complex finishing mode is not selected.

When the first ejection tray is set at the straight outlet, the performing step may perform the control operation in which the ejection operation through the finisher outlet is switched to the ejection operation through the straight outlet upon a time when the full in the large capacity ejection mode is detected, and the ejection operation is continued to the first ejection tray through the straight outlet.

The performing step may prohibit a selection of the large capacity ejection mode when the second ejection tray is full and when the first ejection tray is full.

When the second ejection tray is full and when the first ejection tray is not full, the performing step may perform the control operation in which the first ejection tray is moved to the straight outlet and the ejection operation is started.

The performing step may prohibit a selection of the large capacity ejection mode when the second ejection tray is full, regardless of a fact as to whether the first ejection tray is full.

When an event that one of the first and second ejection trays in operation is full and the other is full is detected, the performing step may perform the control operation in which the ejection operation is automatically entered into the large capacity ejection mode.

In the above-mentioned method, a receiving position for the finisher outlet may be a home position of the second ejection tray and a receiving position for the straight outlet may be a home position of the first ejection tray.

The providing step may provide the first ejection tray which comprises an end fence, integrally formed with the first ejection tray, for jogging a trailing edge of the stack of recording sheets placed on the first ejection tray, and the above-mentioned method may further include a mounting step for mounting a tray sensor to the end fence. In this case, the tray sensor detects an event that the first ejection tray is full.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein.

DETAILED DESCRIPTION

Figure 1:
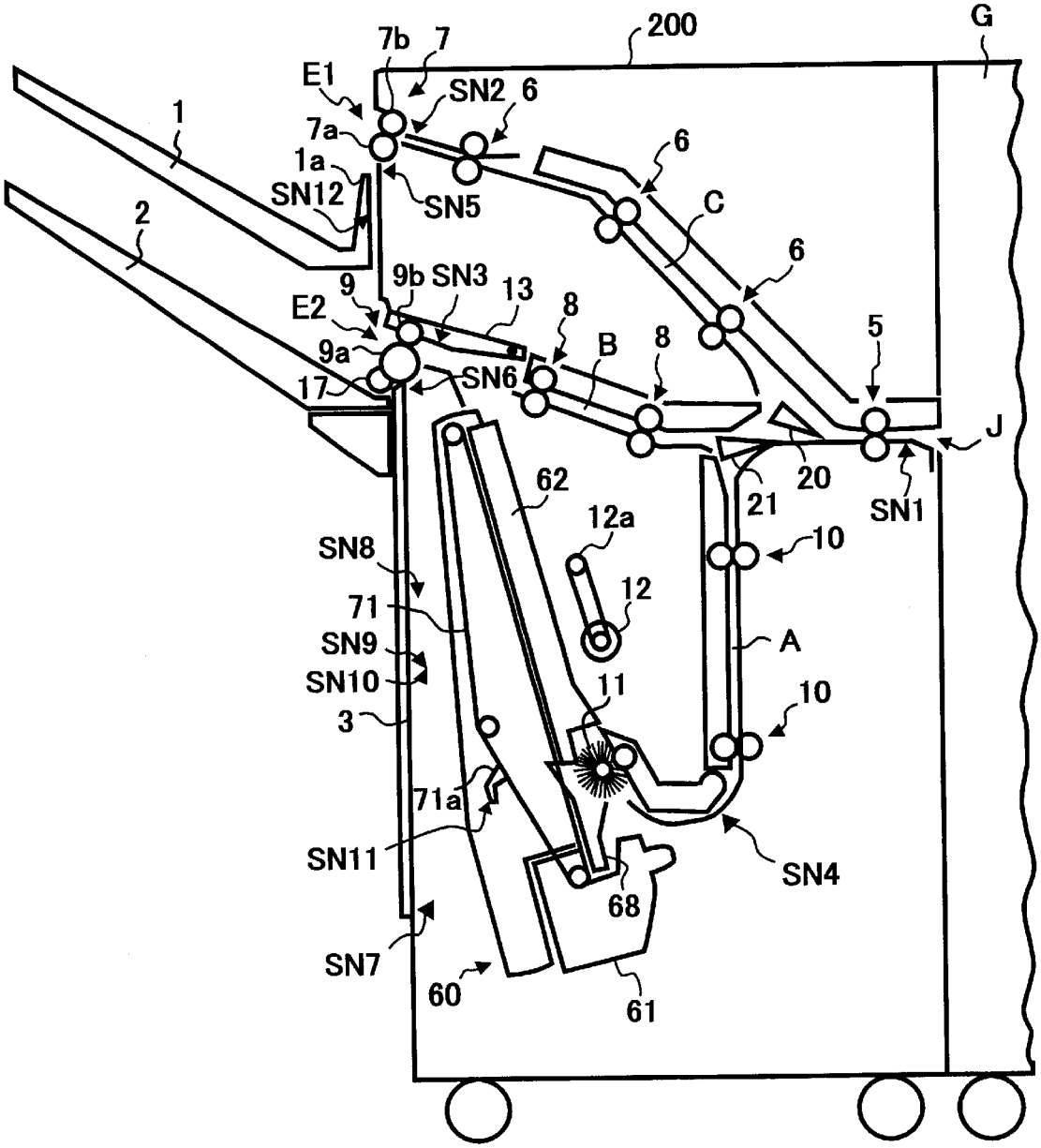
FIG. 1 is a schematic illustration for showing a finishing apparatus having two ejection trays at their home positions according to an embodiment of the present invention.

In describing preferred embodiments illustrated in the drawings, specific terminology is employed for the sake of clarity. However, the invention is not intended to be limited to the specific terminology so selected and it is to be understood that each specific element includes all technical equivalents which operate in a similar manner.

Referring now to the drawings, wherein like reference numerals designate identical or corresponding parts throughout the several views, particularly to FIG. 1, a finishing apparatus 200 according to an embodiment of the present invention is explained. The finishing apparatus 200 shown in FIG. 1 is capable of handling a large number of ejected recording sheets in a variety of finishing modes including a simple finishing mode such as a jogging, a sorting, and so on and a complex finishing mode such as a stapling, and so on. The finishing apparatus 200 is attached to a copying machine G, as partly shown in FIG. 1, which is presented as one example of a general image forming apparatus.

Figure 2:
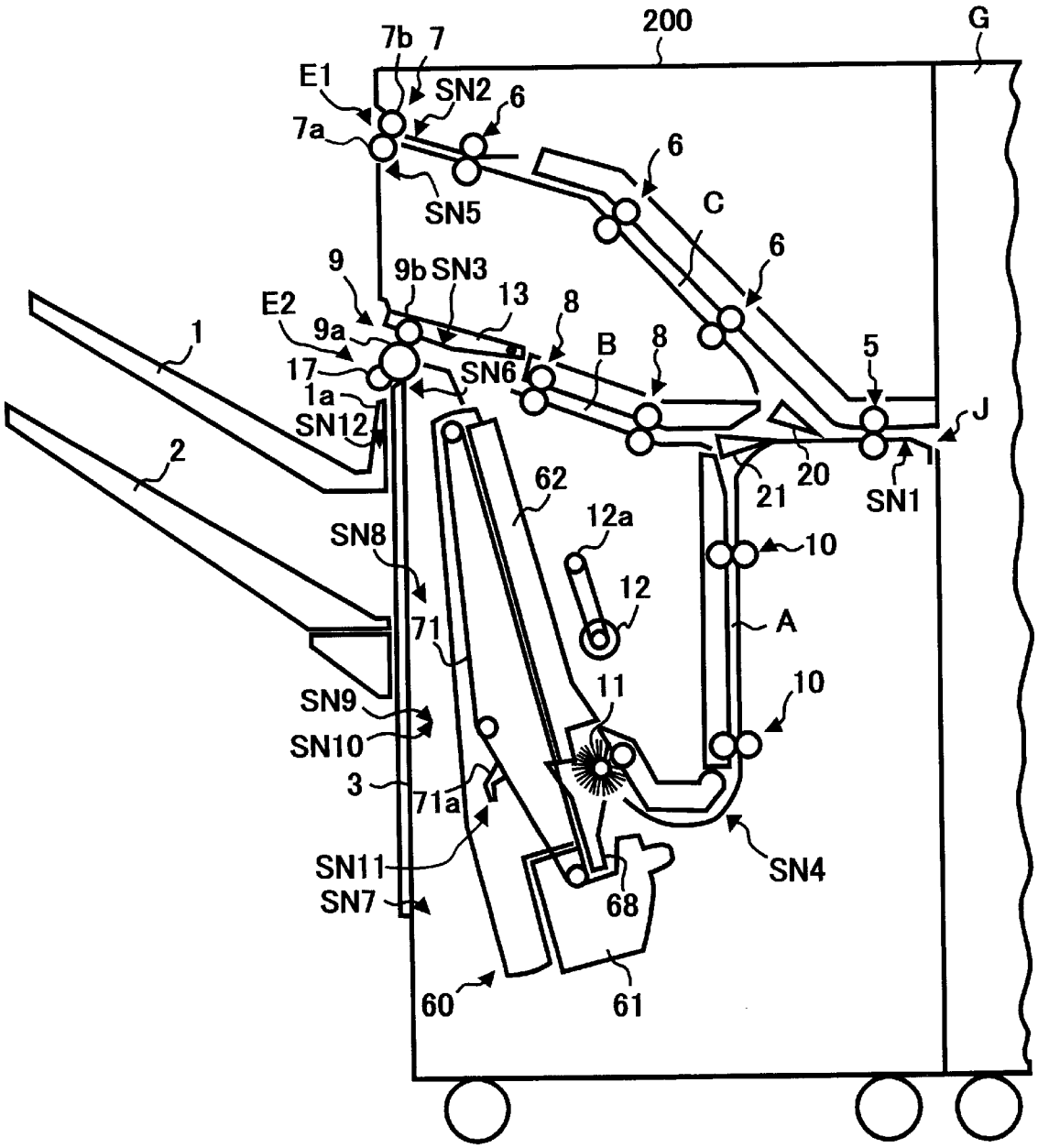
FIG. 2 is another schematic illustration for showing the finishing apparatus of FIG. 1, with the upper ejection tray held at a lower outlet.

FIG. 1 shows one operational condition of the finishing apparatus 200, in which an ejection tray 1 is evacuated to an upper standby position and an ejection tray 2 is moved to a receiving position for an outlet E2, or a finisher outlet. Comparable to this, FIG. 2 shows the finishing apparatus 200 with the same configuration but in another operational condition, in which the ejection tray 2 is evacuated in a lower standby position and the ejection tray 1 is moved at the receiving position for the outlet E2.

As shown in FIG. 1, the finishing apparatus 200 is provided with an inlet sensor SN1 and a pair of inlet rollers 5 mounted next to a sheet passing area J formed between the finishing apparatus 200 and the copying machine G, wherein the inlet rollers 5 transfers a recording sheet coming from the copying machine G to the sheet passing area J into the finishing apparatus 200. The recording sheet thus transferred into the finishing apparatus 200 can be handled in the following three different ways of sheet ejection. In a first way, the recording sheet is not stapled and is ejected from an outlet E1, or a straight outlet, to the ejection tray 1. This way is referred to as a first non-staple mode. In a second way, the recording sheet is not stapled and is ejected from the outlet E2 to either the ejection tray 1 or 2. This way is referred to as a second non-staple mode. In a third way, the recording sheet is stapled and is ejected from the outlet E2 to either the ejection tray 1 or 2.

A first non-staple path C is the passage to the outlet E1, through which the recording sheet is not stapled. The first non-staple path C is selected by a junction pawl 20 provided downstream from the inlet rollers 5, and the recording sheet is transferred through this first non-staple path C by pairs of transfer rollers 6 mounted along the first non-staple path C and is ejected from the outlet E1 to the ejection tray 1 by a pair of ejection rollers 7. The ejection rollers 7 include a driving roller 7*a* and a driven roller 7*b*, wherein the driven roller 7*b* is configured to contact the driving roller 7*a* with a pressure by its own weight and a rotating inertial force so as to drive the recording sheet.

The junction pawl 20 is driven by a solenoid 20*a* (FIG. 15) when the solenoid 20*a* is energized. When the solenoid 20*a* is not energized, the junction pawl 20 is not driven and is in the position as shown in FIG. 1 so that the recording sheet is directed towards the outlet E1. The recording sheet transferred through the first non-staple path C by the transfer rollers 6 is detected by a ejection sensor SN2 provided close to the ejection rollers 7.

Figure 15:
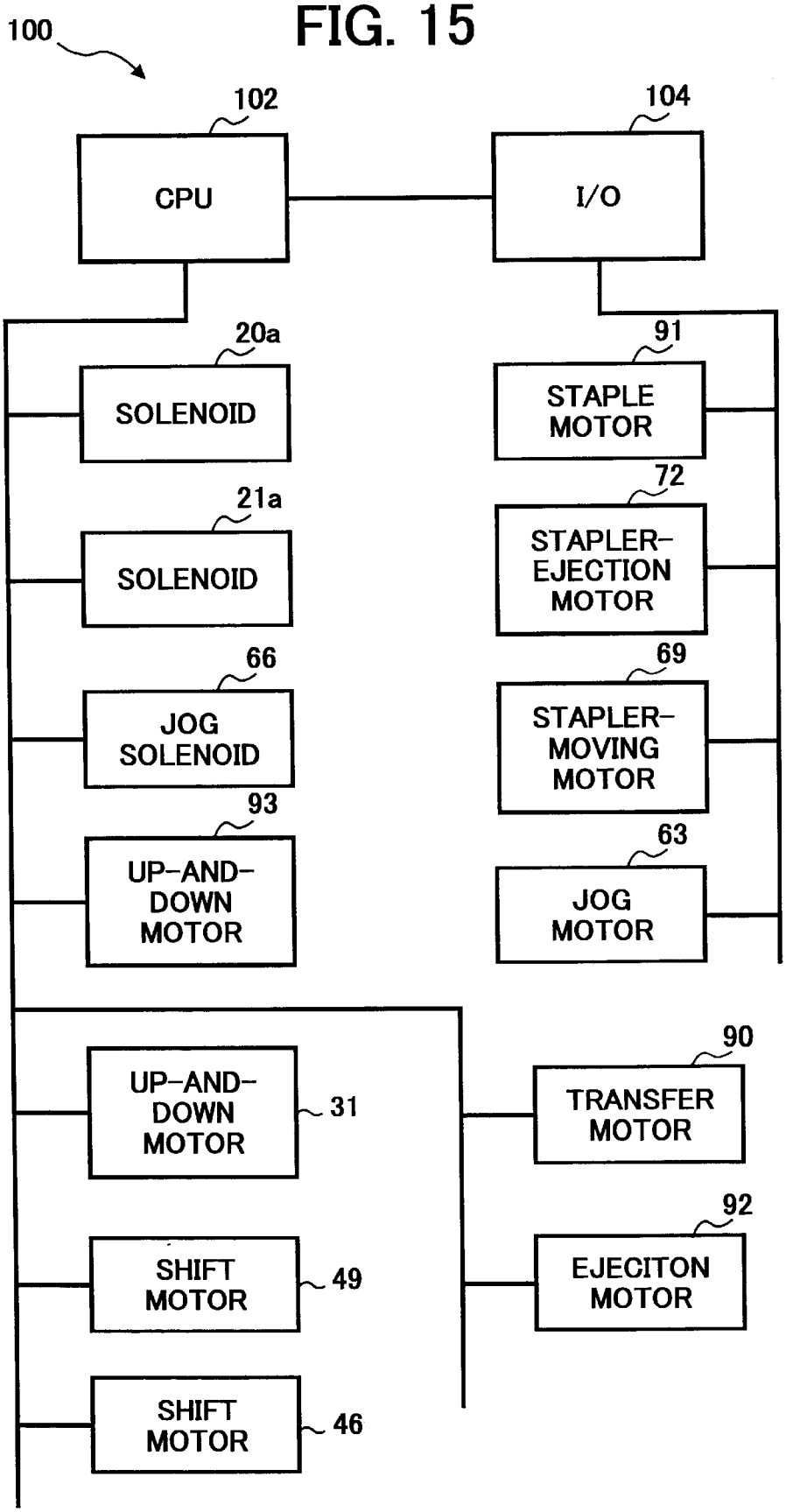
FIG. 15 is a block diagram of a controller for controlling the mechanisms of the finishing apparatus of FIG. 1.

When the solenoid 20*a* is energized and the junction pawl 20 is turned upwards, the recording sheet is forwarded in an approximately horizontal direction. Another junction pawl 21 is provided downstream from the junction pawl 20, and the recording sheet transferred in the approximately horizontal direction by the junction pawl 20 is selectively directed by the junction pawl 21 either to a second non-staple path B through which the recording sheet is not stapled or a staple path A through which the recording sheet is stapled. The junction pawl 21 is driven by a solenoid 21*a* (FIG. 15). When the solenoid 21*a* is energized, the junction pawl 21 is driven to turn upwards and the recording sheet is directed into the staple path A in an approximately vertical direction. When the solenoid 21*a* is not energized, the junction pawl 21 is in the position as shown in FIG. 1 and the recording sheet is directed to the second non-staple path B.

In the second non-staple path B, the recording sheet is transferred by pairs of transfer rollers 8 and is ejected by a pair of ejection rollers 9 to either the ejection tray 1 or 2. The recording sheet passing through the second non-staple path B or the staple path A is detected by an outlet sensor SN3 mounted near the ejection rollers 9.

In the staple path A, the recording sheet is transferred by pairs of transfer rollers 10 and is conveyed to a staple unit 60 for stapling a set of the recording sheets. A recording sheet set is then stapled by the staple unit 60 and is ejected by the ejection rollers 9 either to the ejection tray 1 or 2. The stapled recording sheet set passing through the staple path A is detected by a staple sensor SN4 mounted downstream from the transfer rollers 10.

The ejection rollers 9 include a driving roller 9*a* and a driven roller 9*b*. The driven roller 9*b* is held for free rotation by a supporting member 13. The supporting member 13 is supported on one side upstream in the direction of the recording sheet flow and, therefore, the other side of the supporting member 13 to which the driven roller 9*b* is mounted is movable up and down. The driven roller 9*b* usually contacts the driving roller 9*a* with a pressure by its own weight and a rotating inertial force so as to drive the recording sheet. But, when the stapled recording sheet set is ejected, the supporting member 13 is turned upwards and, at a predetermined timing, is turned downwards. This predetermined timing is determined based on a signal from the ejection sensor SN3.

A large capacity ejected-sheet handling facility of the finishing apparatus 200 is formed by a number of components including the above-mentioned ejection rollers 7 and 9, the ejection trays 1 and 2, and a mechanism for elevating the ejection trays 1 and 2 (explained later), and a mechanism for shifting the sheets (explained later).

The image forming method and its configuration of the copying machine G is known although it is not shown. That is, the copying machine G performs a procedure in which an electrostatic latent image is generated on an image carrying member in accordance with image information from an original, the latent image is visualized with toner, the toner image is transferred to a recording sheet with an electrostatic force, the recording sheet having the toner image is conveyed to a fixing station, and the toner image is fixed on the recording sheet with the fixing station by heat and pressure.

As shown in FIG. 1, the finishing apparatus 200 is provided with several more sensors. A tray sensor SN5 is mounted near the outlet E1 to detect an event that the ejection tray 1 comes to the upper standby position in a case, for example, when the ejection tray 2 is moved to the receiving position for the outlet E2. This upper standby position is also used by the ejection tray 1 as a receiving position for the outlet E1. A tray sensor SN6 is mounted near the outlet E2 to detect an event that the ejection tray 1 comes to the receiving position for the outlet E2 in the case when the ejection tray 1 is moved to the receiving position for the outlet E2. The tray sensor SN6 also detects an upper surface of the ejection tray 2 or an upper surface of an uppermost recording sheet placed on the ejection tray 2. A tray sensor SN8 is mounted near the lower standby position to detect an event that the ejection tray 2 comes to the lower standby position. If the ejection tray 2 contains the ejected recording sheets thereon, the tray sensor SN8 detects a top surface of the ejected recording sheets. A tray sensor SN9 is mounted under the tray sensor SN8 and detects an event that the ejection tray 2 contains a maximum amount of the recording sheets. A tray sensor SN10 is mounted under the tray sensor SN9 and detects the position of the ejection tray 2 and a lower limit of the tray position in a large amount ejection mode. A tray sensor SN7 is mounted under the tray sensor SN10 and detects an event that the ejection tray 2 comes to a lower limit position. As shown in FIG. 15, the detection signals from these tray sensors SN5–SN10 are input to a CPU (central processing unit) 102 via an I/O (input and output) interface 104, explained later.

When the ejection tray 1 is moved to the receiving position for the outlet E2, the ejection tray 2 is moved to the lower standby position at which it is detected by the tray sensor SN8, but not to the lower limit position, thereby quickly reaching the receiving position of the outlet E2 when the ejection tray 2 is requested to move thereto.

The positions of the above-mentioned tray sensors SN5–SN10 are actually different from each other in the direction of the recording sheet flow in accordance with the functions thereof. For the sake of convenience, however, FIGS. 1 and 2 indicate only the differences in the vertical position of these tray sensors SN5–SN10 but not the differences in the direction of the recording sheet flow. In addition, throughout the drawings, the tray sensors SN5–SN10 are often shown in triangle forms having different sizes from each other, which differences do not mean the differences in functions of the tray sensors SN5–SN10 but are caused only due to the limitations of drawing spaces.

The ejection trays 1 and 2 are independently driven by different power supply units and are controlled by a controller 100, explained later with reference to FIG. 15, to move to the receiving position for the outlet E2, for example.

Next, a configuration of the staple unit 60 is explained. The staple unit 60 includes a staple tray (not shown) to which the recording sheet guided to the staple path A is conveyed by the transfer rollers 10 and a pair of ejection rollers 11. In this case, a stack of the recording sheets contained in the staple tray is jogged in the length direction, or in the direction of the recording sheet flow, by a jog roller 12 and in the width direction, or in the direction orthogonal to the length direction, by a pair of jog fences 62. Upon a receipt of the last recording sheet for the stack of the recording sheets presently place in the staple tray, the controller 100 (explained later) instructs a stapler 61 to perform a stapling operation which is completed before the first recording sheet of the next stack of the recording sheets comes into the staple unit 60.

Figure 6:
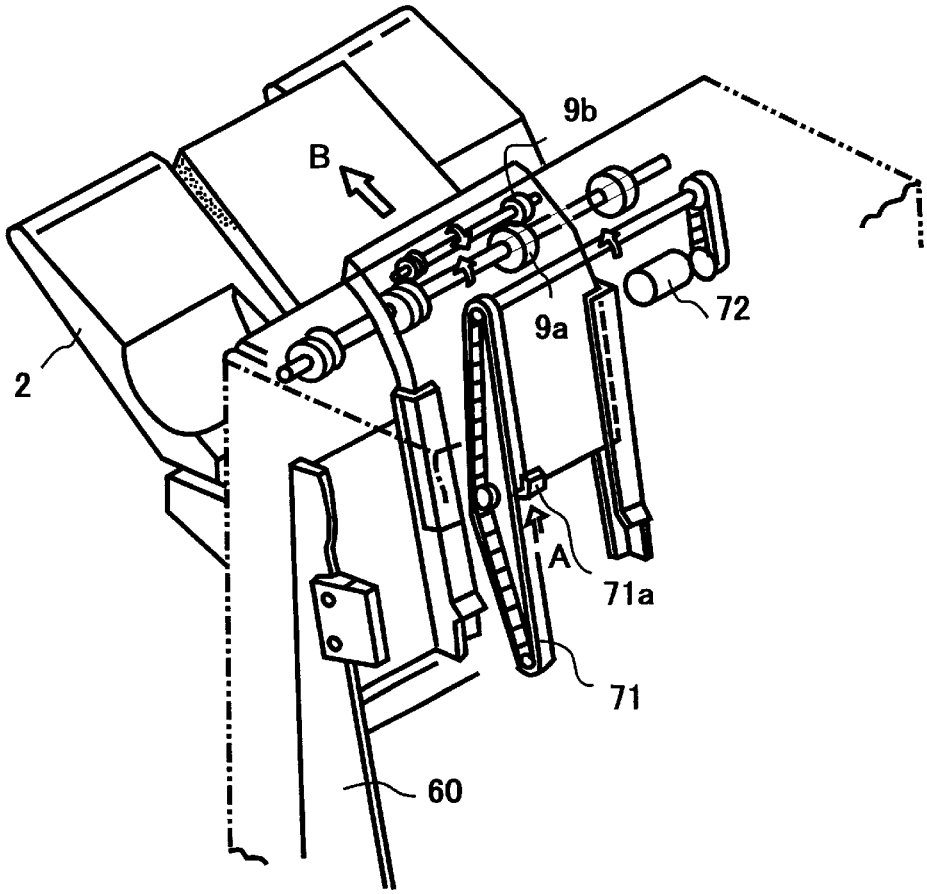
FIG. 6 is a schematic illustration for explaining an ejection operation of the staple unit of FIG. 3.
Figure 7:
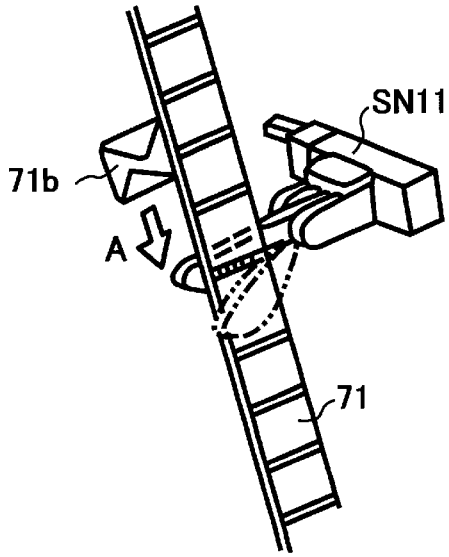
FIG. 7 is a schematic illustration for explaining a detection mechanism for detecting a home position of a stapler-ejection belt included in the staple unit of FIG. 3.

Upon a completion of the stapling operation, the stapled stack of recording sheets is conveyed to the ejection rollers 9 by a stapler-ejection belt 71 having a stapler-ejection pawl 71*a* and a sensor actuator 71*b* and which is rotated in a direction indicated by an arrow A in FIG. 6. Then, the stapled stack of recording sheets is ejected in a direction indicated by an arrow B in FIG. 6 to the ejection tray 2, or the ejection tray 1, locating at the receiving position for the outlet E2, as shown in FIG. 6. The stapler-ejection pawl 71*a* indicates a home position of the stapler-ejection belt 71 rotating in a direction indicated by an arrow A in FIG. 7 when it is detected by a belt sensor SN11 which is activated and inactivated by the sensor actuator 71*b*, as shown with dotted lines in FIG. 7.

Figure 3:
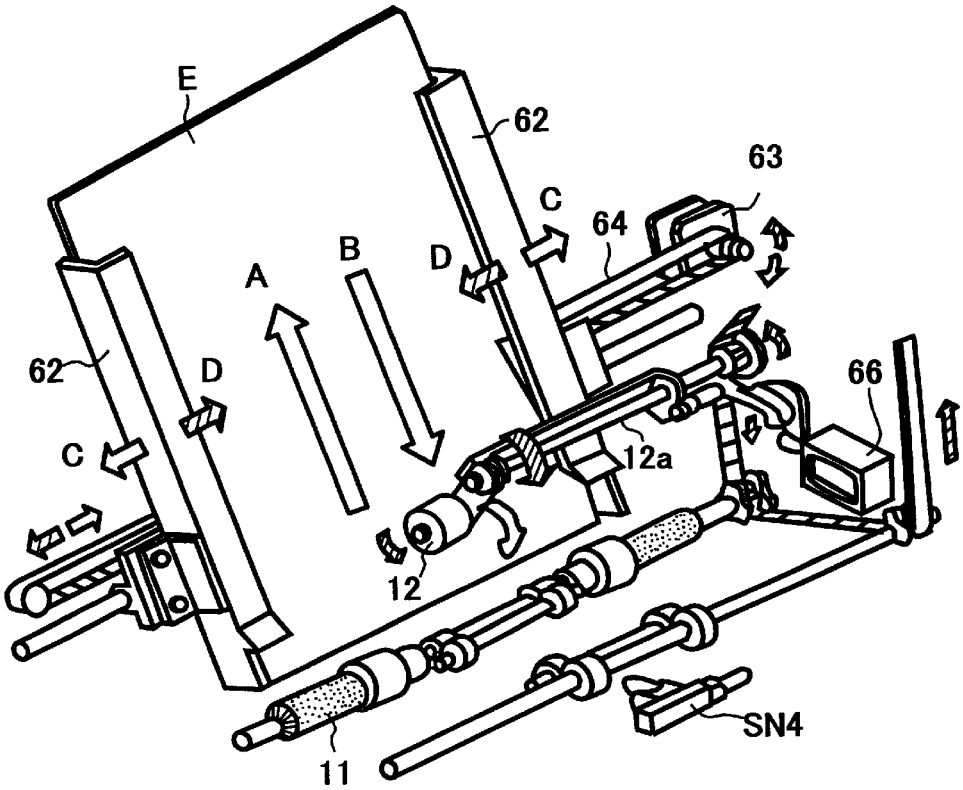
FIG. 3 is a schematic illustration for showing a perspective exploded view of a staple unit included in the finishing apparatus of FIG. 1.
Figure 4:
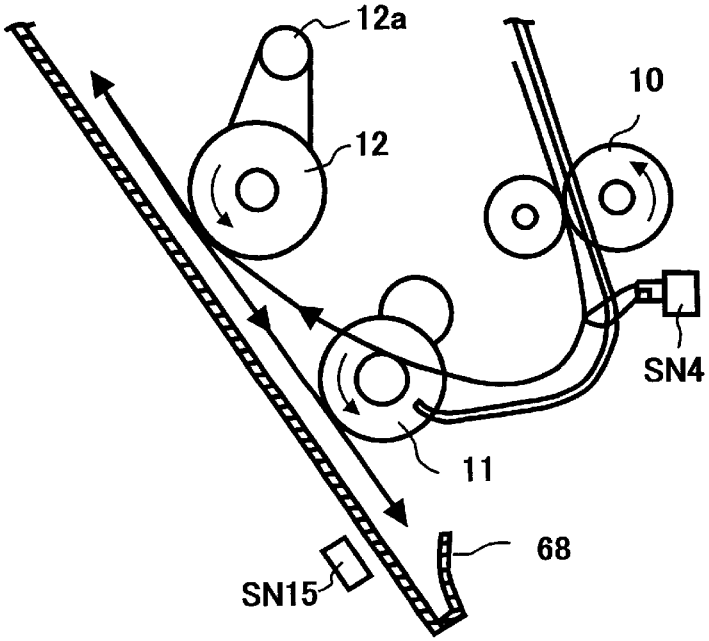
FIG. 4 is a schematic illustration for explaining a jog operation in the staple unit of FIG. 3.

As shown in FIG. 3, the jog roller 12 is swung back and forth about a fulcrum 12*a* in directions indicated by arrows A and B in FIG. 3 by a jog solenoid 66 and jogs the recording sheet conveyed into the staple tray to cause the recording sheet to fall on a rear edge fence 68, as shown in FIG. 4. At this time, the jog roller 12 is rotated counterclockwise to cause the recording sheet to fall on the rear edge fence 68, and the recording sheet is prevented from flowing in a reverse direction with a brush roller included in the ejection rollers 11 (FIG. 1).

Figure 5:
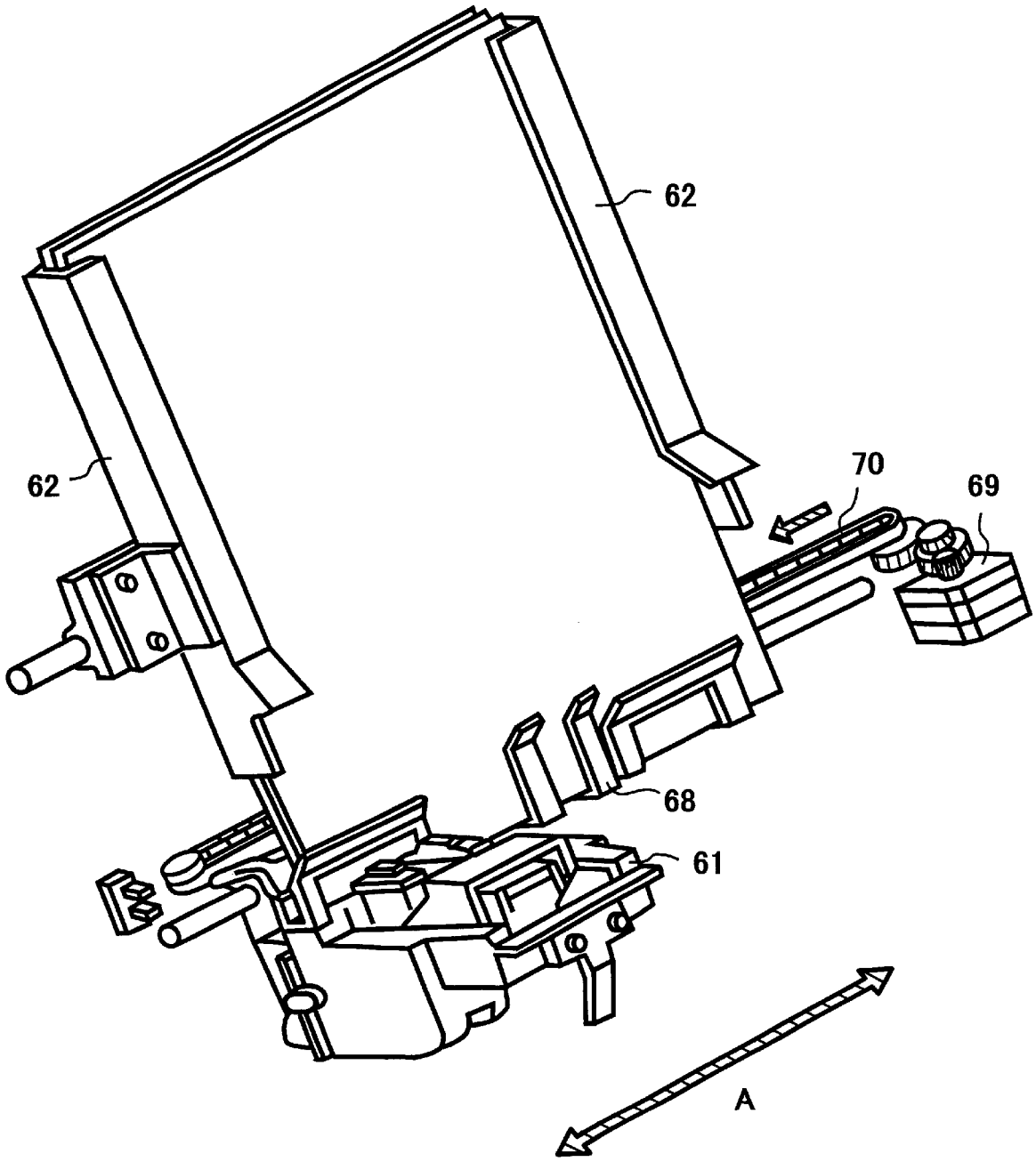
FIG. 5 is a schematic illustration for explaining a shift motion of a stapler included in the staple unit of FIG. 3.

The jog fences 62 are driven by a reversibly rotatable jog motor 63 via a jog belt 64 to move back and forth in the width direction of the recording sheet, as indicated by arrows C and D in FIG. 3, in order to hold and release the stack of recording sheets placed in the staple tray. The stapler 61 is driven by a reversibly rotatable stapler-moving motor 69 via a staple belt 70 to move back and forth in the width direction of the recording sheet, as indicated by an arrow A in FIG. 5, so as to perform the stapling operation at predetermined positions in an edge area of the recording sheet. The staple sensor SN4 is located at a position such that, when the jog solenoid 66 is energized immediately after the staple sensor SN4 detects the trailing edge of the recording sheet and the jog roller 12 is activated, the jog roller 12 perfectly ejects the recording sheet into the staple tray and the trailing edge of the recording sheet is then directed towards the rear edge fence 68 so that the stack of the recording sheets in the staple tray are jogged.

Next, an exemplary operation of the finishing apparatus 200 in a staple mode is explained. In FIG. 3, a stack of recording sheets is indicated by a letter E. When a staple mode is selected, each of the jog fences 62 is moved away from its home position and is stopped at a standby position having a distance of 7 mm from a position to which a side edge of the recording sheet is supposed to locate in the staple tray. Then, the recording sheet is transferred by the transfer rollers 10, and when the recording sheet passes by the staple sensor SN4 each of the jog fences 62 is moved inwardly by 5 mm from the standby position and is stopped.

The staple sensor SN4 detects the passing recording sheet by the trailing edge thereof and generates a detection signal which is input to the CPU 102 (FIG. 15). Upon receiving this detection signal from the staple SN4, the CPU 102 starts to count a number of pulses generated by a transfer motor 90 (FIG. 15) driving the transfer rollers 10 and energizes the jog solenoid 66 upon counting a predetermined number of the pulses. The jog roller 12 is moved like a pendulum by an on-and-off action of the jog solenoid 66 so as to jog the recording sheet when the jog solenoid 66 is energized, and the recording sheet falls downwards and is stopped by the rear edge fence 68.

Each time when the recording sheet to be conveyed to the staple tray is detected by the inlet sensor SN1, or the staple sensor SN4, the CPU102 receives the detection signal and increments a number of sheets by one.

In a predetermined time period after the jog solenoid 66 is off-energized, each of the jog fences 62 is further moved inwardly by 2.6 mm and is stopped. Thereby, the jogging operation in the width direction is completed. After that, each of the jog fences 62 is moved backward by 7.6 mm to the standby position and waits for the next recording sheet. These sequential operations will be repeated to the last recording sheet. After that, the jog fence is again moved inwardly by 7.6 mm and is stopped to prepare for the stapling operation with holding both side edges of the stack of the recording sheets. Then, in a predetermined time period, the stapler 61 is driven by a staple motor 91 (FIG. 15) to perform the stapling operation. If a multi-staple mode is selected, the stapler-moving motor 69 (FIG. 5) is energized upon a completion of the stapling operation at one location to move the stapler 61 to the next stapling position along the rear edge of the stack of the recording sheets. Then, the subsequent stapling operation is performed.

When the stapling operation is completed, a stapler-ejection motor 72 (FIG. 6) is energized and the stapler-ejection belt 71 is driven. At this time, an ejection motor 92 is also energized to drive the ejection rollers 9 which will receive the stack of recording sheets lifted up by the stapler-ejection pawl 71*a*. In this operation, the jog fences 62 are controlled to behave differently according to the size of the recording sheet and the number of recording sheets in a stack to be stapled. For example, if the size of the recording sheet is smaller than a predefined size or if the number of recording sheets in a stack to be stapled is smaller than a predefined number, the stack of recording sheets is held by the jog fences 62 and is conveyed by the stapler-ejection pawl 71*a* hooking the trailing edge of the recording sheet stack. The stack of recording sheet is then detected by a sheet sensor SN15 (FIG. 4), or the belt sensor SN11 for detecting the home position of the stapler-ejection pawl 71*a*. Upon a count of a predetermined number of pulses after the detection signal, each of the jog fences 62 is moved away by 2.6 mm to release the stack of recording sheets. With this predetermined number of pulses, the above release timing is conducted during a time period from a time when the stapler-ejection pawl 71*a* hits the rear edge of the recording sheet stack to a time when the stapler-ejection pawl 71*a* passes by the tops of the jog fences 62. But, if the size of the recording sheet is greater than a predefined size or if the number of recording sheets in a stack to be stapled is greater than a predefined number, each of the jog fences 62 is moved away by 2.6 mm and the stack of recording sheets is ejected from the staple unit 60. In both cases, when the stack of recording sheets completely comes out of the jog fences 62, each of the jog fences 62 is moved further away by 5 mm and is located at the standby position to wait for the next incoming recording sheet. The force to hold the stack of recording sheet can be controlled by varying a distance of the jog fences 62 relative to the stack of recording sheets.

As shown in FIG. 1, the ejection tray 1 includes an end fence la molded in one piece with the ejection tray 1 and which evens up the edges of the recording sheets in the ejection tray 1. On the end fence la, a tray sensor SN12 for detecting an event that the ejection tray 1 contains recording sheets to an extent of a maximum capacity is mounted. To even up the edges of the recording sheets in the ejection tray 2, there is provided an end fence 3 forming a side surface of the finishing apparatus 200 and which performs this function.

Figure 10:
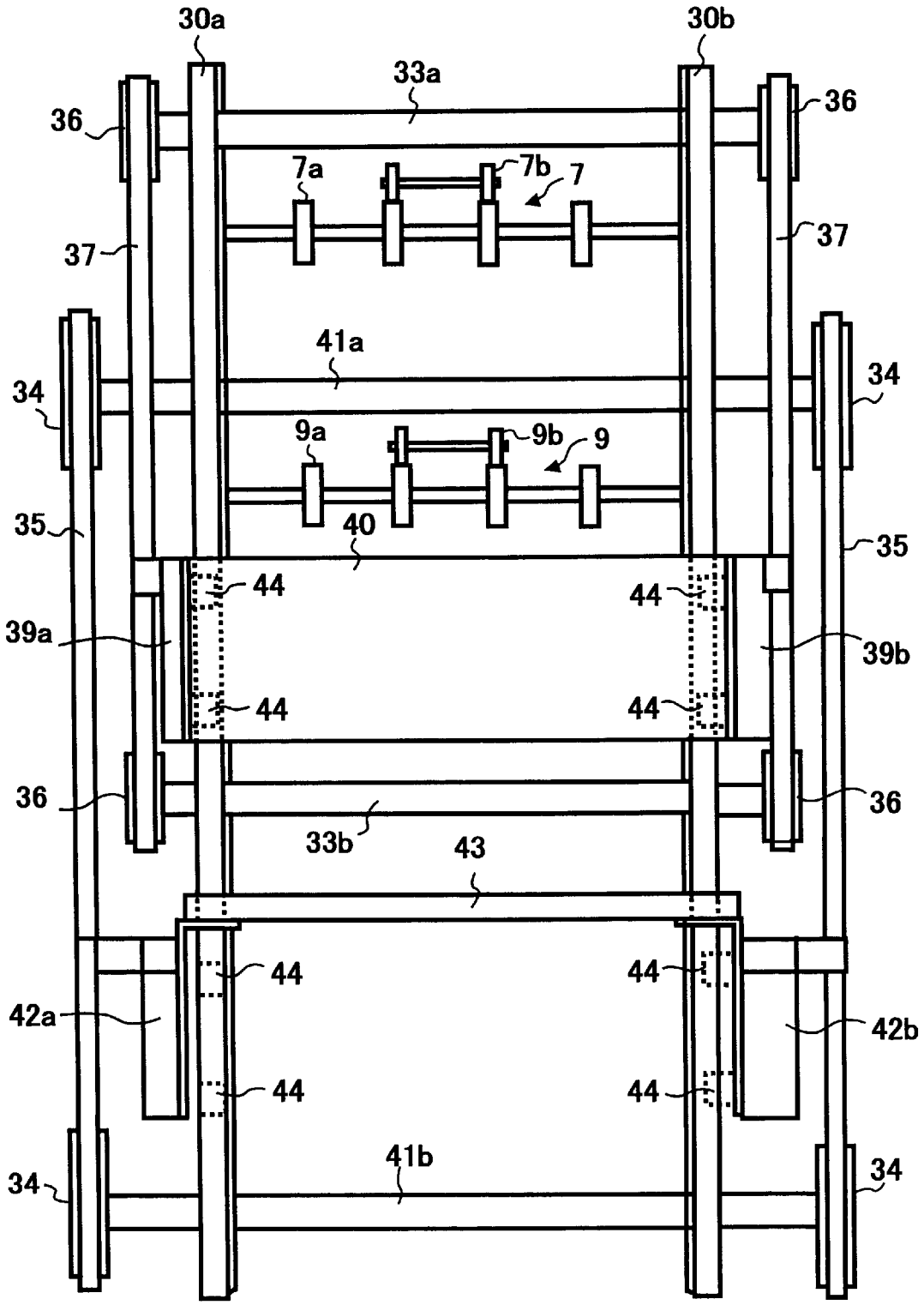
FIG. 10 is a schematic illustration for explaining a structure of the elevation mechanism of FIG. 9.

Next, a first example of an elevation mechanism for the ejection trays 1 and 2 is explained. As shown in FIG. 10, the ejection tray 1 is mounted to a base 40 arranged between side plates 39*a* and 39*b*. To each of the side plates 39*a* and 39*b*, guide rollers 44 are mounted for rotation via short axles (not shown). The guide rollers 44 are engaged in grooves of guide rails 30*a* and 30*b* to be able to move up and down along the guide rails 30*a* and 30*b*. The guide rollers 44 are prevented from disengaging from the guide rails 30*a* and 30*b* since they are positioned by assembling the side plates 39*a* and 39*b* and the base 40. A timing belt 37 is hooked under tension on each side of a shaft combination consisting of a driving shaft 33*a* and a driven shaft 33*b* via timing pulleys 36. A part of the side plate 39*a* and a part of the side plate 39*b* are respectively secured to parts of the timing belts 37, as shown in FIG. 10. With the above-mentioned configuration, a unit of the ejection tray 1 is held for an up-and-down movement. The ejection tray 1 is driven for the up-and-down movement by an up-and-down motor 93 (FIG. 15) of a driving unit (not shown).

In the same way as the ejection tray 1, the ejection tray 2 is mounted to a base 43 arranged between side plates 42*a* and 42*b*. To each of the side plates 42*a* and 42*b*, guide rollers 44 are mounted for rotation via short axles (not shown). The guide rollers 44 are engaged in grooves of guide rails 30*a* and 30*b* to be able to move up and down along the guide rails 30*a* and 30*b*. The guide rollers 44 are prevented from disengaging from the guide rails 30*a* and 30*b* since they are positioned by assembling the side plates 42*a* and 42*b* and the base 43. A timing belt 35 is hooked under tension on each side of a shaft combination consisting of a driving shaft 41*a* and a driven shaft 41*b* via timing pulleys 34. A part of the side plate 42*a* and a part of the side plate 42*b* are respectively secured to parts of the timing belts 35, as shown in FIG. 10. With the above-mentioned configuration, a unit of the ejection tray 2 is held for an up-and-down movement.

Figure 11:
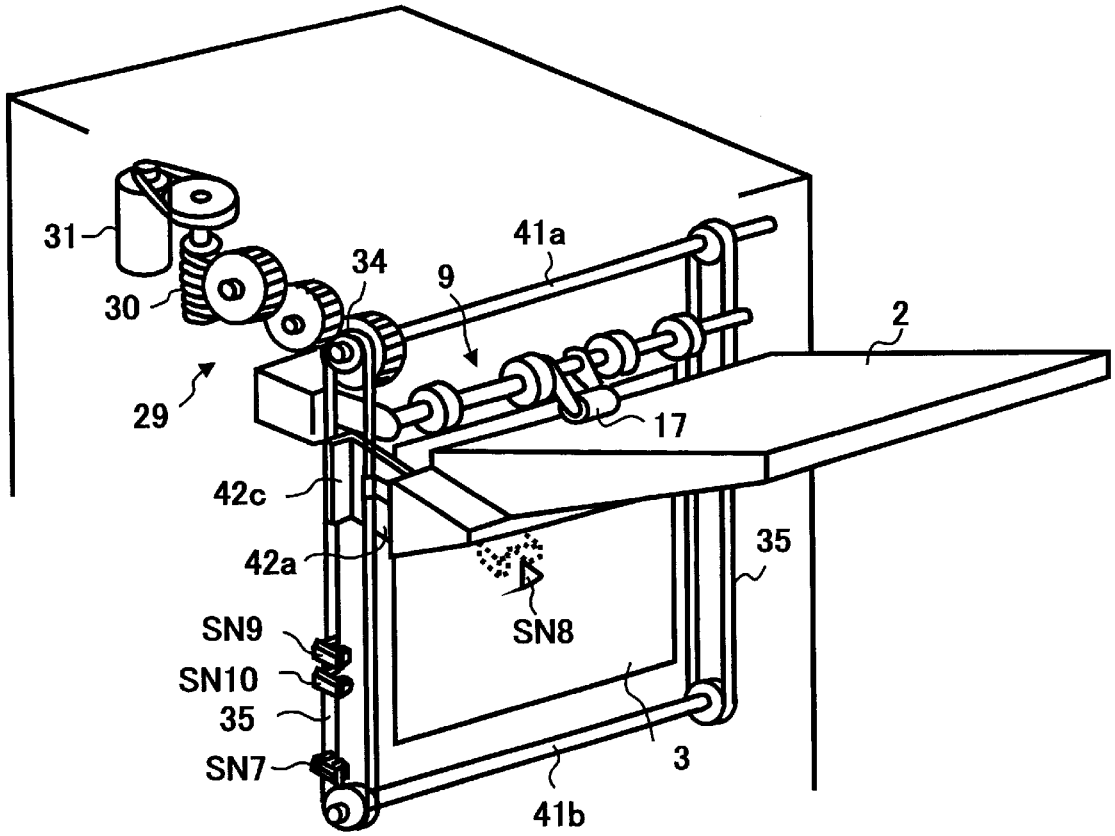
FIG. 11 is a schematic illustration for explaining a driving mechanism for moving the lower ejection tray.

The ejection tray 2 configured in the above-mentioned way is driven by a tray-drive unit 29, shown in FIG. 11, to move up and down. A power generated by an up-and-down motor 31 is transmitted to the last gear of aligned gears secured to the driving shaft 41*a* via a worm gear 30. Since the worm gear 30 is provided in between, it becomes possible that the ejection tray 2 can be held at a certain position. The ejection tray 1 is driven in a similar manner. In FIG. 11, the driven roller 9*b* is omitted. In addition, FIG. 11 shows a roller 17 made of sponge rubber and which evens up the rear edge of the recording sheet in the ejection tray 2.

Figure 8:
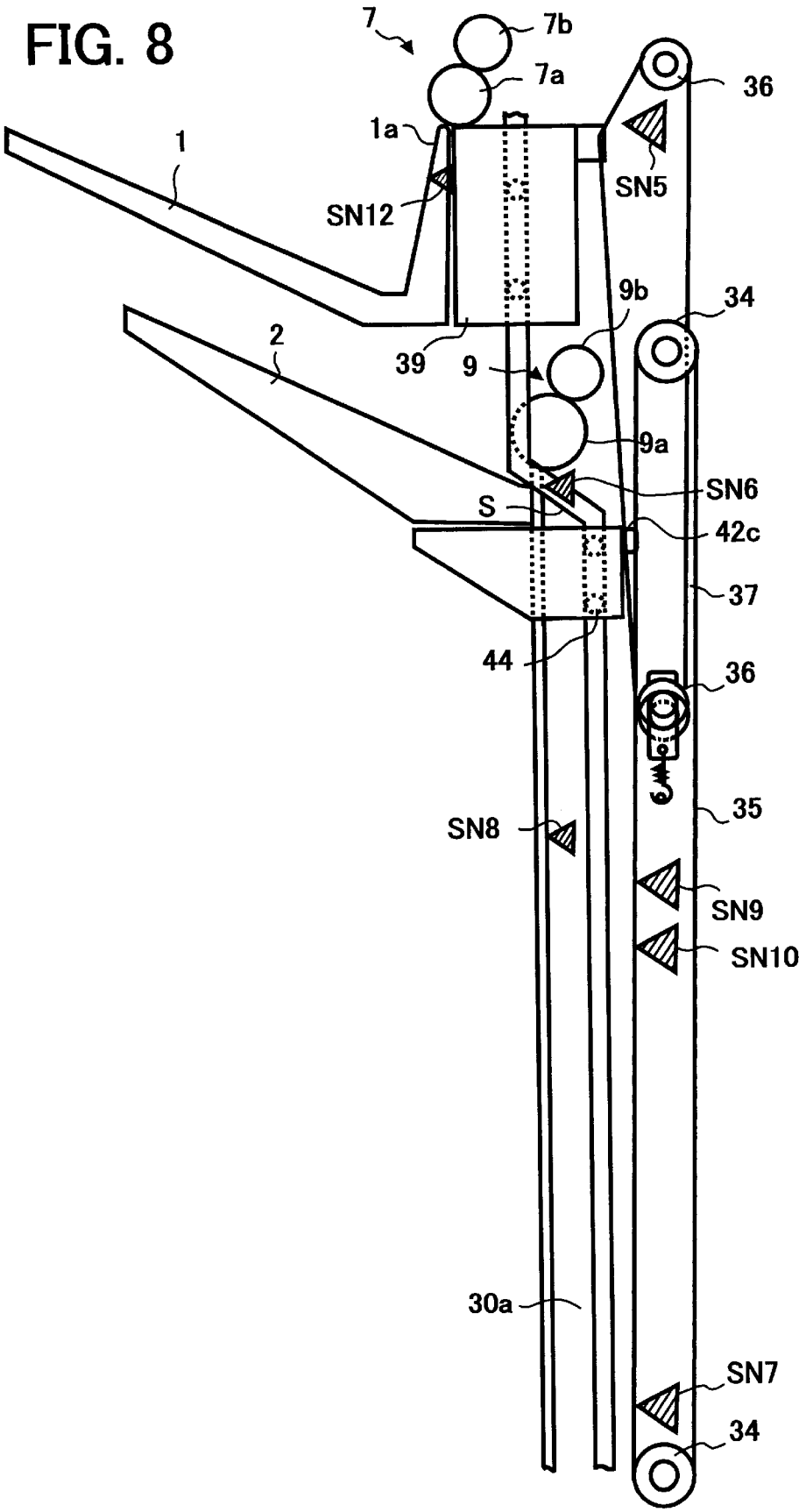
FIG. 8 is a schematic illustration for showing a sectional side view of an elevation mechanism for moving ejection trays up and down, wherein a lower tray is held at a lower outlet.
Figure 9:
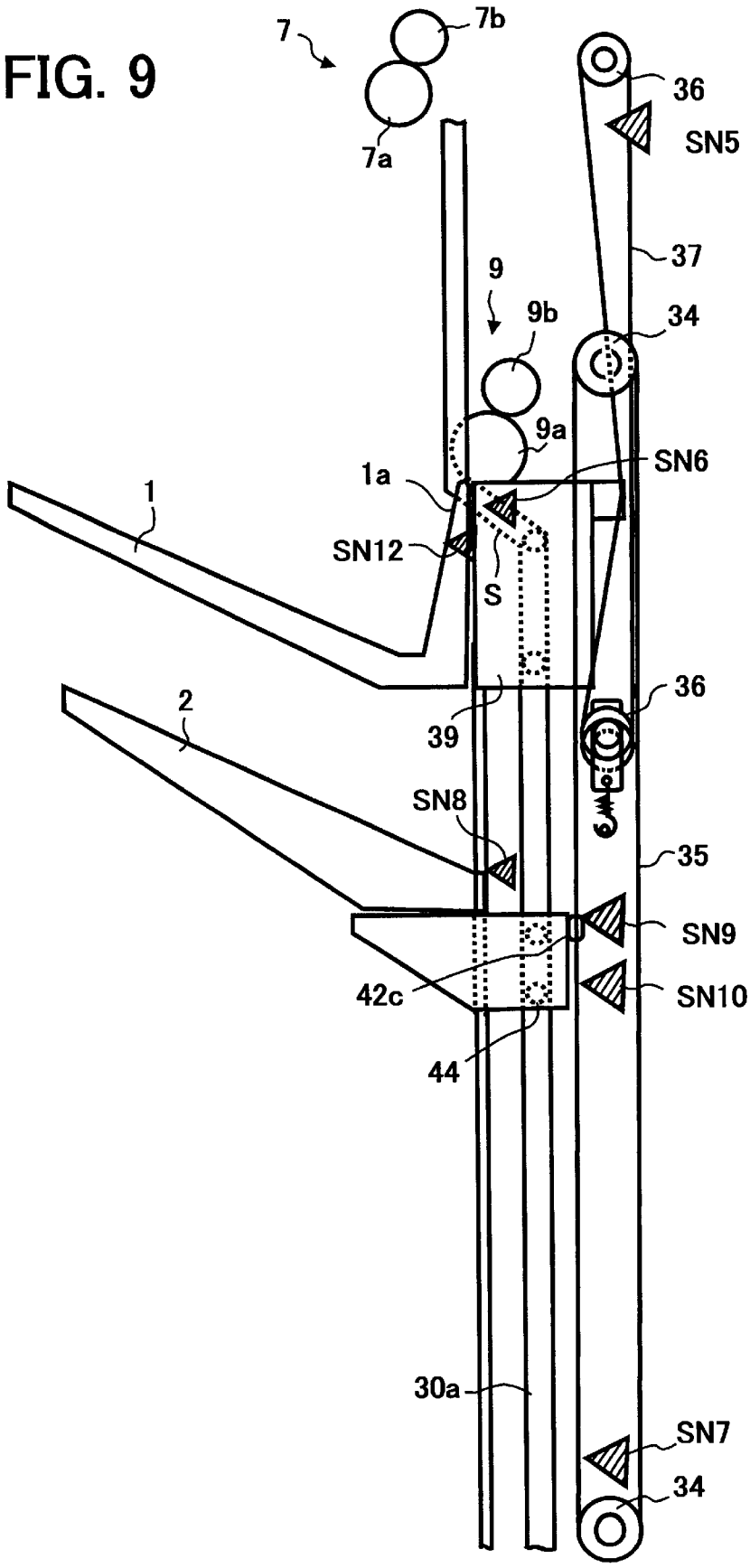
FIG. 9 is a schematic illustration for showing another sectional side view of the elevation mechanism for moving the ejection trays up and down, wherein an upper tray is held at the lower outlet.

The ejection trays 1 and 2 use in common the guide rails 30*a* and 30*b* both having a bend S, as shown in FIGS. 8 and 9. This structure is to allow the ejection tray 1 to slide down smoothly over the ejection rollers 9. When the ejection tray 1 is moved upwards in a case that the ejection tray 2 is located at the receiving position of the outlet E2, the ejection tray 1 is swayed by displacements of the guide rollers 44 and can avoid causing interference with the ejection rollers 9. FIG. 8 shows a manner in which the ejection tray 2 is located at the receiving position of the outlet E2 while the ejection tray 1 is held at the standby position. Each of the timing pulleys 36, hooked at a lower position by the timing belt 37, is secured to a movable bracket held with a spring so as to be movable, as shown in FIG. 8, which arrangement prevents the timing belt 37 from changing the tension when the ejection tray 1 is swayed.

In FIG. 11, a shutter plate 42*c* is integrally formed with the side plate 42*a* of the ejection tray 2 and is moved up and down with the movement of the ejection tray 2. The tray sensors SN7, SN9, and SN10, which are a photo-sensor, are turned on when the shutter plate 42*c* is moved and blocks the light path of the photo-sensor. The tray sensor SN8 has a detection knob which is projected from the surface of the end fence 3 and is turned on when this detection knob is pressed by the ejection tray 2 moving down.

Figure 12A:
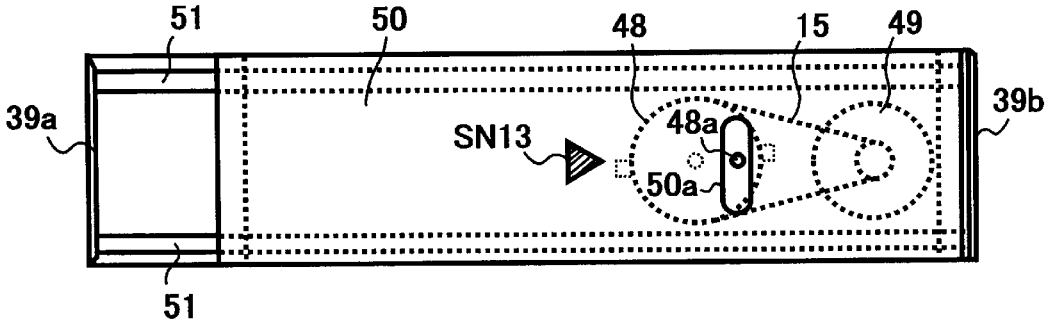
FIGS. 12A and 12B are schematic illustrations for explaining a shift mechanism of the upper ejection tray.
Figure 12B:
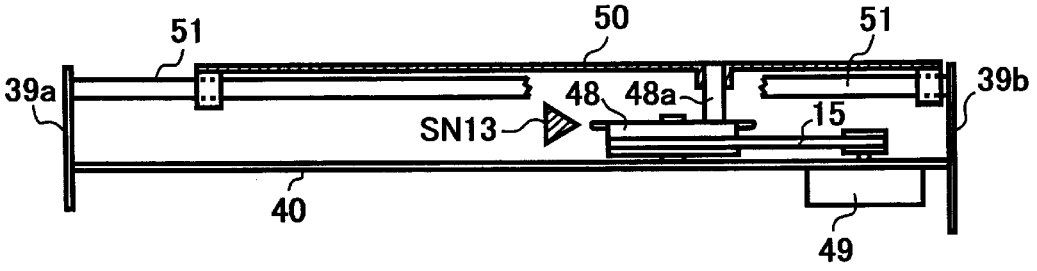

As shown in FIGS. 12A and 12B, the side plates 39*a* and 39*b* secured to the base 40 of the ejection tray 1 are provided with guide rods 51 to which a slider 50 is slidably mounted. The slider 50 is driven to slide by a crank pulley 48 rotated by a shift motor 49 via a belt 15. Stop positions of the slider 50 is watched by a shift sensor SN13. The ejection tray 1 is secured to the slider 50 and is therefore slidable in the direction orthogonal to the direction of ejecting the recording sheets so as to perform an offset stack operation. In FIG. 12, an eccentric pin 48*a* is engaged in a slide hole 50*a*.

Figure 13:
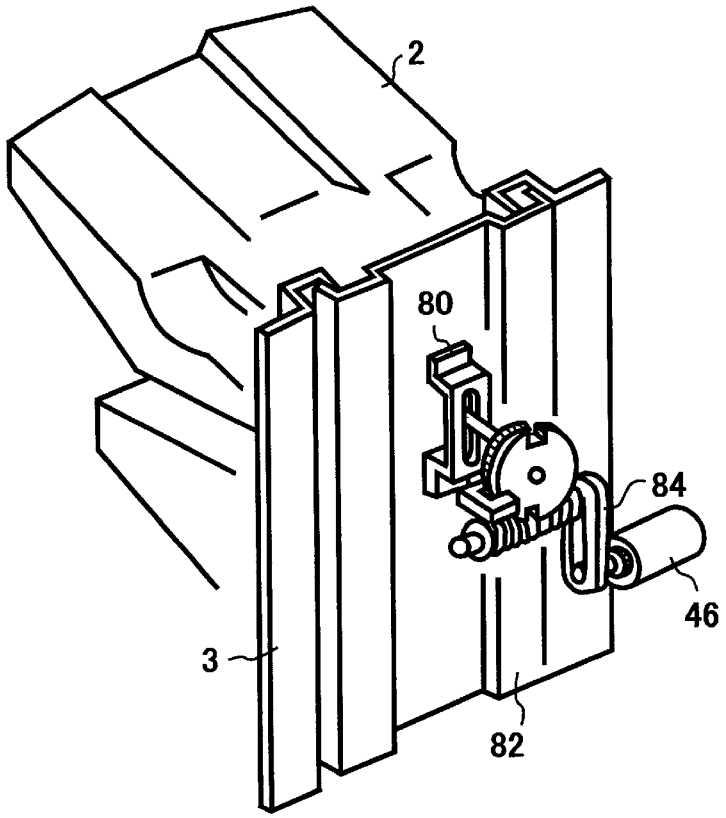
FIG. 13 is a schematic illustration for explaining a shift mechanism of the lower ejection tray.
Figure 14A:
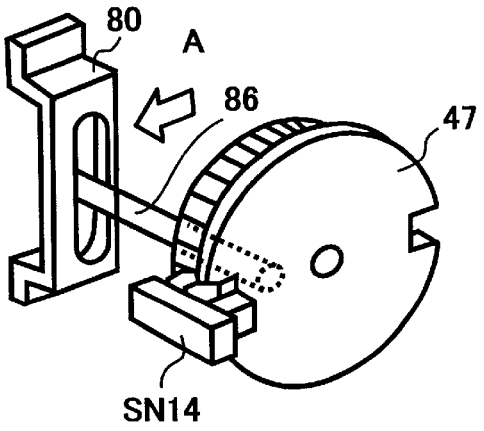
FIGS. 14A and 14B are schematic illustrations for explaining a shift operation of the lower ejection tray.
Figure 14B:
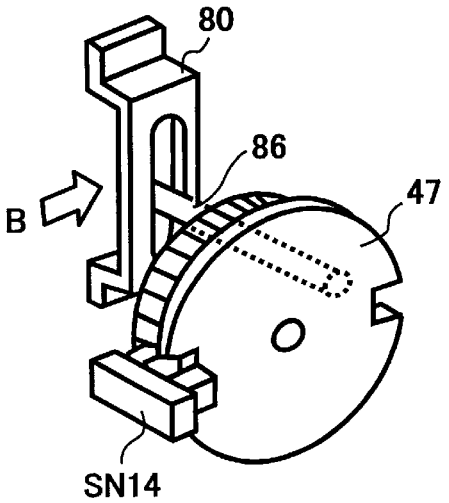

To shift the end fence 3, a shift motor 46 and a crank gear 47 are provided behind the end fence 3, as shown in FIG. 13 and in FIGS. 14A and 14B, respectively. A bracket 80 having a vertically-long hole is secured to the rear surface of the end fence 3, and a pin 86 eccentrically secured to the crank gear 47 is engaged to the vertically-long hole of the bracket 80. Rotation of the shift motor 46 is transmitted to a worm gear 82 via a belt 84 and the crank gear 47 engaged to the worm gear 82 is rotated. The shift movement of the end fence 3 is watched by a shift sensor SN14, and stop positions can be determined. In FIG. 14A, a manner is shown in that the end fence 3 is shifted to the direction indicated by an arrow A. In FIG. 14B, a manner is shown in that the end fence 3 is shifted to the opposite direction as indicated by an arrow B. The end fence 3 and the ejection tray 2 are engaged with each other in a form of comb so that the ejection tray 2 is allowed to smoothly move up and down and is moved to follow the movement of the end fence 3. In this way, the ejection tray 2 is capable of performing an offset stack operation.

In this embodiment, the offset stack operation is made possible by moving the ejection trays 1 and 2. However, it is also possible to perform the offset stack operation by moving the transfer rollers or the ejection rollers, for example. Further, the offset stack operation of the ejection tray 2 may be carried out by using the jog fence of the staple unit 60. Of course, the combination of these ways are also possible.

The controller 100 is, as shown in FIG. 15, a microcomputer including the CPU 102, the I/O interface 104, and so forth. Signals from various switches (not shown) provided to a control panel (not shown) of the finishing apparatus 200, or the copying machine G, and the above-mentioned various sensors are input into the CPU 102 via the I/O interface 104. Based on the signals received, the CPU 102 drives various components including the solenoid 20*a*, the solenoid 21*a*, the up-and-down motor 31, the shift motor 46, the shift motor 49, the jog motor 63, the jog solenoid 66, the stapler-moving motor 69, the stapler-ejection motor 72, the transfer motor 90, the staple motor 91, the ejection motor 92, the up-and-down motor 93, and so on. The CPU 102 receives and counts the pulse signal of the transfer motor 90 driving the transfer rollers 10 and controls the jog solenoid 66 based on the number of the counts. The CPU 102 and the various operation programs for instructing the CPU 102 in total form the control of the jog operations.

Next, an exemplary operation of the finishing apparatus 200 having the above configuration when the non-staple mode is selected. As an example, the following describes a case when the recording sheet is ejected to the ejection tray 1 by the ejection rollers 7. When the copying machine G completes the image forming operation, the printed recording sheet is transferred into the finishing apparatus 200 via the inlet rollers 5. In the finishing apparatus 200, the recording sheet is conveyed by the transfer rollers 6 and is ejected by the ejection rollers 7 into the ejection tray 1. In this operation, the rotation speed of the ejection rollers 7 is reduced upon an event that the outlet sensor SN2 detects the trailing edge of the recording sheet, so that the recording sheets are stacked in a more effective manner. In sort and stack modes, the shift motor 49 is driven based on termination signals generated from the control panel or the like of the finishing apparatus 200, or the copying machine G, to cause the ejection tray 1 to perform the shift operations until the job is ended. Thus, the finishing apparatus 200 performs the sort or stack operation of the ejection tray 1.

As another example, the following describes a case when the recording sheet is ejected to the ejection tray 2 by the ejection rollers 9. When the copying machine G completes the image forming operation, the printed recording sheet is transferred into the finishing apparatus 200 via the inlet rollers 5. In the finishing apparatus 200, the recording sheet is conveyed by the transfer rollers 8 and is ejected by the ejection rollers 9 into the ejection tray 2. In this operation, the rotation speed of the ejection rollers 9 is reduced upon an event that the outlet sensor SN3 detects the trailing edge of the recording sheet, so that the recording sheets are stacked in a more effective manner. When a plurality of the printed recording sheets are ejected into the ejection tray 2 and when the tray sensor SN6 detects the top surface of the stacked recording sheets, the up-and-down motor 31 is driven and therefore the ejection tray 2 is moved down so that the height of the stacked recording sheets are maintained at an appropriate level. In sort and stack modes, the shift motor 46 is driven based on termination signals generated from the control panel or the like of the finishing apparatus 200, or the copying machine G, to cause the ejection tray 2 to perform the shift operations until the job is ended. Thus, the finishing apparatus 200 performs the sort or stack operation of the ejection tray 2.

Next, an exemplary operation of the controller 100 for controlling the ejection trays 1 and 2 is explained. The ejection trays 1 and 2 are moved to their home positions when the power is applied to the finishing apparatus 200. The home position for the ejection tray 1 locates at a position where the tray sensor SN5 detects the top edge of the end fence la of the ejection tray 1. The home position for the ejection tray 2 locates at a position where the tray sensor SN6 detects the surface of the ejection tray 2 or the top surface of the stacked recording sheets. An operation for moving the ejection trays 1 and 2 are referred to as an initial operation, or a homing operation.

Figure 16:
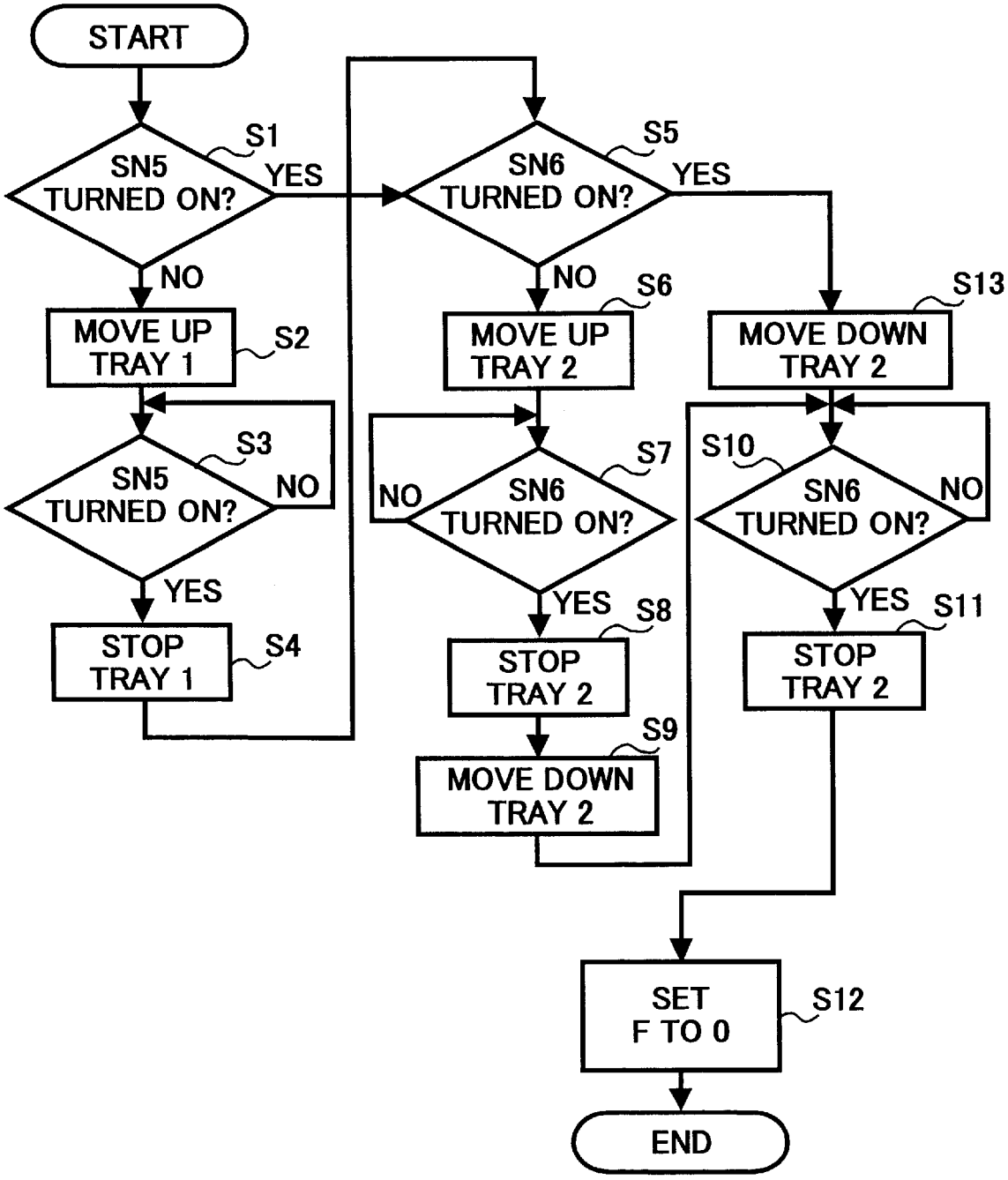
FIG. 16 is a flowchart for explaining an initial operation of the ejection trays.

Referring to FIG. 16, an exemplary procedure of the initial operation performed by the finishing apparatus 200 is explained. To move the ejection tray 1 to the receiving position of the outlet E1, the controller 100 checks in Step S1 if the tray sensor SN5 is turned on. If the tray sensor SN5 is turned off and the check result of Step S1 is NO, the ejection tray 1 is moved up in Step S2. The controller 100 then again checks in Step S3 if the tray sensor SN5 is turned on. This check is repeated until the check result is made YES. When the tray sensor SN5 is turned on and the check result of Step S3 is YES, the ejection tray 1 is stopped in Step S4.

When the check result of Step S1 is YES or after Step S4, the process proceeds to Step S5 in which the controller 100 checks if the tray sensor SN6 is turned on, in order to move the ejection tray 2 to the receiving position of the outlet E2. If the tray sensor SN6 is turned on and the check result of Step S5 is YES, the ejection tray 2 is moved down in Step S13 and the process proceeds to Step S10.

If the tray sensor SN6 is off and the check result of Step S5 is NO, the ejection tray 2 is moved up in Step S6. Subsequently, the controller 100 again checks in Step S7 if the tray sensor SN6 is turned on. This check is repeated until the check result is made YES. When the tray sensor SN6 is on and the check result of Step S7 is YES, the ejection tray 2 is stopped in Step S8. Then, the ejection tray 2 is moved down in Step S9 and the controller 100 checks in Step S10 if the tray sensor SN6 is turned off from the on-state. This check is continued until the check result is made YES. If the tray sensor SN6 is turned off from the on-state and the check result of Step S10 is YES, the ejection tray 2 is stopped in Step S11. After that, the controller 100 sets a position flag (F) of the ejection tray 1 to a value of 0 in Step S12. Then, the process ends. In this way, the controller 100 performs the initial operation.

Figure 17:
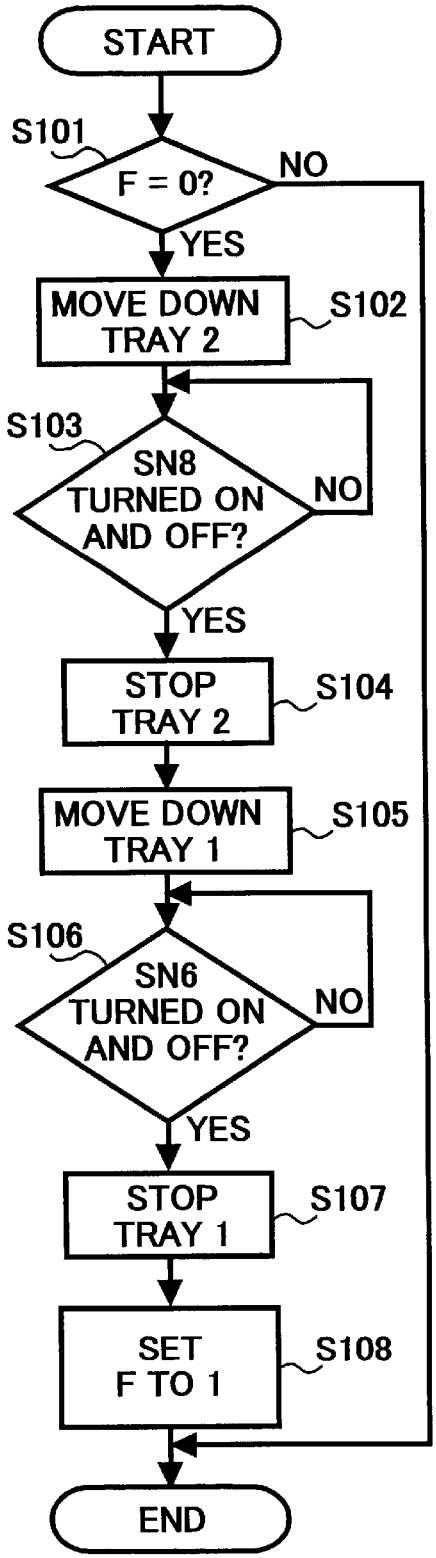
FIG. 17 is a flowchart for explaining an operation for moving the upper ejection tray to the lower outlet.

A flowchart of FIG. 17 explains a case when the ejection tray 1 is moved to the receiving position of the outlet E2 or the ejection tray 2 is moved to the standby position, under the position flag (F) of the ejection tray 1 set to 0. In Step S101, the controller 100 checks if the position flag (F) of the ejection tray 1 is set to 0. If the position flag (F) is not set to 0 and the check result of Step S101 is NO, the process ends. But, if the position flag (F) is set to 0 and the check result of Step S101 is YES, the controller 100 determines that the ejection tray 1 is held at the receiving position of the outlet E1 and proceeds to Step S102 in which the ejection tray 2 is moved down to the receiving position of the outlet E2. Then, the controller 100 checks in Step S103 if the tray sensor SN8 is turned on and is then turned off. That is, the tray sensor SN8 is turned on when detecting the bottom edge of the descending ejection tray 2 and is turned off when detecting the top surface of the ejection tray 2 or the top surface of the recording sheets placed on the ejection tray 2. If the tray sensor SN8 reacts in this way and the check result of Step S103 is YES, the ejection tray 2 is stopped in step S104 and the ejection tray 1 is subsequently moved down in Step S105. The controller 100 checks in Step S106 if the tray sensor SN6 is turned on and is then turned off by detecting the ejection tray 1. If the tray sensor SN6 is turned on and is then turned off and the check result of Step S106 is YES, the ejection tray 1 is stopped in Step S107. After that, in Step S108, the controller 100 sets the position flag (F) of the ejection tray 1 to a value of 1. Then, the process ends. In this embodiment, the tray sensor SN6 used for a detection of the ejection tray 2 is used also for a detection of the top surface of the end fence la of the ejection tray 1.

Figure 18:
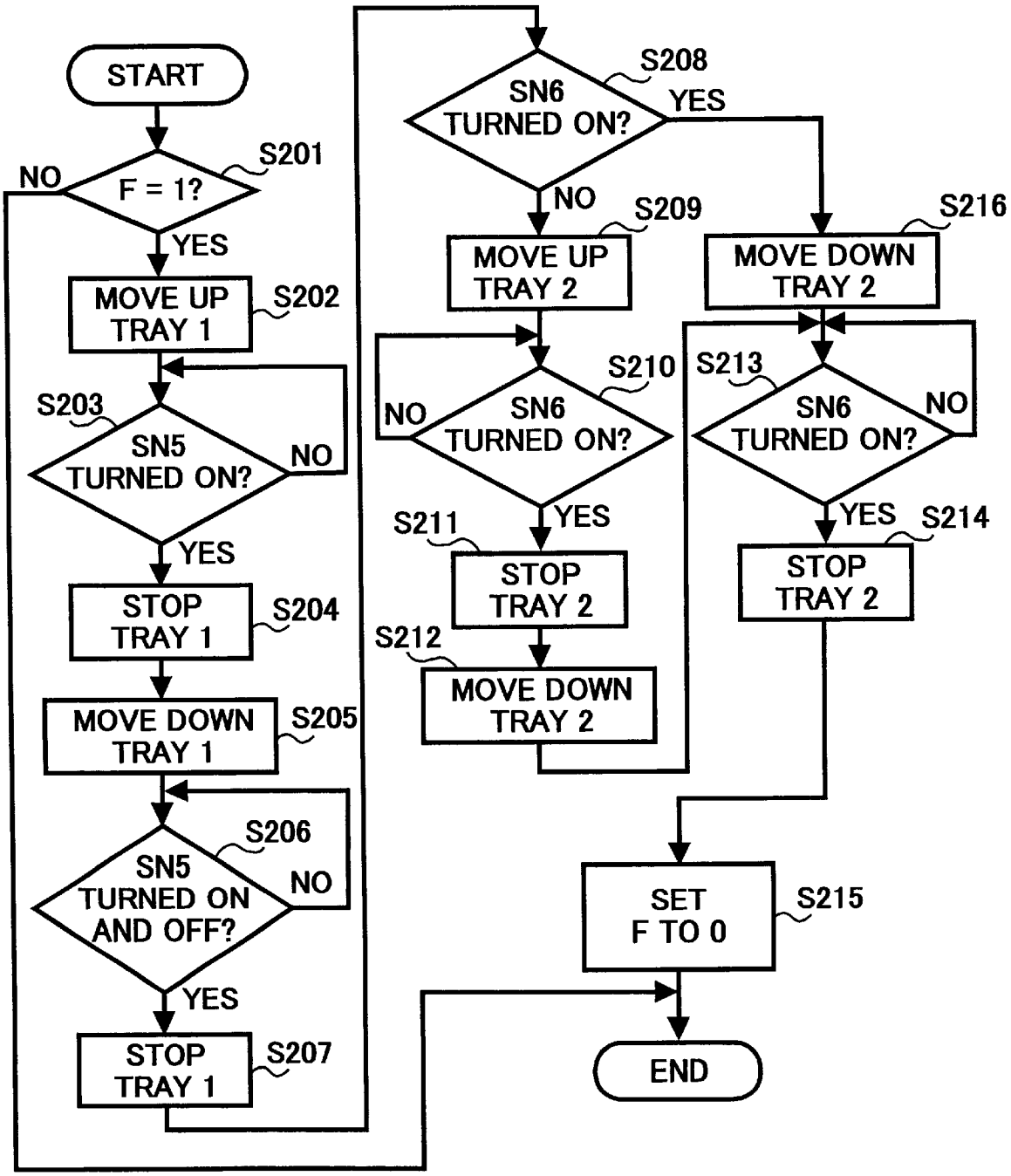
FIG. 18 is a flowchart for explaining an operation for moving the upper ejection tray to an upper outlet.

A flowchart of FIG. 18 explains a case when the ejection tray 1 is moved to the receiving position of the outlet E1 or the ejection tray 2 is moved to the receiving position of the outlet E2, under the position flag (F) of the ejection tray 1 set to 1. In Step S201, the controller 100 checks if the position flag (F) of the ejection tray 1 is set to 1. If the position flag (F) is not set to 1 and the check result of Step S201 is NO, the process ends. But, if the position flag (F) is set to 1 and the check result of Step S201 is YES, the controller 100 determines that the ejection tray 1 is held at the receiving position of the outlet E2 and proceeds to Step S202 in which the ejection tray 1 is moved up to the receiving position of the outlet E1. Then, the controller 100 checks in Step S203 if the tray sensor SN5 is turned on. If the tray sensor SN5 is turned on and the check result of Step S203 is YES, the ejection tray 1 is stopped in step S204 and the ejection tray 1 is subsequently moved down in Step S205. The controller 100 then checks in Step S206 if the tray sensor SN5 is turned off from the on-state. If the tray sensor SN5 is turned off from the on-state and the check result of Step S206 is YES, the ejection tray 1 is stopped in Step S207.

After Step S207, the process proceeds to Step S208 in which the controller 100 checks if the tray sensor SN6 is turned on, in order to move the ejection tray 2 to the receiving position of the outlet E2. If the tray sensor SN6 is turned on and the check result of Step S5 is YES, the ejection tray 2 is moved down in Step S216 and the process proceeds to Step S213. If the tray sensor SN6 is off and the check result of Step S208 is NO, the ejection tray 2 is moved up in Step S209. Subsequently, the controller 100 again checks in Step S210 if the tray sensor SN6 is turned on. This check is repeated until the check result is made YES. When the tray sensor SN6 is on and the check result of Step S210 is YES, the ejection tray 2 is stopped in Step S211. Then, the ejection tray 2 is moved down in Step S212 and the controller 100 checks in Step S213 if the tray sensor SN6 is turned off from the on-state. This check is continued until the check result is made YES. If the tray sensor SN6 is turned off from the on-state and the check result of Step S213 is YES, the ejection tray 2 is stopped in Step S214. After that, the controller 100 sets the position flag (F) of the ejection tray 1 to a value of 0 in Step S215. Then, the process ends.

Figure 19:
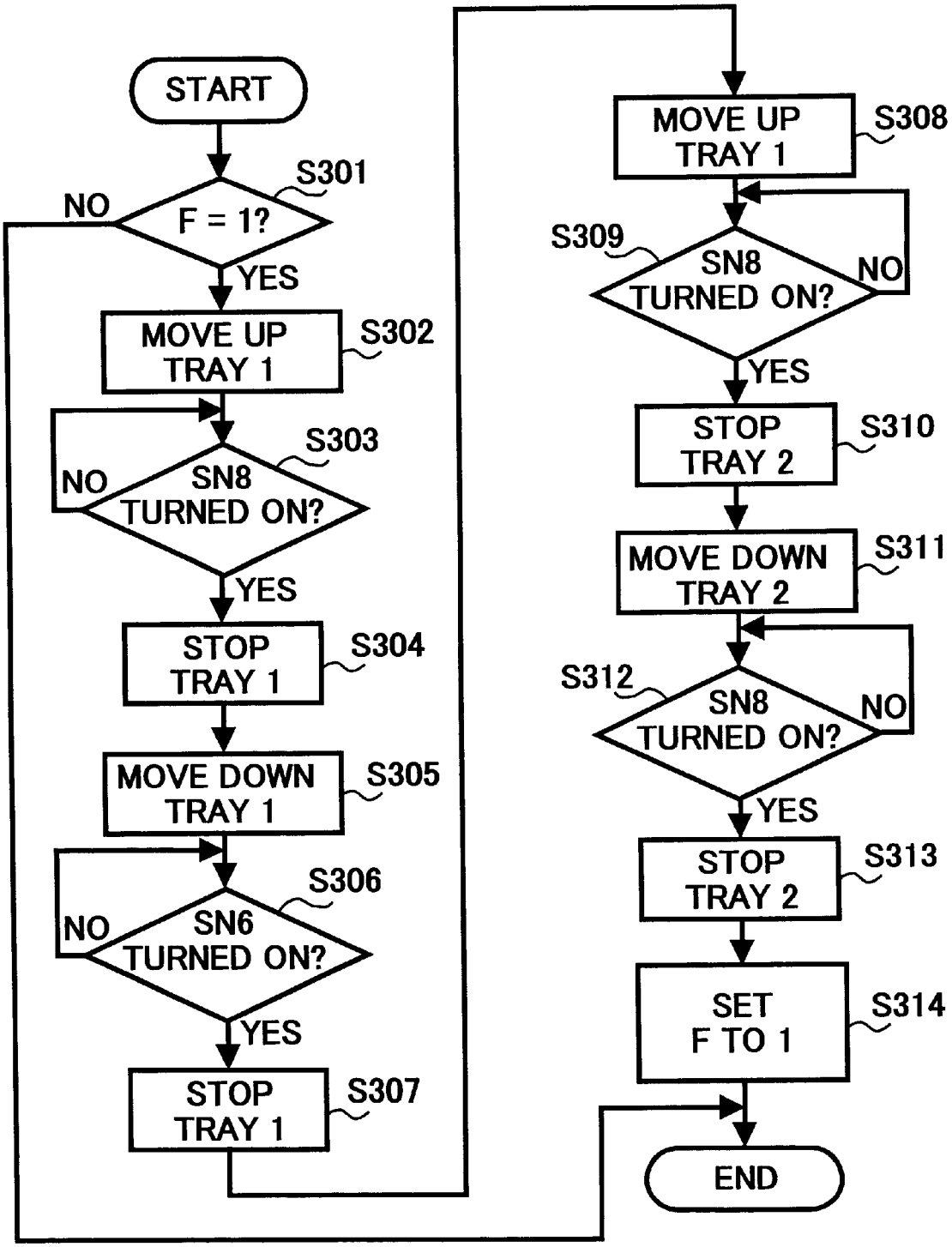
FIG. 19 is a flowchart for explaining an operation for resetting the upper ejection tray to the lower outlet.

A flowchart of FIG. 19 explains a case when the ejection tray 1 is reset to the receiving position of the outlet E2 or the ejection tray 2 is reset to the standby position, under the position flag (F) of the ejection tray 1 set to 1. In Step S301, the controller 100 checks if the position flag (F) of the ejection tray 1 is set to 1. If the position flag (F) is not set to 1 and the check result of Step S301 is NO, the process ends. But, if the position flag (F) is set to 1 and the check result of Step S301 is YES, the controller 100 proceeds with the following processes to make sure that the ejection tray 1 is held at the receiving position of the outlet E2. In Step S302, the ejection tray 1 is moved up. Then, the controller 100 checks in Step S303 if the tray sensor SN6 is turned on. If the tray sensor SN6 is turned on and the check result of Step S303 is YES, the ejection tray 1 is stopped in step S304 and the ejection tray 1 is subsequently moved down in Step S305. The controller 100 then checks in Step S306 if the tray sensor SN6 is turned off from the on-state. If the tray sensor SN6 is turned off from the on-state and the check result of Step S306 is YES, the ejection tray 1 is stopped in Step S307. Thereby, the ejection tray 1 is settled at the receiving position of the outlet E2.

In Step S308, the ejection tray 2 is moved up to the standby position. Then, the controller 100 checks in Step S309 if the tray sensor SN8 is turned on. This check is repeated until the check result is made YES. When the tray sensor SN8 is on and the check result of Step S309 is YES, the ejection tray 2 is stopped in Step S310. Then, the ejection tray 2 is moved down in Step S311 and the controller 100 checks in Step S312 if the tray sensor SN8 is turned off from the on-state. This check is continued until the check result is made YES. If the tray sensor SN8 is turned off from the on-state and the check result of Step S312 is YES, the ejection tray 2 is stopped in Step S313. After that, the controller 100 sets the position flag (F) of the ejection tray 1 to a value of 1 in Step S314. Then, the process ends.

In this way, when the position flag (F) of the ejection tray 1 is set to 1, resetting of the ejection tray 1 to the receiving position of the outlet E2 is performed using the tray sensor SN6 through the up-and-down movement of the ejection tray 1 and resetting of the ejection tray 2 to the standby position is performed using the tray sensor SN8 through the up-and-down movement of the ejection tray 2.

Figure 20:
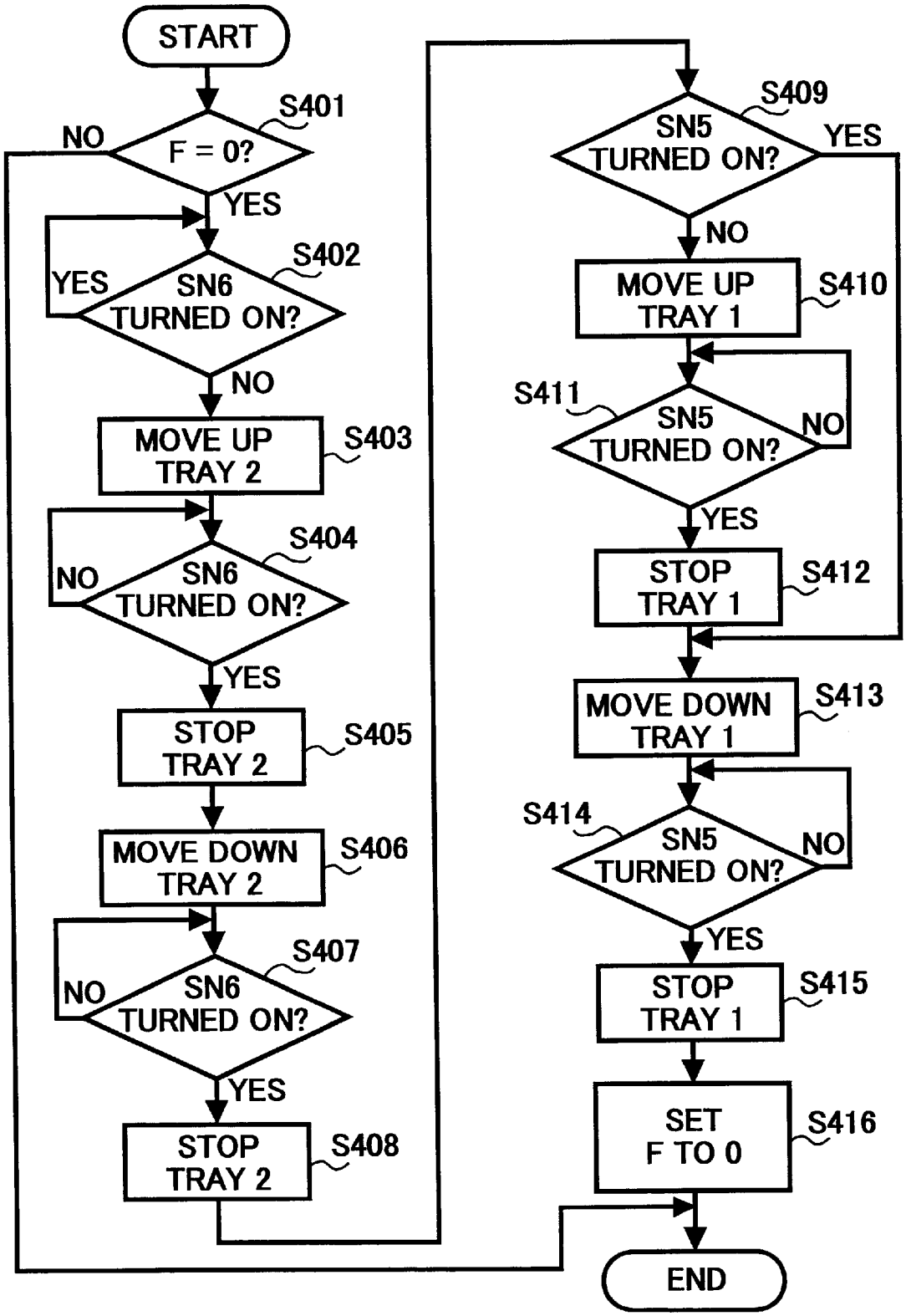
FIG. 20 is a flowchart for explaining an operation for resetting the upper ejection tray to the upper outlet.

A flowchart of FIG. 20 explains a case when the ejection tray 1 is reset to the receiving position of the outlet E1 or the ejection tray 2 is reset to the receiving position of the outlet E2, under the position flag (F) of the ejection tray 1 set to 0. In Step S401, the controller 100 checks if the position flag (F) of the ejection tray 1 is set to 0. If the position flag (F) is not set to 0 and the check result of Step S401 is NO, the process ends. If the position flag (F) is set to 0 and the check result of Step S401 is YES, the controller 100 determines that the ejection tray 1 is held at the receiving position of the outlet E1 and the process proceeds to Step S402. Then, the controller 100 checks in Step S402 if the tray sensor SN6 is turned on so as to move the ejection tray 2 to the receiving position of the outlet E2. If the tray sensor SN6 is turned on and the check result of Step S402 is NO, the ejection tray 2 is moved up in Step S403 and the controller 100 subsequently checks in Step S404 if the tray sensor SN6 is turned on. If the tray sensor SN6 is turned on and the check result of Step S404 is YES, the ejection tray 2 is stopped in step S405 and the ejection tray 2 is moved down in Step S406. The controller 100 then checks in Step S407 if the tray sensor SN6 is turned off from the on-state. If the tray sensor SN6 is turned off from the on-state and the check result of Step S407 is YES, the ejection tray 2 is stopped in Step S408. Thereby, the ejection tray 2 is settled at the receiving position of the outlet E2.

Then, the controller 100 checks in Step S409 if the tray sensor SN5 is turned on. If the tray sensor SN5 is turned on and the check result of Step S409 is YES, the process proceeds to Step S413, explained later. If the tray sensor SN5 is not on and the check result of Step S409 is NO, the ejection tray 1 is moved up in Step S410. Then, the controller 100 checks in Step S411 if the tray sensor SNS is turned on. If the tray sensor SN5 is turned on and the check result of Step S411 is YES, the ejection tray 1 is stopped in Step S412 and is moved down in Step S413. After that, the controller 100 checks in Step S414 if the tray sensor SN5 is turned off from the on-state. This check is continued until the check result is made YES. If the tray sensor SN5 is turned off from the on-state and the check result of Step S414 is YES, the ejection tray 1 is stopped in Step S415. After that, the controller 100 sets the position flag (F) of the ejection tray 1 to a value of 0 in Step S416. Then, the process ends.

In this way, when the position flag (F) of the ejection tray 1 is set to 0, resetting of the ejection tray 2 to the receiving position of the outlet E2 using the tray sensor SN6 through the up-and-down movement of the ejection tray 2 and resetting of the ejection tray 1 to the receiving position of the outlet E1 using the tray sensor SN5 through the up-and-down movement of the ejection tray 1.

Next, a tray switching operation of the finishing apparatus 200 is explained. For example, when the ejection tray 1 is designated in the staple mode, the ejection tray 1 is moved to the receiving position of the outlet E2. So, for example, in a job in which the ejection tray 1 is designated under the shift mode after the previous job in which the ejection tray 1 is designated under the staple mode, the ejection tray 1 is held at the receiving position of the outlet E2 to receive the recording sheet ejected from the outlet E2 and, after receiving the recording sheet, the ejection tray 1 is shifted. Thereby, the offset stack operation is performed.

For another example, in a job in which the ejection tray 1 is designated under the staple mode after the previous job in which the ejection tray 1 is also designated under the staple mode, the ejection tray 1 is held at the receiving position of the outlet E2, while the stack of the recording sheets is stapled and is ejected from the outlet E2. In this way, the job is performed.

In the present embodiment in which the finishing apparatus 200 is connected to the copying machine G, the tray switching operation is performed in accordance with the designation of the ejection trays and process modes such as the staple mode, the shift mode, and so on. Bit, in case of a multi-function apparatus having multiple functions such as the facsimile, copying, and printing functions, for example, the tray switching operation may be performed according to the designated ejection trays combined with the tray designation from the applications such as the facsimile, copying, and printing functions. For example, in the condition shown in FIG. 1, the tray switching operation is performed when the ejection tray 1 is designated in the staple mode. Furthermore, in the condition shown in FIG. 2, the tray switching operation is performed when the ejection tray 2 is designated.

The finishing apparatus 200 is provided with a normal ejection mode and a large capacity ejection (LCE) mode. The normal ejection mode is defined as a mode in which the ejection tray 2 can be switched to the ejection tray 1 when the maximum number of the recording sheets are placed in the ejection tray 2. The condition in which the ejection tray 1 contains the maximum number of recording sheets in the normal ejection mode is detected when the tray sensor SN12 detects the top surface of the recording sheets contained in the ejection tray 1. The condition in which the ejection tray 2 contains the maximum recording sheet capacity in the normal ejection mode is detected when the lower edge of the shutter plate 42*c* is detected by the tray sensor SN9 and the top surface of the recording sheets contained in the ejection tray 2 is detected by the tray sensor SN6.

On the other hand, the condition in which the maximum number of recording sheets are placed on the ejection tray 2 in the large capacity ejection mode is detected when the lower edge of the shutter plate 42*c* is detected by the tray sensor SN9 and then by the tray sensor SN10 and, in addition, when the tray sensor SN9 is turned off.

The maximum recording sheet number of the ejection tray 2 in the normal ejection mode is not large enough relative to the distance along which the ejection tray 2 can be moved, while the maximum recording sheet number of the ejection tray 2 in the large capacity ejection mode is reasonably large relative to the distance along which the ejection tray 2 can be moved.

When the large capacity ejection mode and the staple mode are selected, the positions of the ejection trays 1 and 2 are first checked and the ejection tray 1 is moved to the receiving position of the outlet E2, as shown in FIG. 2, so that the stacks of the recording sheets are ejected into the ejection tray 1. When the tray sensor SN12 detects the top surface of the recording sheet stacks in the ejection tray 1, the tray switching operation is performed and the ejection tray 1 is switched to the ejection tray 2. Then, the ejection tray 2 is moved to the receiving position of the outlet E2 to continue the job.

When the large capacity ejection mode and the non-staple mode are selected, the positions of the ejection trays 1 and 2 are first checked and the ejection tray 2 is moved to the receiving position of the outlet E2 so that the recording sheets are ejected into the ejection tray 2, wherein the recording sheets are conveyed through the second non-staple path B. When the condition that the maximum number of the recording sheets are loaded on the ejection tray 2 is detected in the way as described above, the controller 100 drives the solenoid 20*a* to turn the junction pawl 20 so as to select the first non-staple path C. Thereby, the recording sheets are guided to the outlet E1 and to the ejection tray 1 via the ejection rollers 7. In this way, the job is continued.

When one of the ejection trays is in operation and becomes full in the normal ejection mode, the job can be continued by performing the tray switching operation or by changing the path for the recording sheets. This operation is generally called a limitless ejection. If every ejection tray is full, however, the job cannot be continued and the limitless ejection is not a reality. However, the finishing apparatus 200 automatically switches to the large capacity ejection mode in this case and the job is continued with the ejection tray 2 until the ejection tray 2 becomes full in the large capacity ejection mode.

When the ejection tray 2 becomes full during the time when the recording sheets are ejected into the ejection tray 2, an judgement if the ejection tray 1 is full or not can be made by using the tray sensor SN12. In a case when the ejection tray 1 becomes full while receiving the recording sheets, the status of the ejection tray 2 is stored as the flag in a memory of the CPU 102 and therefore an judgement if the ejection tray 2 is full or not can be made by checking the flag.

Figure 21:
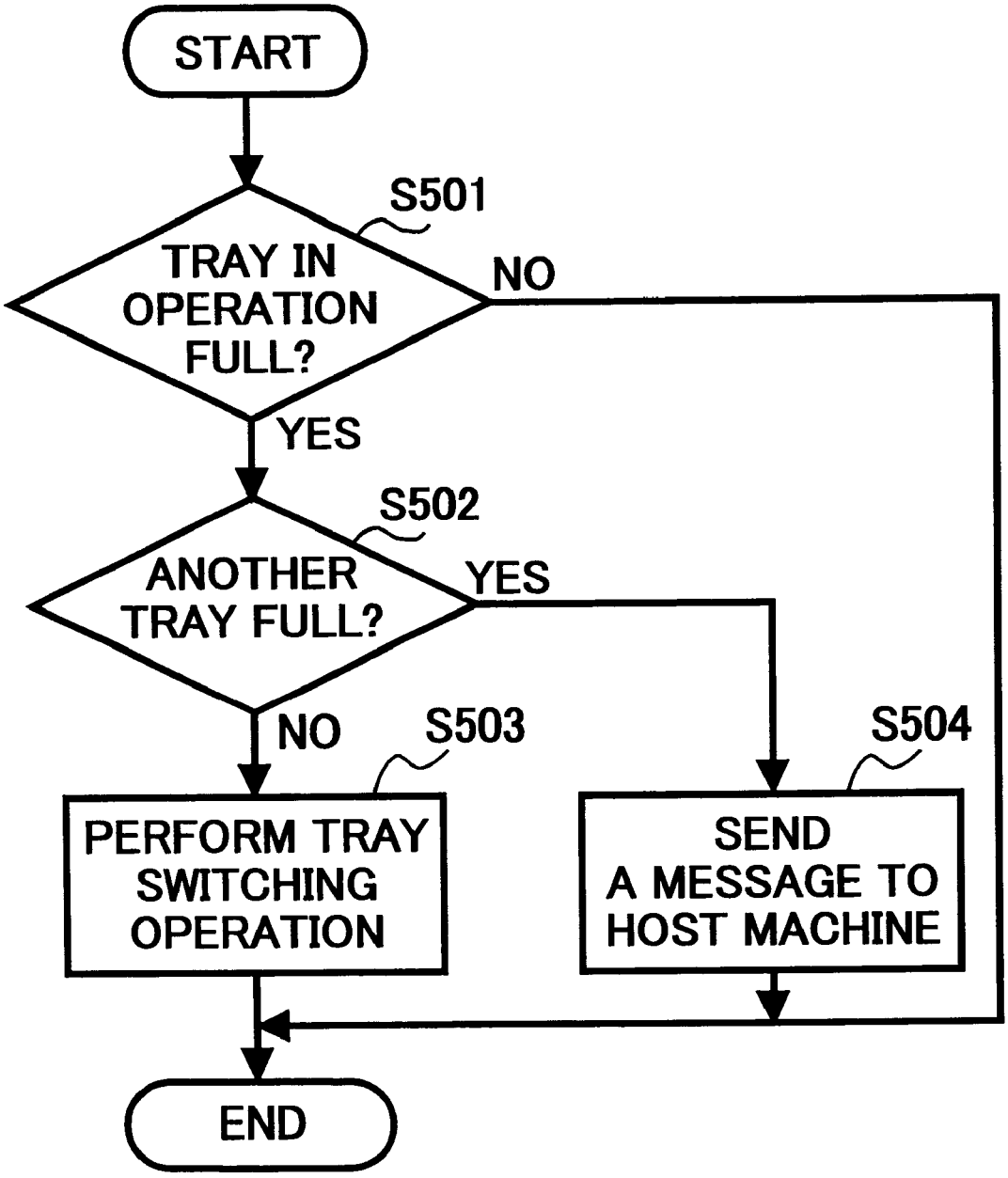
FIG. 21 is a flowchart for explaining an operation for handling an event in that the ejection tray in operation becomes full in a staple mode at a normal ejection mode.
Figure 22:
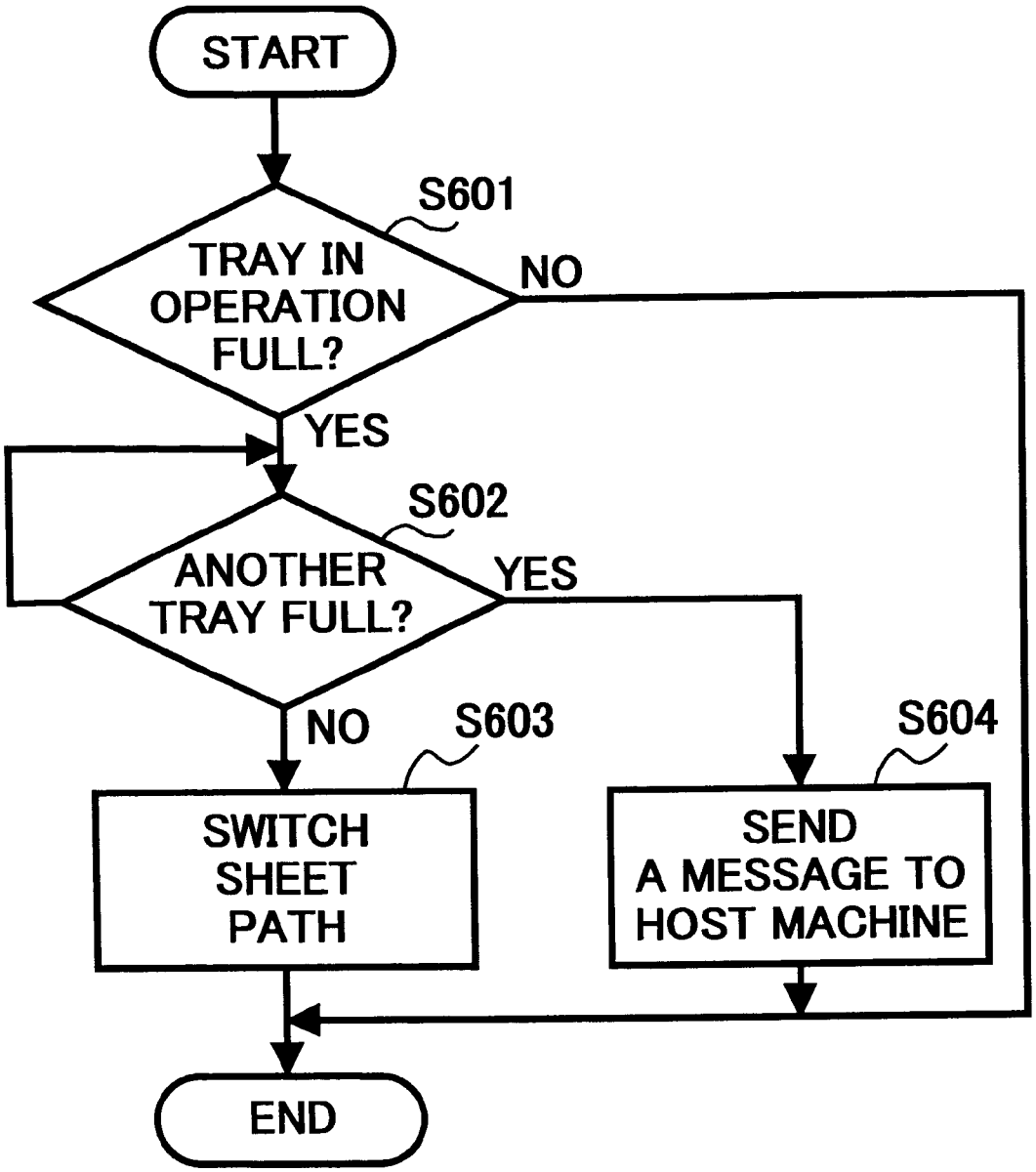
FIG. 22 is a flowchart for explaining an operation for handling an event in that the ejection tray in operation becomes full in a non-staple mode at a normal ejection mode.

Referring to FIGS. 21 and 22, an exemplary control operation when the ejection tray 1 becomes full in the normal ejection mode is explained. FIG. 21 shows a case in the staple mode. The controller 100 first checks in Step S501 if the ejection tray to which the recording sheets are ejected is full or not. If such an ejection tray in operation is not full, the controller 100 in Step S502 checks if the other tray is full or not. If the other tray is not full and the check result of Step S502 is NO, the controller 100 sends a wait-request signal to the copying machine G in Step S503. Further, in Step S503, the controller 100 performs the tray switching operation during the time that the copying machine G waits and sends a wait-release signal to the copying machine G. If the other tray is full and the check result of Step S502 is YES, the controller 100 sends in Step S504 a warning signal to the copying machine G indicating that every ejection tray is full. Then, the process ends.

FIG. 22 shows a case in the non-staple mode. The controller 100 first checks in Step S601 if the ejection tray to which the recording sheets are ejected is full or not. If such an ejection tray in operation is not full, the controller 100 in Step S602 checks if the other tray is full or not. If the other tray is not full and the check result of Step S602 is NO, the controller 100 switches the path for the recording sheet to change the outlet for the recording sheet, in Step S603. If the other tray is full and the check result of Step S602 is YES, the controller 100 sends in Step S604 a warning signal to the copying machine G indicating that every ejection tray is full. Then, the process ends.

Figure 23A:
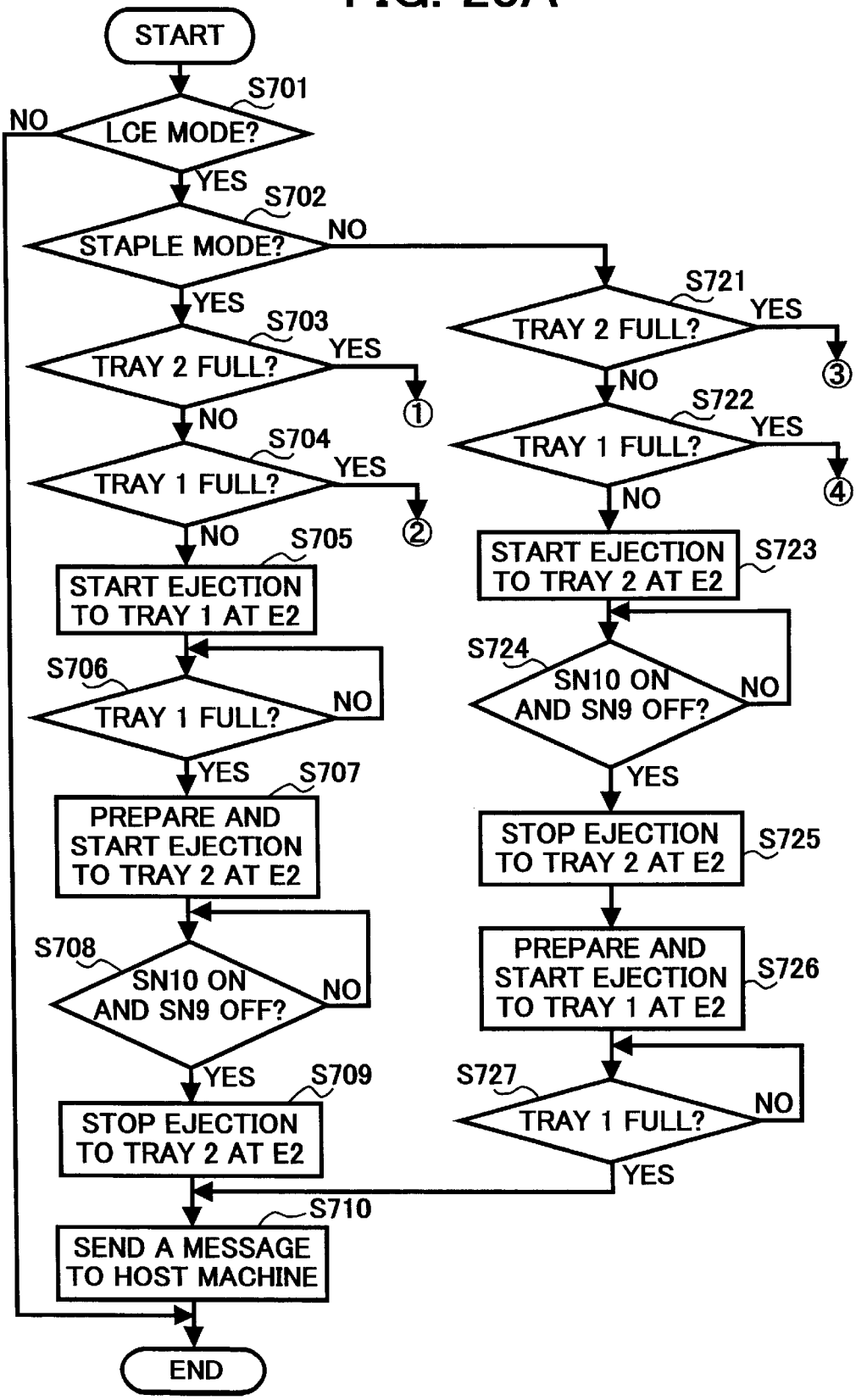
FIGS. 23A–23E are flowcharts for explaining an operation for handling a case in that the upper ejection tray is held at the upper outlet in a large capacity ejection mode.

Next, an exemplary control operation when the large capacity ejection (LCE) mode is selected with the ejection tray 1 held at the receiving position of the outlet E1 is explained with reference to FIGS. 23A–23E. In FIG. 23A, the controller 100 first checks in Step S701 if the LCE mode is selected. The process ends if the LCE mode is not selected, but if the LCE mode is selected and the check result of Step S701 is YES, the controller 100 checks in Step S702 if the staple mode is selected. If the staple mode is selected and the check result of Step S702 is YES, the controller 100 checks in Step S703 if the ejection tray 2 is full. If the ejection tray 2 is not full and the check result of Step S703 is NO, the controller 100 checks in Step S704 if the ejection tray 1 is full. If the ejection tray 1 is also not full and the check result of Step S704 is NO, the process proceeds to Step S705 in which the ejection tray 1 is moved to the receiving position of the outlet E2, the ejection tray 2 is moved to the standby position, and the ejection to the ejection tray 1 is started.

Then, in Step S706, the controller 100 checks if the ejection tray 1 is full. This check is continued until the ejection tray 1 becomes full. When the ejection tray 1 becomes full and the check result of Step S706 is YES, the process proceeds to Step S707. In Step S707, the ejection to the ejection tray 1 is stopped, the ejection tray 1 is moved up until it is detected by the tray sensor SN5, the ejection tray 2 is moved to the receiving position of the outlet E2, and the ejection to the ejection tray 2 is started. After that, in Step S708, the controller 100 checks if the tray sensor SN10 is turned on and, subsequently, the tray sensor SN9 is turned off. This check is continued until the check result becomes YES. When the tray sensor SN10 is turned on and, subsequently, the tray sensor SN9 is turned off and the check result of Step S708 is YES, the ejection to the ejection tray 2 is stopped in Step S709. Then, in Step S710, the controller 100 sends a signal to the copying machine G indicating that every ejection tray is full. The process then ends.

If the staple mode is not selected and the check result of Step S702 is NO, the controller 100 checks in Step S721 if the ejection tray 2 is full. If the ejection tray 2 is not full and the check result of Step S721 is NO, the controller 100 checks in Step S722 if the ejection tray 1 is full. If the ejection tray 1 is also not full and the check result of Step S722 is NO, the process proceeds to Step S723. In Step S723, the ejection tray 2 is moved to the receiving position of the outlet E2 and the ejection to the ejection tray 2 is started. After that, the controller 100 checks in Step S724 if the tray sensor SN10 is turned on and, subsequently, the tray sensor SN9 is turned off. This check is continued until the check result becomes YES. When the tray sensor SN10 is turned on and, subsequently, the tray sensor SN9 is turned off and the check result of Step S724 is YES, the ejection to the ejection tray 2 is stopped in Step S725. Then, in Step S726, the sheet path is switched to the outlet E1 and the ejection to the ejection tray 1 is started. In Step S727, the controller 100 checks if the ejection tray 1 is full. When the ejection tray 1 becomes full and the check result of Step S727 is YES, the process proceeds to Step S710 in which the controller 100 sends a signal to the copying machine G indicating that every ejection tray is full. The process then ends.

Figure 23B:
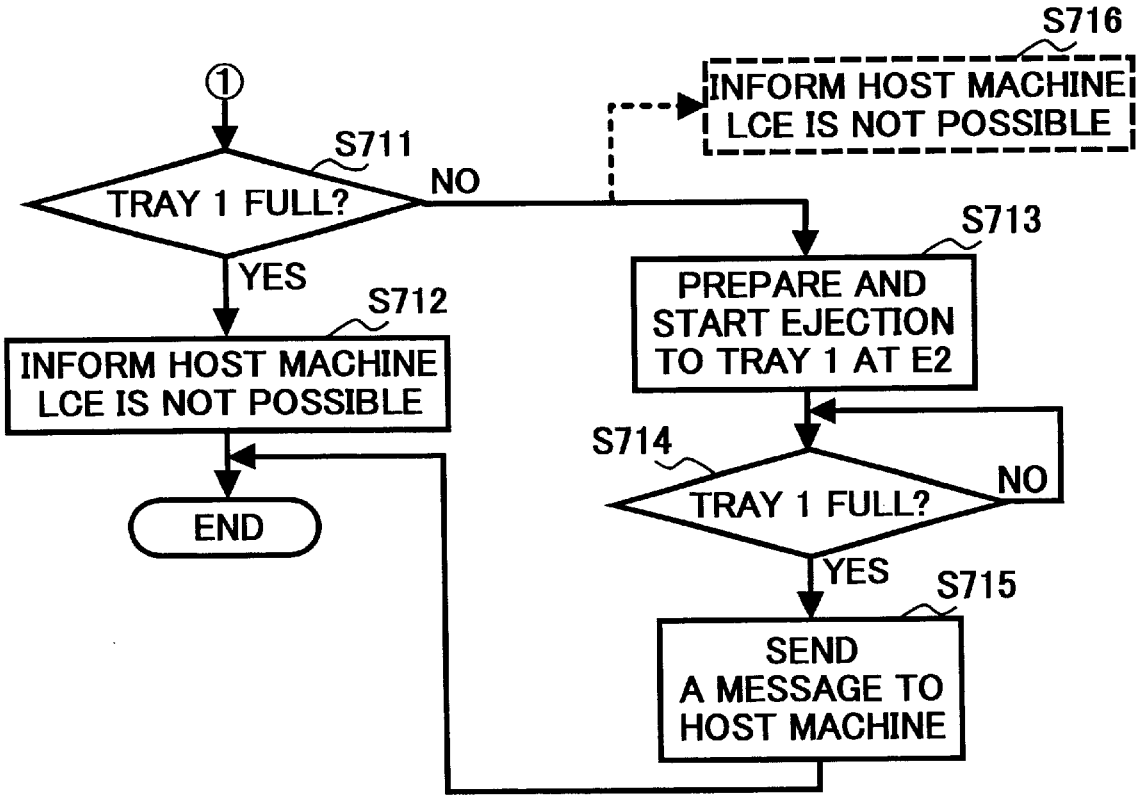

If the ejection tray 2 is full and the check result of Step S703 in FIG. 23A is YES, the process proceeds to Step S711 in FIG. 23B. In Step S711, the controller 100 checks if the ejection tray 1 is full. If it is full and the check result of Step S711 is YES, the controller 100 sends in Step S712 a signal to the copying machine G indicating that the larger capacity ejection mode is not allowed. The message is indicated, for example, on a screen (not shown) of the copying machine G and an operator will react to the message by removing the stacks of the recording sheets placed on the ejection trays 1 and 2.

If the ejection tray 1 is not full and the check result of Step S711 is NO, the process proceeds to Step S713 in which the ejection tray 2 is moved to the standby position, the ejection tray 1 is moved to the receiving position of the outlet E2, and the ejection to the ejection tray 1 is started. After that, in Step S714, the controller 100 checks if the ejection tray 1 is full. When the ejection tray 1 becomes full and the check result of Step S714 is YES, the controller 100 sends in Step S715 a signal to the copying machine G indicating that every ejection tray is full. In this case, upon a time that the ejection tray 1 is full and the check result of Step S714 is YES, it is possible to switch to the ejection to the ejection tray 2 which is in the full state in the normal ejection mode. That is, the ejection tray 1 is moved up, the ejection tray 2 is moved to the receiving position of the outlet E2, and the ejection to the ejection tray 2 is started. This ejection will be continued until the tray sensor SN10 is turned on and, subsequently, the tray sensor SN9 is turned off.

Alternative to Steps S713–S715, the controller 100 may perform Step S716, indicated by dotted lines. Since a number of recording sheets that can be placed on the ejection tray 1 is rather small at a view point of the large capacity ejection mode, the controller 100 sends in Step S716 a signal to the copying machine indicating that the larger capacity ejection mode is not allowed.

Figure 23C:
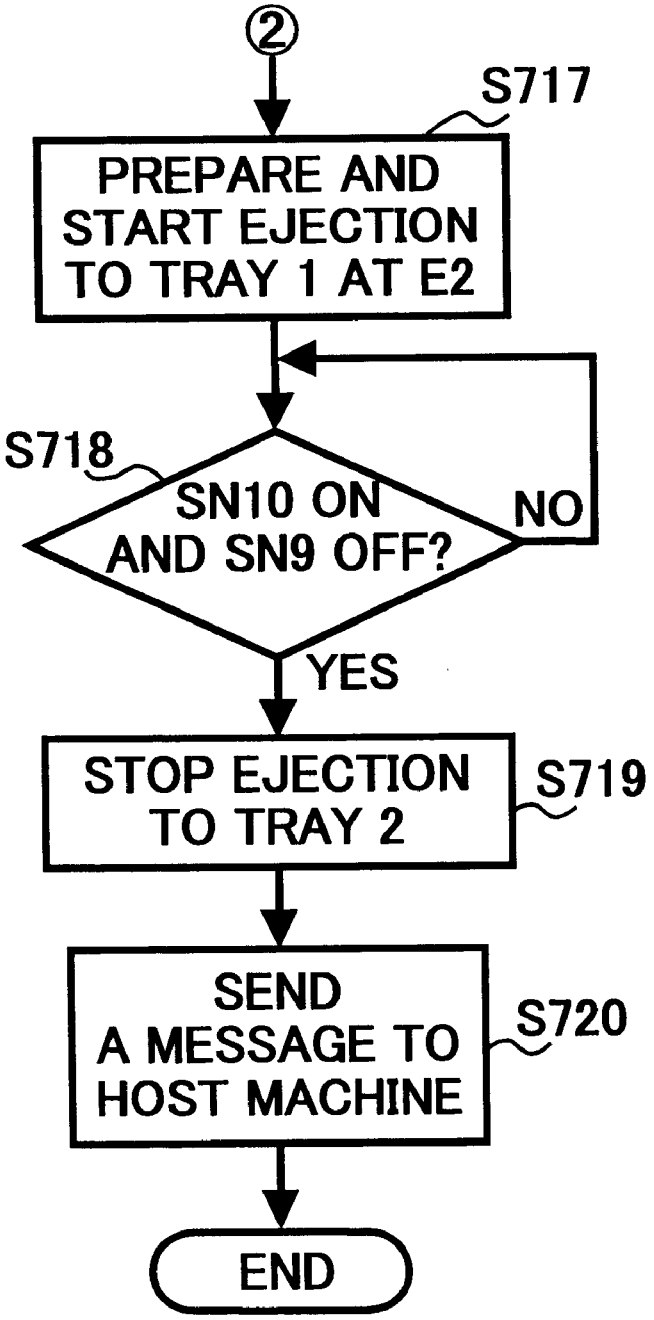

If the ejection tray 1 is full and the check result of Step S704 in FIG. 23A is YES, the process proceeds to Step S717 in FIG. 23C. In Step S717, the ejection tray 2 is moved to the receiving position of the outlet E2 and the ejection to the ejection 2 is started. In Step S718, the controller 100 checks if the tray sensor SN10 is turned on and, subsequently, the tray sensor SN9 is turned off. When the tray sensor SN10 is turned on and, subsequently, the tray sensor SN9 is turned off and the check result of Step S718 is YES, the ejection to the ejection tray 2 is stopped in Step S719 and the controller 100 sends in Step S720 a signal to the copying machine G indicating that every tray is full. Then, the process ends.

Figure 23D:
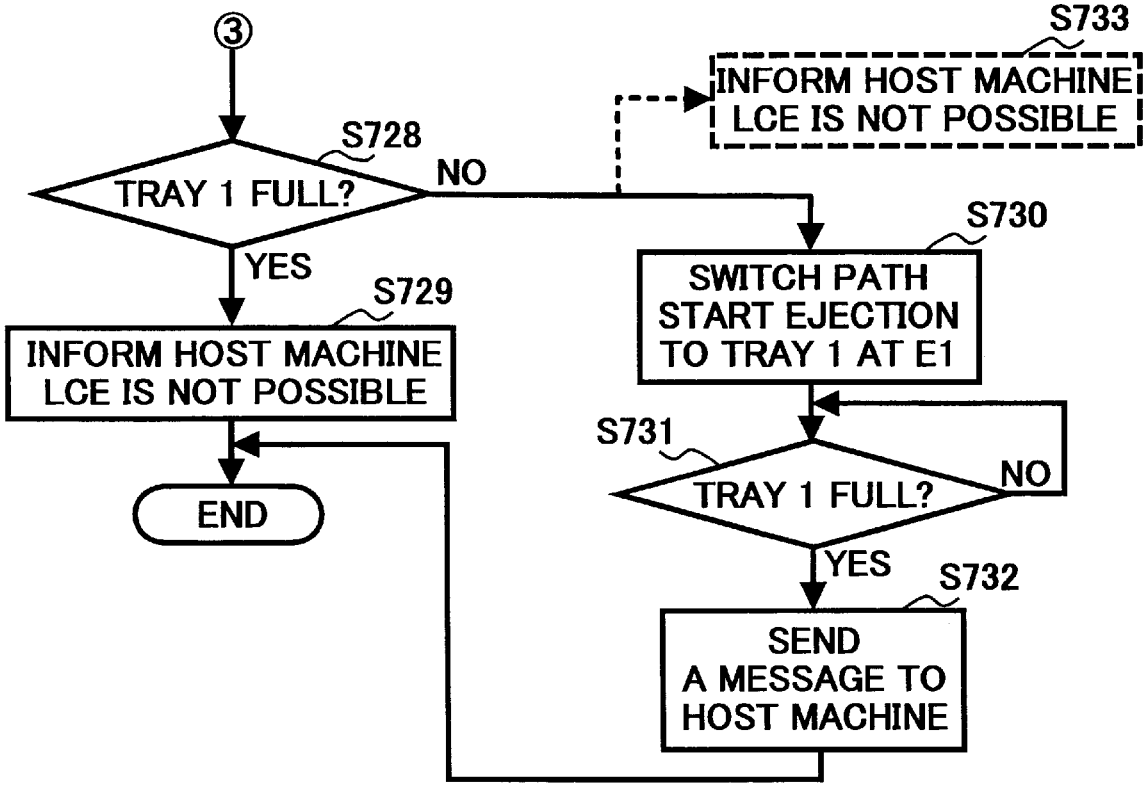

If the ejection tray 2 is full and the check result of Step S721 in FIG. 23A is YES, the process proceeds to Step S728 in FIG. 23D. In Step S728, the controller 100 checks if the ejection tray 1 is full. If it is full and the check result of Step S728 is YES, the controller 100 sends in Step S729 a signal to the copying machine G indicating that the larger capacity ejection mode is not allowed. The message is indicated, for example, on a screen (not shown) of the copying machine G and an operator will react to the message by removing the stacks of the recording sheets placed on the ejection trays 1 and 2.

If the ejection tray 1 is not full and the check result of Step S728 is NO, the process proceeds to Step S730 in which the sheet path is switched to the outlet E1 and the ejection to the ejection tray 1 is started. After that, in Step S731, the controller 100 checks if the ejection tray 1 is full. When the ejection tray 1 becomes full and the check result of Step S731 is YES, the controller 100 sends in Step S732 a signal to the copying machine G indicating that every ejection tray is full. In this case, upon a time that the ejection tray 1 is full and the check result of Step S731 is YES, it is possible to switch to the ejection to the ejection tray 2 which is in the full state in the normal ejection mode. That is, the ejection tray 2 is moved to the receiving position of the outlet E2, and the ejection to the ejection tray 2 is started. This ejection will be continued until the tray sensor SN10 is turned on and, subsequently, the tray sensor SN9 is turned off.

Alternative to Steps S730–S732, the controller 100 may perform Step S733, indicated by dotted lines. Since a number of recording sheets that can be placed on the ejection tray 1 is rather small at a view point of the large capacity ejection mode, the controller 100 sends in Step S733 a signal to the copying machine indicating that the larger capacity ejection mode is not allowed.

Figure 23E:
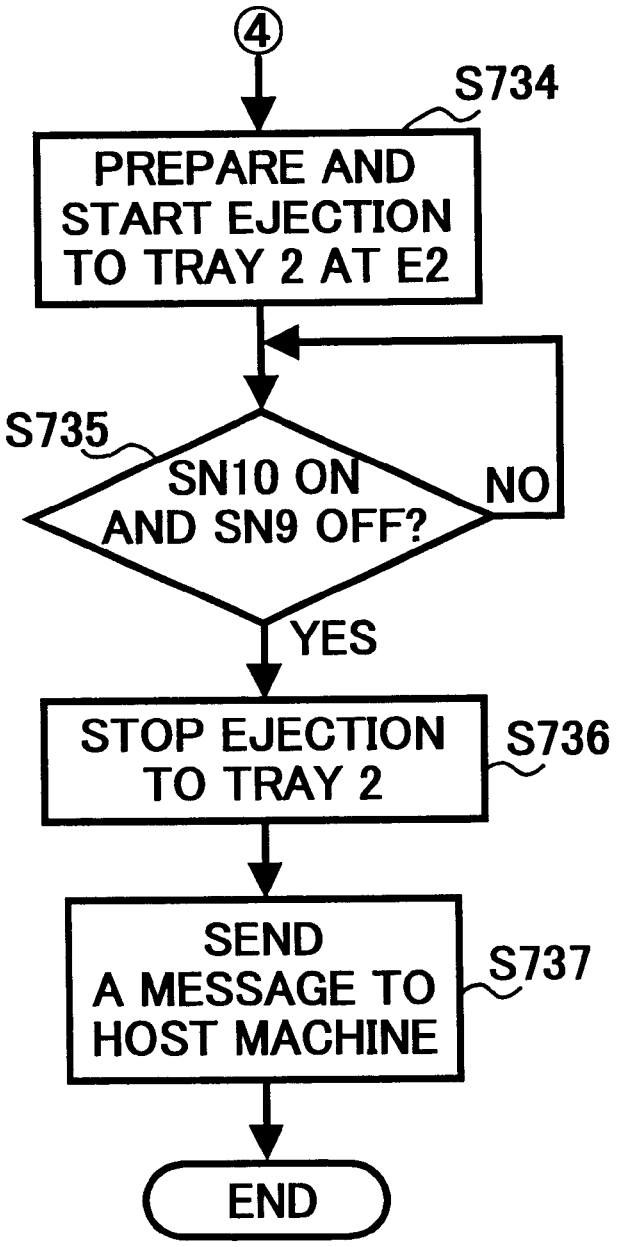

If the ejection tray 1 is full and the check result of Step S722 in FIG. 23A is YES, the process proceeds to Step S734 in FIG. 23E. In Step S734, the ejection tray 2 is moved to the receiving position of the outlet E2 and the ejection to the ejection 2 is started. In Step S735, the controller 100 checks if the tray sensor SN10 is turned on and, subsequently, the tray sensor SN9 is turned off. When the tray sensor SN10 is turned on and, subsequently, the tray sensor SN9 is turned off and the check result of Step S735 is YES, the ejection to the ejection tray 2 is stopped in Step S736 and the controller 100 sends in Step S737 a signal to the copying machine G indicating that every tray is full. Then, the process ends.

Figure 24A:
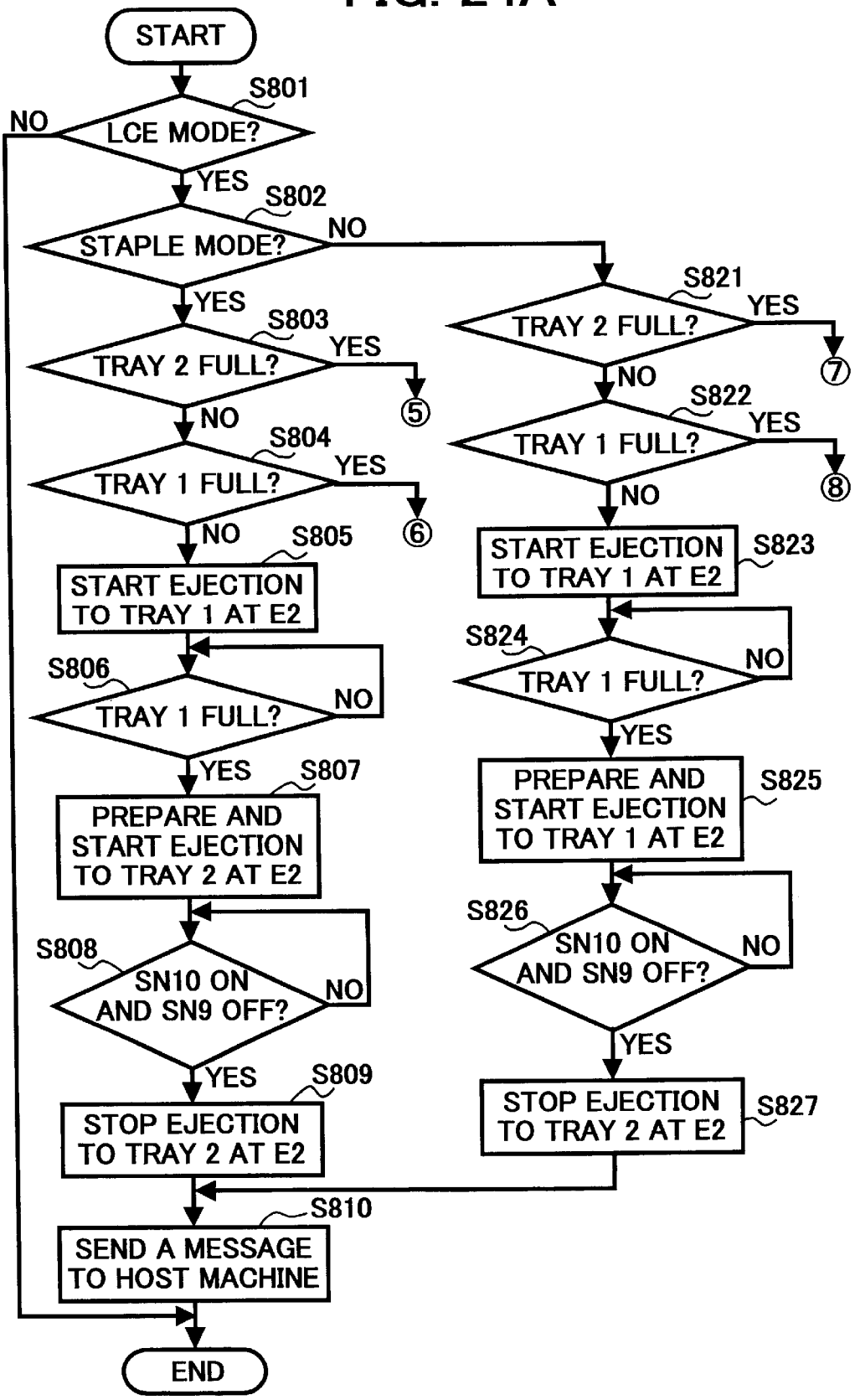
FIGS. 24A–24E are flowcharts for explaining an operation for handling a case in that the upper ejection tray is held at the lower outlet in the large capacity ejection mode.

Next, an exemplary control operation when the large capacity ejection (LCE) mode is selected with the ejection tray 1 held at the receiving position of the outlet E2 is explained with reference to FIGS. 24A–24E. In FIG. 24A, the controller 100 first checks in Step S801 if the LCE mode is selected. The process ends if the LCE mode is not selected, but if the LCE mode is selected and the check result of Step S801 is YES, the controller 100 checks in Step S802 if the staple mode is selected. If the staple mode is selected and the check result of Step S802 is YES, the controller 100 checks in Step S803 if the ejection tray 2 is full. If the ejection tray 2 is not full and the check result of Step S803 is NO, the controller 100 checks in Step S804 if the ejection tray 1 is full. If the ejection tray 1 is also not full and the check result of Step S804 is NO, the process proceeds to Step S805 and the ejection to the ejection tray 1 is started.

Then, in Step S806, the controller 100 checks if the ejection tray 1 is full. This check is continued until the ejection tray 1 becomes full. When the ejection tray 1 becomes full and the check result of Step S806 is YES, the process proceeds to Step S807. In Step S807, the ejection to the ejection tray 1 is stopped, the ejection tray 1 is moved up until it is detected by the tray sensor SN5, the ejection tray 2 is moved to the receiving position of the outlet E2, and the ejection to the ejection tray 2 is started. After that, in Step S808, the controller 100 checks if the tray sensor SN10 is turned on and, subsequently, the tray sensor SN9 is turned off. This check is continued until the check result becomes YES. When the tray sensor SN10 is turned on and, subsequently, the tray sensor SN9 is turned off and the check result of Step S808 is YES, the ejection to the ejection tray 2 is stopped in Step S809. Then, in Step S810, the controller 100 sends a signal to the copying machine G indicating that every ejection tray is full. The process then ends.

If the staple mode is not selected and the check result of Step S802 is NO, the controller 100 checks in Step S821 if the ejection tray 2 is full. If the ejection tray 2 is not full and the check result of Step S821 is NO, the controller 100 checks in Step S822 if the ejection tray 1 is full. If the ejection tray 1 is also not full and the check result of Step S822 is NO, the process proceeds to Step S823. In Step S823, the ejection to the ejection tray 1 is started. After that, the controller 100 checks in Step S824 if the ejection tray 1 is full. If the ejection tray 1 is full and the check result of Step S824 is YES, the process proceeds to Step S825. In Step S825, the ejection to the ejection tray 1 is stopped, the ejection tray 1 is moved up until it is detected by the tray sensor SN5, the ejection tray 2 is moved to the receiving position of the outlet E2, and the ejection to the ejection tray 2 is started. Then, the controller 100 checks in Step S826 if the tray sensor SN10 is turned on and, subsequently, the tray sensor SN9 is turned off. This check is continued until the check result becomes YES. When the tray sensor SN10 is turned on and, subsequently, the tray sensor SN9 is turned off and the check result of Step S826 is YES, the ejection to the ejection tray 2 is stopped in Step S827. Then, the process proceeds to Step S810 in which the controller 100 sends a signal to the copying machine G indicating that every ejection tray is full. The process then ends.

Figure 24B:
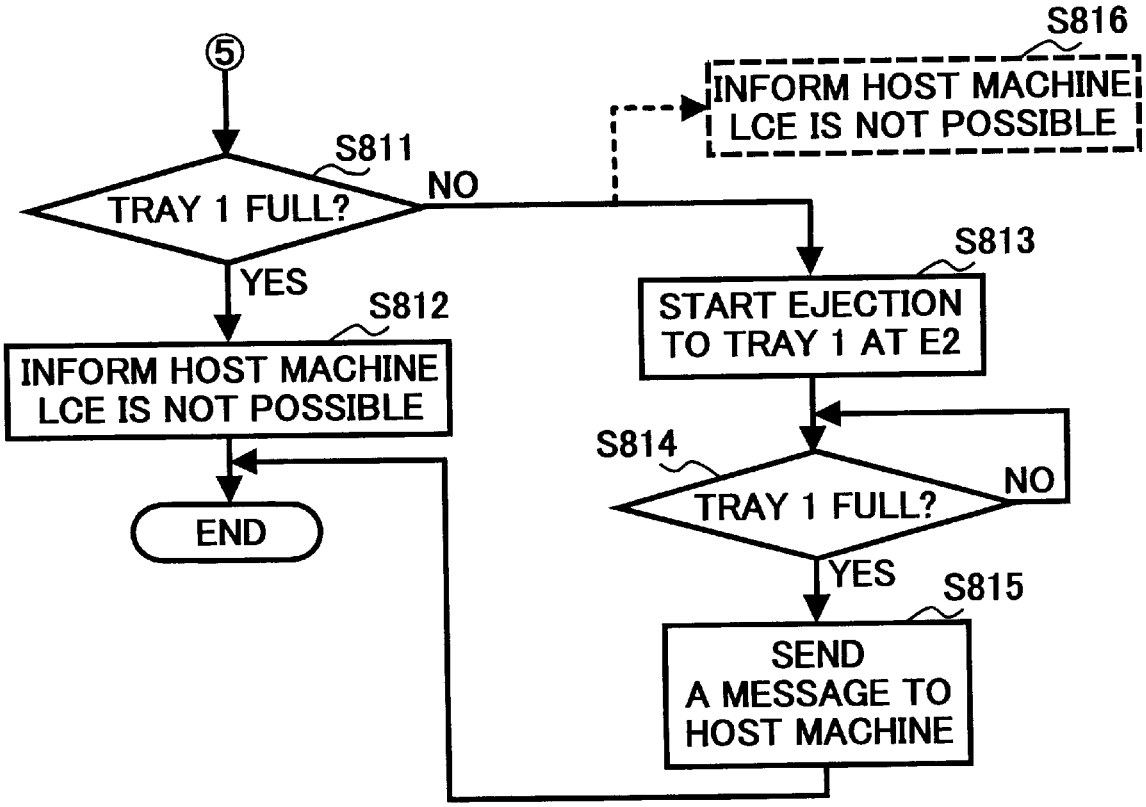

If the ejection tray 2 is full and the check result of Step S803 in FIG. 24A is YES, the process proceeds to Step S811 in FIG. 24B. In Step S811, the controller 100 checks if the ejection tray 1 is full. If it is full and the check result of Step S811 is YES, the controller 100 sends in Step S812 a signal to the copying machine G indicating that the larger capacity ejection mode is not allowed. The message is indicated, for example, on a screen (not shown) of the copying machine G and an operator will react to the message by removing the stacks of the recording sheets placed on the ejection trays 1 and 2.

If the ejection tray 1 is not full and the check result of Step S811 is NO, the process proceeds to Step S813 in which the ejection to the ejection tray 1 is started. After that, in Step S814, the controller 100 checks if the ejection tray 1 is full. When the ejection tray 1 becomes full and the check result of Step S814 is YES, the controller 100 sends in Step S815 a signal to the copying machine G indicating that every ejection tray is full. In this case, upon a time that the ejection tray 1 is full and the check result of Step S814 is YES, it is possible to switch to the ejection to the ejection tray 2 which is in the full state in the normal ejection mode. That is, the ejection tray 1 is moved up, the ejection tray 2 is moved to the receiving position of the outlet E2, and the ejection to the ejection tray 2 is started. This ejection will be continued until the tray sensor SN10 is turned on and, subsequently, the tray sensor SN9 is turned off.

Alternative to Steps S813–S815, the controller 100 may perform Step S816, indicated by dotted lines. Since a number of recording sheets that can be placed on the ejection tray 1 is rather small at a view point of the large capacity ejection mode, the controller 100 sends in Step S816 a signal to the copying machine indicating that the larger capacity ejection mode is not allowed.

Figure 24C:
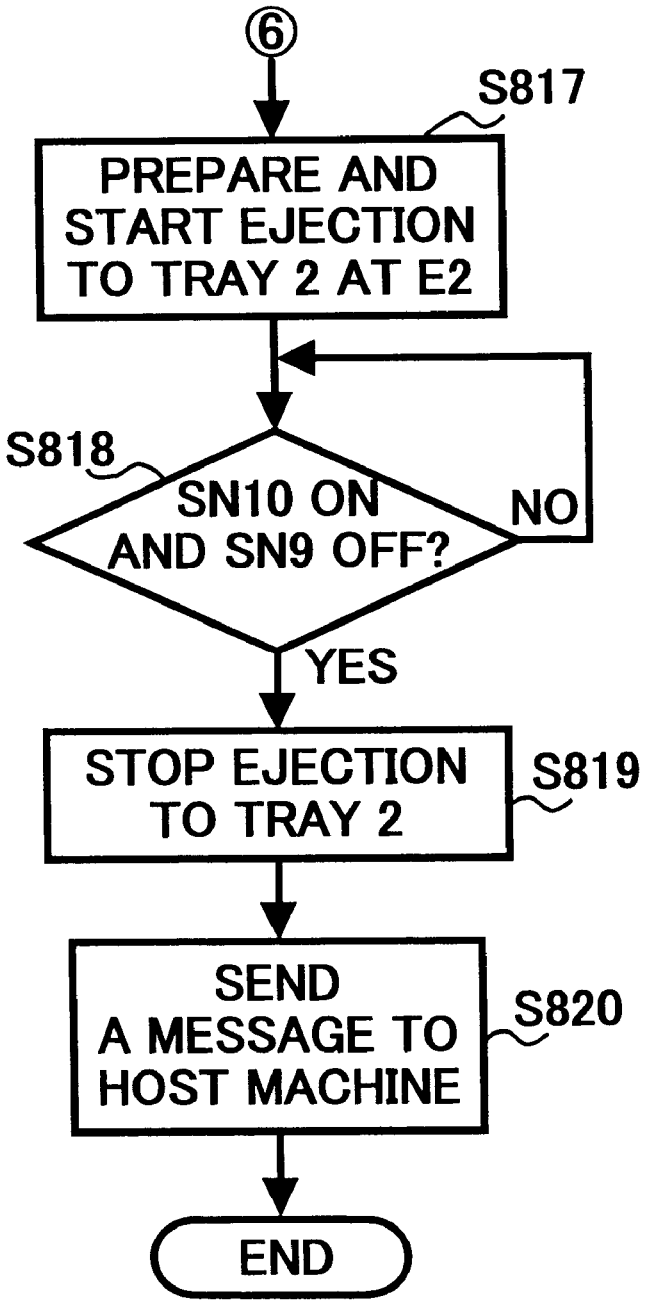

If the ejection tray 1 is full and the check result of Step S804 in FIG. 24A is YES, the process proceeds to Step S817 in FIG. 24C. In Step S817, the ejection tray 1 is moved up until it is detected by the tray sensor SN5, the ejection tray 2 is moved to the receiving position of the outlet E2, and the ejection to the ejection 2 is started. In Step S818, the controller 100 checks if the tray sensor SN10 is turned on and, subsequently, the tray sensor SN9 is turned off. When the tray sensor SN10 is turned on and, subsequently, the tray sensor SN9 is turned off and the check result of Step S818 is YES, the ejection to the ejection tray 2 is stopped in Step S819 and the controller 100 sends in Step S820 a signal to the copying machine G indicating that every tray is full. Then, the process ends.

Figure 24D:
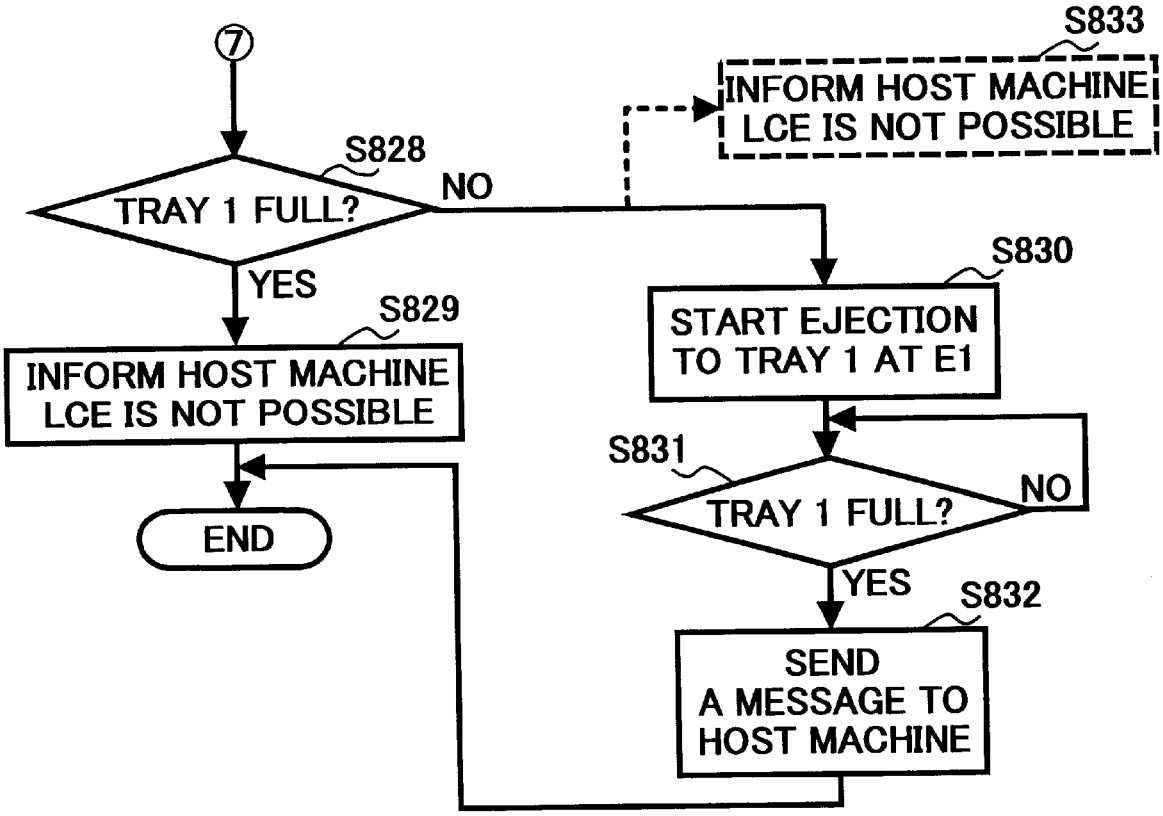

If the ejection tray 2 is full and the check result of Step S821 in FIG. 24A is YES, the process proceeds to Step S828 in FIG. 24D. In Step S828, the controller 100 checks if the ejection tray 1 is full. If it is full and the check result of Step S828 is YES, the controller 100 sends in Step S829 a signal to the copying machine G indicating that the larger capacity ejection mode is not allowed. The message is indicated, for example, on a screen (not shown) of the copying machine G and an operator will react to the message by removing the stacks of the recording sheets placed on the ejection trays 1 and 2.

If the ejection tray 1 is not full and the check result of Step S828 is NO, the process proceeds to Step S830 in which the ejection to the ejection tray 1 is started. After that, in Step S831, the controller 100 checks if the ejection tray 1 is full. When the ejection tray 1 becomes full and the check result of Step S831 is YES, the controller 100 sends in Step S832 a signal to the copying machine G indicating that every ejection tray is full. In this case, upon a time that the ejection tray 1 is full and the check result of Step S731 is YES, it is possible to switch to the ejection to the ejection tray 2 which is in the full state in the normal ejection mode. That is, the ejection tray 2 is moved to the receiving position of the outlet E2, and the ejection to the ejection tray 2 is started. This ejection will be continued until the tray sensor SN10 is turned on and, subsequently, the tray sensor SN9 is turned off.

Alternative to Steps S830–S832, the controller 100 may perform Step S833, indicated by dotted lines. Since a number of recording sheets that can be placed on the ejection tray 1 is rather small at a view point of the large capacity ejection mode, the controller 100 sends in Step S833 a signal to the copying machine indicating that the larger capacity ejection mode is not allowed.

Figure 24E:
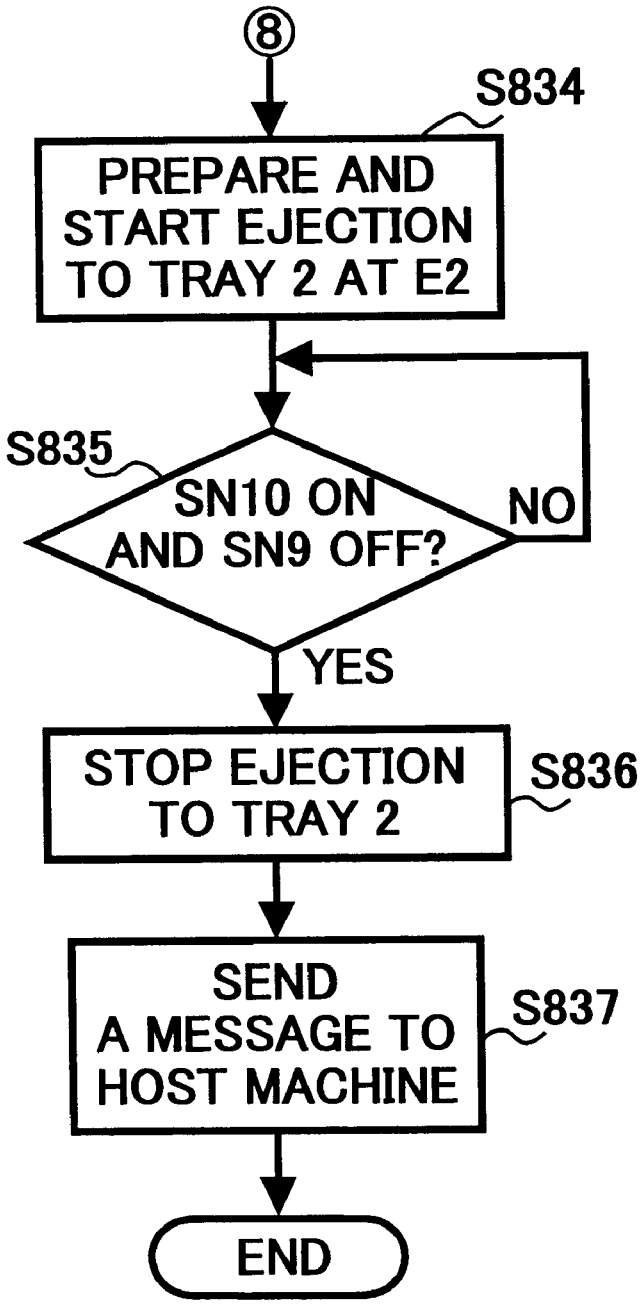

If the ejection tray 1 is full and the check result of Step S822 in FIG. 24A is YES, the process proceeds to Step S834 in FIG. 24E. In Step S834, the ejection tray 1 is moved up until it is detected by the tray sensor SN5, the ejection tray 2 is moved to the receiving position of the outlet E2, and the ejection to the ejection 2 is started. In Step S835, the controller 100 checks if the tray sensor SN10 is turned on and, subsequently, the tray sensor SN9 is turned off. When the tray sensor SN10 is turned on and, subsequently, the tray sensor SN9 is turned off and the check result of Step S835 is YES, the ejection to the ejection tray 2 is stopped in Step S836 and the controller 100 sends in Step S837 a signal to the copying machine G indicating that every tray is full. Then, the process ends.

Next, a second example of the elevation mechanism for the ejection trays 1 and 2 of the finishing apparatus 200 is explained with reference to FIGS. 25, 26, 27A, 27B, 28, and 29. As described above, the first example of the elevation mechanism causes the ejection tray 1 to sway to pass by the bend of the guide rails 30*a* and 30*b*. In this second example, the ejection tray 1 is slid in the direction of the recording sheet ejection to pass by the bend of the guide rails 30*a* and 30*b*. In addition, the end fence 1*a* of the ejection tray 1 is allowed to move up and down so that the relative distance between the end fence la and the ejection tray 1 varies in accordance with the amount of the recording sheets placed on the ejection tray 1.

Figure 25:
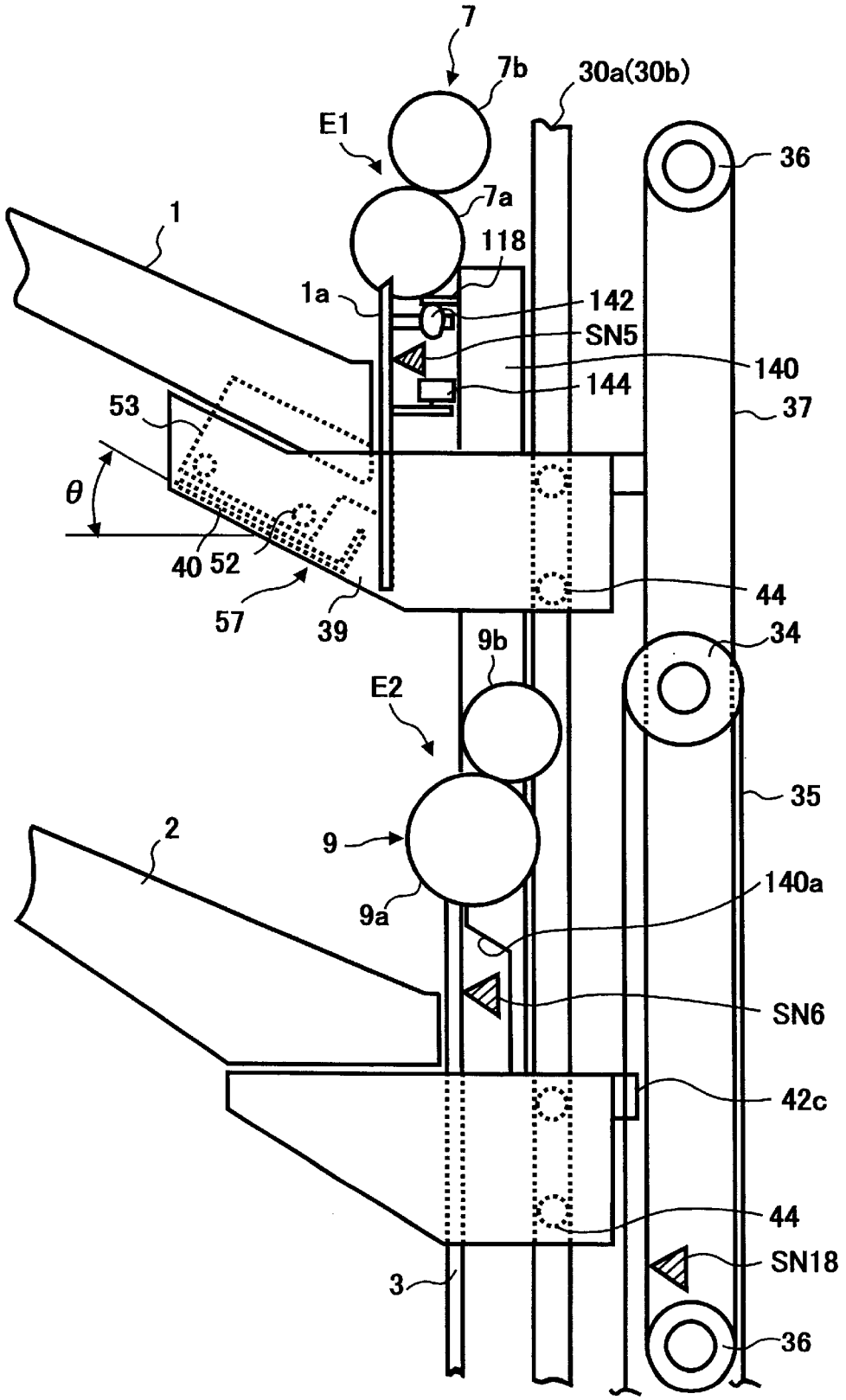
FIG. 25 is a schematic illustration of another elevation mechanism for moving the ejection trays up and down, with the lower ejection tray held at the lower outlet.
Figure 26:
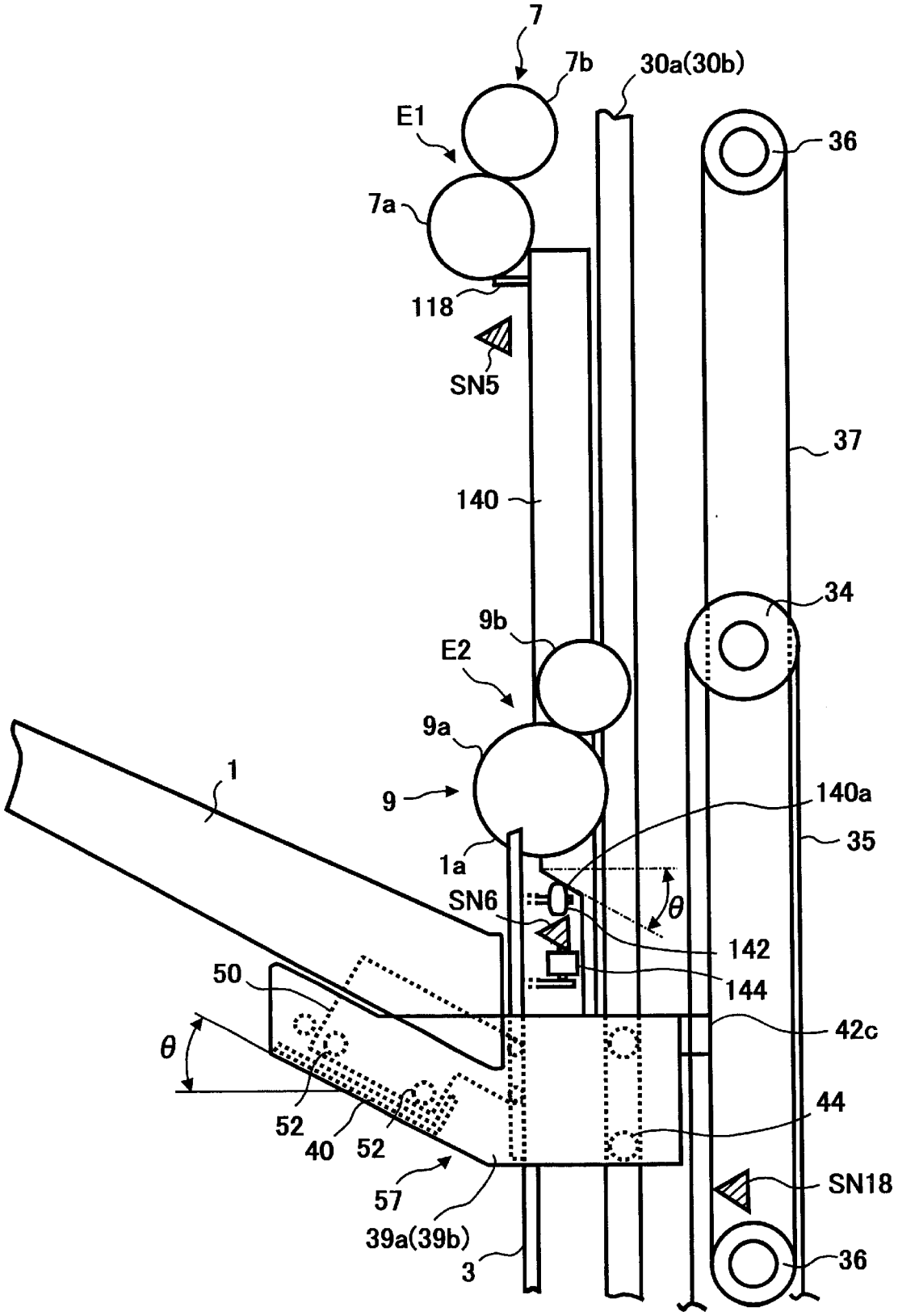
FIG. 26 is a schematic illustration of the elevation mechanism of FIG. 25, with the upper ejection tray held at the lower outlet.
Figure 27A:
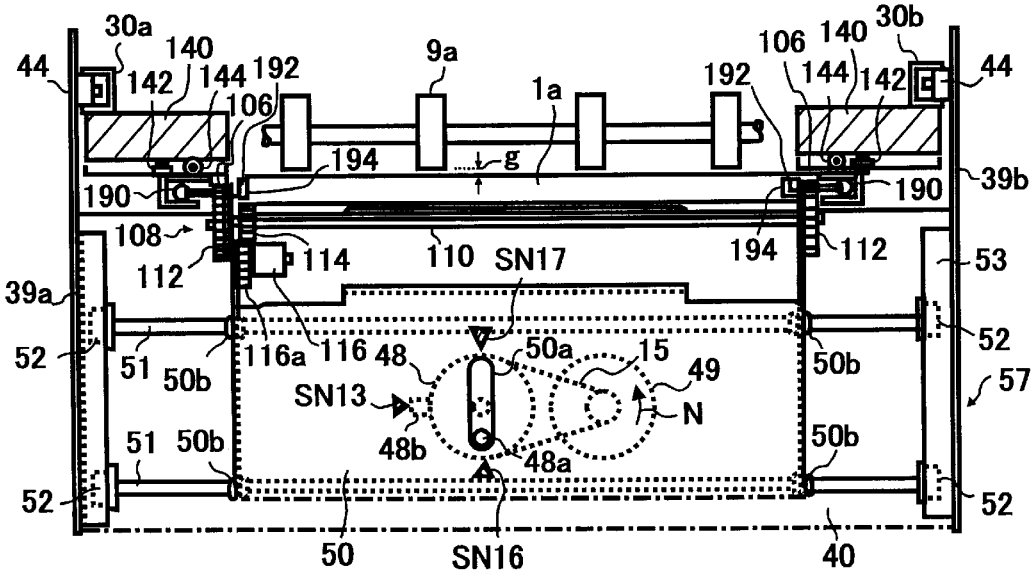
FIGS. 27A, 27B, and 28 are schematic illustrations for explaining how the upper ejection tray is moved to a receiving position of the lower outlet over a mechanism of the lower outlet.
Figure 27B:
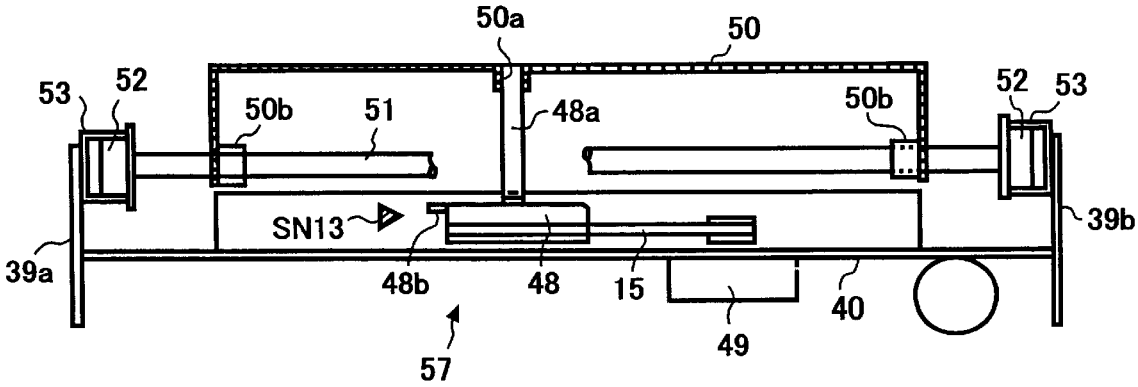
Figure 28:
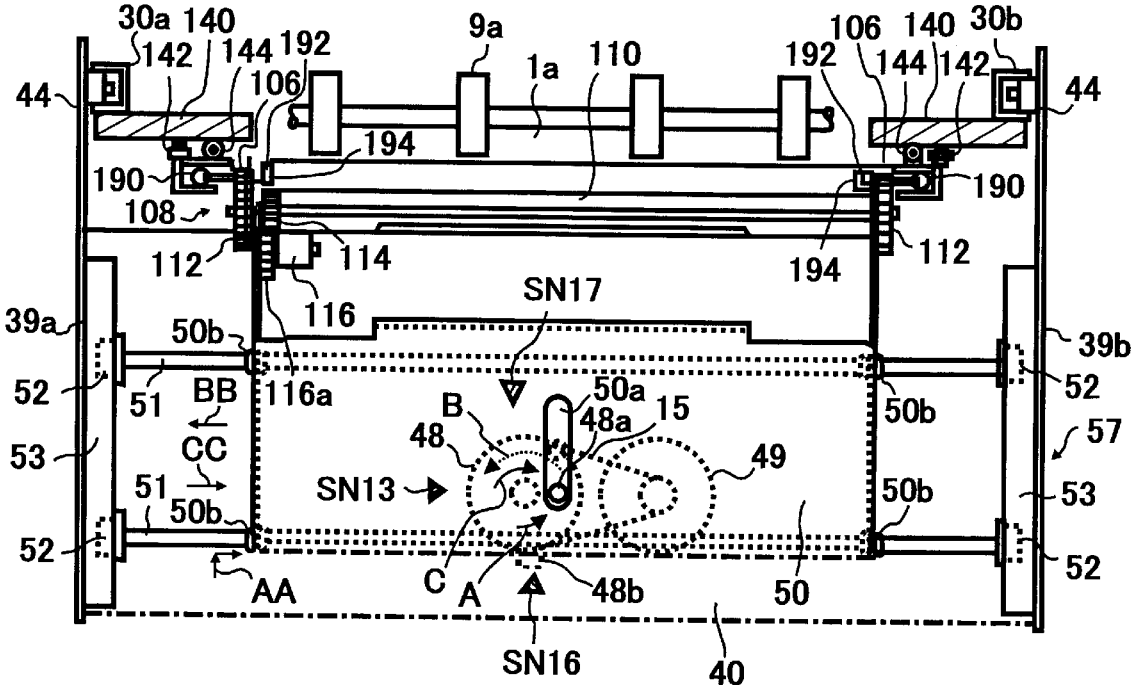

Referring to FIGS. 25, 26, 27A, 27B, and 28, mechanisms of the ejection tray 1 for sliding in the direction of the recording sheet ejection and for shifting are explained. As shown in FIGS. 27A, 27B, and 28, a slide rail 53 is secured to each of the side plates 39*a* and 39*b*. A pair of rollers 52 are provided at both ends of each of the guide rods 51 and are supported by the slide rails 53. Thereby, the guide rods 51 are held between the slide rails 53, and the slider 50 to which the ejection tray 1 is mounted is supported by and between the guide rods 51 via sleeves 50*b*. These components are the main parts to form a base member 57 for moving the ejection tray 1 up and down.

As shown in FIGS. 25 and 26, the slide rails 53 are mounted to the side plates 39*a* and 39*b* with an approximately same angle as the direction in which the recording sheets are ejected into the ejection tray 1. As indicated in FIG. 25, this mounting angle of the slide rails 53 is defined as θ. With this angle θ, the ejection tray 1 is slidable by its own weight towards the upstream side of the recording sheet ejection flow.

When the ejection tray 1 passes over the outlet E2, it is necessary to avoid causing interference between the ejection tray 1 and the driving roller 9*a* of the ejection rollers 9 since the driving roller 9*a* is projected outwards in the recording sheet ejection direction from the moving surface of the ejection tray 1. For this purpose, the ejection tray 1 is slid in the recording sheet ejection direction with the shift motor 49. As described above, the shift motor 49 slides the ejection tray 1 in the direction orthogonal to the recording sheet ejection direction so as to be able to perform the sheet sorting operation. That is, the ejection tray 1 is slid in the two directions with a single motor (i.e., the shift motor 49) which is provided independently from the up-and-down motor 93 for moving the ejection tray 1 up and down.

As shown in FIGS. 25 and 26, an end fence supporting member 140 is mounted to the guide rails 30 and 30*b* and has a stopper 118 at an upper position for stopping the upward movement of the end fence la around the outlet E1. Also, the end fence supporting member 140 includes a slanting portion 140*a* for stopping the upward movement of the end fence la around the outlet E2. The end fence la is provided at its rear surface with rollers 142 and 144. The roller 142 contacts the slanting portion 140*a* and the roller 144 contacts the vertical surface of the end fence supporting member 140, both rotatable in the width direction of the recording sheet. With this arrangement having two contacts, the ejection tray 1 can be shifted in a stable manner.

As shown in FIGS. 27A and 27B, the slider 50 is driven in the width direction of the recording sheet by the reversibly-rotatable slide motor 49 via the belt 15 and the crank pulley 48. This slider 50 is held for a sliding movement in the width direction of the recording sheet by the guide rods 51. As described above, the slider 50 is provided with the slide hole 50*a* into which the eccentric pin 48*a* formed on the crank pulley 48 is engaged.

The stop positions of the slider 50 are monitored by the shift sensor SN13, a shift sensor SN16, and a shift sensor SN17 which are turned on and off when the detection tab 48*b* of the crank pulley 48 passes by. The shift sensor SN16 is located at a position on the rotating surface of the crank pulley 48 approximately 90 degrees downstream from the shift sensor SN13 and the shift sensor SN17 is located at a position on the rotating surface of the crank pulley 48 approximately 90 degrees upstream from the shift sensor SN13.

FIGS. 25, 27A and 27B show the condition in which the ejection tray 1 is set at the receiving position of the outlet E1 and the ejection tray 2 is set at the receiving position of the outlet E2. Under this condition, the shift sensor SN13 is turned on by the detection tab 48*b* of the crank pulley 48 and there is a gap g in the direction of the recording sheet ejection between the end fence la and the ejection rollers 9, as particularly shown in FIG. 27A. When the ejection tray 2 is moved to the standby position and the ejection tray 1 is moved to the receiving position of the outlet E2 under the above-mentioned condition, the ejection tray 1 is moved down over the outlet E2 with keeping the same position as it is detected by the shift sensor SN13, thereby avoiding an interference with the ejection rollers 9.

When the ejection tray 1 passes over the outlet E2 and reaches an appropriate position, the ejection tray 1 (more specifically, the base member 57) is stopped and the shift motor 49 is driven to rotate in the direction indicated by an arrow N in FIG. 27A. The above-mentioned appropriate position is a position at which the rear end of the base member 57 is detected by a shift sensor SN18 (FIG. 25). At this appropriate position, the roller 142 of the end fence 1*a* projecting to the maximum extent when the ejection tray 1 is slid in the direction downstream of the recording sheet ejection with the base member 57 stopped is entered into the slanting portion 140*a* of the end fence supporting member 140.

When the ejection tray 1 passes by the outlet E2, the roller 142 of the end fence 1*a* is positioned at a straight portion of the end fence supporting member 140. Because of it, the top surface of the ejection tray 1 or the top surface of the recording sheets placed on the ejection tray 1 cannot be detected by the tray sensor SN6. Therefore, the ejection tray 1 is stopped at the appropriate position where the roller 142 of the end fence 1*a* passes by the slanting portion 140*a* of the end fence supporting member 140, and is moved upwards. The shift sensor SN18 is provided to determine this appropriate position for the ejection tray 1.

The shift motor 49 rotating in the direction N is driven to turn the crank pulley 48 for a turn A, as shown in FIG. 28, and is stopped to drive the crank pulley 48 when the shift sensor SN16 is turned on by the detection tab 48*b*. In this case, since the ejection tray 1 slides by its own weight to the direction upstream of the recording sheet ejection flow, the ejection tray 1 is shifted to the side of the ejection rollers 9, or the side of the copying machine G, as the eccentric pin 48*a* of the crank pulley 48 is shifted. Then, the roller 144 of the end fence supporting member 140 contacts the ejection tray 1 and the ejection tray 1 is thereby settled at an appropriate position for receiving the recording sheets. This causes the end fence 1*a* of the ejection tray 1 to overlap the driving roller 9*a* of the ejection rollers 9 so that the ejection tray 1 is appropriately positioned at the receiving position of the outlet E2. At the same time when the ejection tray 1 slides in the direction of the recording sheet ejection flow, the ejection tray 1 is slid for a movement AA in the width direction of the recording sheet along the guide rods 51, as shown in FIG. 28. In a case when avoiding the interference with the ejection rollers 9, the ejection tray 1 is slid in the reverse direction.

At the above-mentioned receiving position of the outlet E2, the end fence 1*a* of the ejection tray 1 and the driving roller 9*a* of the ejection rollers 9 are overlapped with each other. More specifically, the end fence 1*a* is provided with vertical grooves (not shown) in order to avoid the interference with the driving roller 9*a*. This overlapping arrangement avoids a paper jamming which may occur in such a way that the trailing edge of the recording sheet ejected from the outlet E2 is jammed between the driving roller 9*a* and the end fence 1*a*. This overlapping arrangement will function in the same manner relative to the ejection roller 7 of the outlet E1.

The tray sensor SN6, which is used to set the ejection tray 1 to the receiving position of the outlet E2, is turned on and off by contacting the rear top surface of the ejection tray 1 or the top surface of the recording sheets placed on the ejection tray 1. This contact of the tray sensor SN6 is made possible by a slit (not shown) formed on the end fence 1*a*. In addition, the end fence 1*a* is provided with another groove (not shown) in order to avoid an interference with the roller 17 (FIG. 11).

To perform the sorting operation, the shift motor 49 is driven to turn the crank pulley 48 for a turn B, as shown in FIG. 28. With the turn B of the crank pulley 48, the ejection tray 1 is slid for a movement BB along the guide rods 51. This movement BB of the ejection tray 1 is stopped when the shift sensor SN17 is turned on by the detection tab 48*b*. When a predetermined number of recording sheets are stacked under this condition, the shift motor 49 is driven to reverse-turn the crank pulley 48 for a turn C. With the turn C of the crank pulley 48, the ejection tray 1 is slid for a movement CC along the guide rods 51. This movement CC of the ejection tray 1 is stopped when the shift sensor SN16 is turned on by the detection tab 48*b*.

With such a back-and-forth movement orthogonal to the direction of the recording sheet ejection, the recording sheets ejected to the ejection tray 1 can be sorted. In this operation, the shift motor 49 is used for sliding the ejection tray 1 in both directions of the recording sheet ejection and the recording sheet width.

During the sorting operation, the roller 142 rotates in contact with the slanting portion 140*a* of the end fence supporting member 140 and the roller 144 rotates in contact with the vertical surface under the slanting portion 140*a*, as shown in FIG. 26. In this way, the ejection tray 1 is supported at the two points and is therefore slid in a smooth and stable manner without causing undesirable deflections.

In addition, during the shifting operation at the outlet E1, the roller 142 rotates in contact with the stopper 118. The stopper 118 may integrally be formed with an upper cover (not shown) of the finishing apparatus 200.

Figure 29:
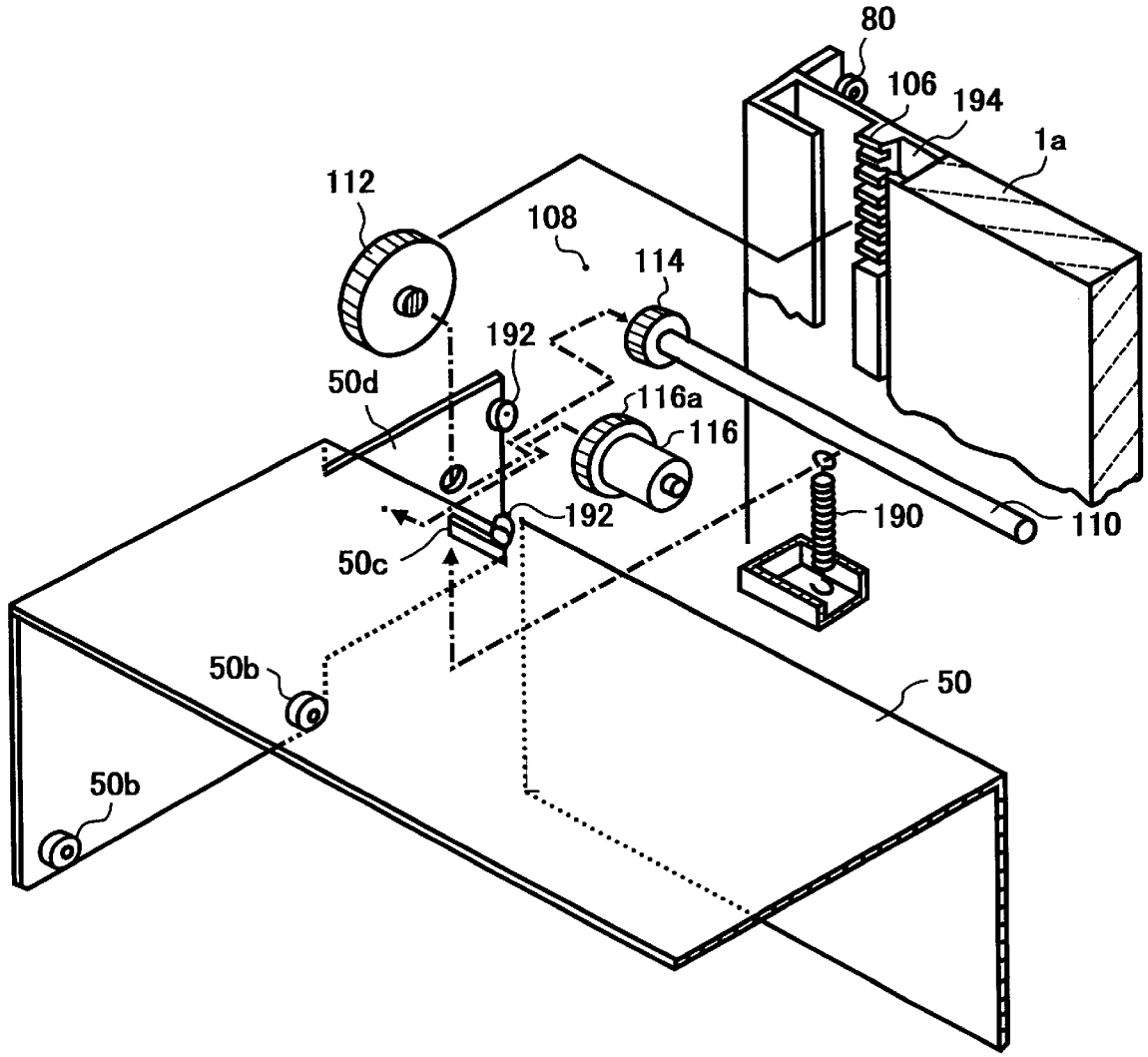
FIG. 29 is a schematic illustration for explaining a structure of a mechanism for supporting an end fence of the upper ejection tray.

Referring to FIGS. 27A, 27B, 28, and 29, an exemplary structure allowing the end fence 1*a* to move up and down relative to the ejection tray 1 is explained. As shown in FIG. 27A, a spring 190 for energizing the end fence 1*a* in an upward direction is contained in each end enclosure of the end fence 1*a* in the width direction of the recording sheet. As shown in FIG. 29, the lower end of the sprint 190 is engaged with the lower part of the end fence 1*a*. The upper end of the spring 190 is engaged with a spring stopper 50*c* projecting outside in the width direction of the recording sheet from an end fence extension 50*d* extended from the slider 50 in the direction of the recording sheet ejection at both sides of the width direction of the recording sheet. On each of the end fence extensions 50*d*, there are mounted two guide rollers 192; one at an upper side and the other at a lower side. These guide rollers 192 are rotated in contact with the inner surface of guide groove 194.

The end fence 1*a* forms, at both ends of the width direction of the recording sheet, a rack gear 106 having each gear in the width direction of the recording sheet is extended in the vertical direction. A gear unit 108 is mounted on each of the end fence extensions 50*d* of the slider 50 and is engaged in the rack gear 106. Each of the gear units 108 includes a shaft 110 supported by the end fence extension 50*d*, a pinion gear 112 engaged with the rack gear 106 and secured at the outside of the end fence extension 50*d* on the edge of the shaft 110, and an idle gear 114 having a built-in one-way-clutch secured inside. With this arrangement in which the rack gear 106 is engaged with the gear unit 108, a phase shift occurred on the end fence 1*a* relative to the ejection tray 1 at a time when the end fence 1*a* is relatively shifted.

On the end fence extension 50*d*, a clutch 116 for locking the end fence 1*a* relative to the ejection tray 1 is mounted via a stud, as shown in FIG. 29. The clutch 116 includes a clutch gear 116*a* engaged with the idle gear 114. When the clutch 116 is disengaged, the end fence 1*a* is slid upwardly while causing the gear unit 108 to turn with the force of the spring 190. When the clutch 116 is engaged, the gear unit 108 is locked and the end fence 1*a* is stopped at an arbitrary position (i.e., a position locked) against the force of the spring 190. The clutch 116 and the idle gear 114 are provided to one of the two end fence extensions 50*d*.

As shown in FIGS. 25 and 26, the stopper 118 for stopping the upward movement of the end fence 1*a* is mounted to the top edge of the end fence supporting member 140. In this mechanism, the roller 142 provided to the end fence 1*a* is made contact with the stopper 118, so that the upward movement of the end fence 1*a* is stopped. However, with the function of the one-way-clutch built in the idle gear 114, the ejection tray 1 is allowed to move upwardly under the condition that the upward movement of the end fence 1*a* is stopped. Accordingly, the ejection tray 1 is allowed to further move upwards even when the roller 142 is made contact with the stopper 118 as the ejection tray 1 is moved up with the condition that the end fence 1*a* is locked, as shown in FIG. 25. Thereby, the ejection tray 1 can be located at an appropriate position in an accurate manner.

The ejection can be executed under the condition that the distance between the top surface of the recording sheets placed on the ejection tray 1 and the outlet E1 is made relatively small. This condition is made by pressing down the end fence 1*a* with the stopper 118. With this arrangement, a defective ejection caused by a curling of the recording sheet on the ejection tray 1 can be avoided.

During the ejection operation to the ejection tray 1, the ejection tray 1 is moved downwards for a predetermined distance each time when the tray sensor SN5 detects the top surface of the recording sheets placed on the ejection tray 1. This sequential operation is repeated until the ejection tray 1 is loaded with the maximum number of the recording sheets. During this operation, the end fence 1*a* is located at a relatively high position when the ejection tray 1 is moved upwards.

When the ejection tray 1 is moved to the receiving position of the outlet E2, as shown in FIG. 26, the slanting portion 140*a* of the end fence supporting member 140 functions as a stopping member.

In a case when the ejection is made to the ejection tray 1 at the outlet E1 or the outlet E2, the clutch 116 is disengaged so that the ejection tray 1 can relatively move away from the end fence 1*a*.

As the first example performs, this example can also performs a control for efficiently moving the ejection trays in the large capacity ejection mode.

In addition, it is also possible to have an embodiment that combines the image forming apparatus and the finishing apparatus into one apparatus according to the present invention, although the embodiments above described are based on the configuration in which the image forming apparatus and the finishing apparatus are separated.

Numerous additional modifications and variations of the present application are possible in light of the above teachings. It is therefore to be understood that within the scope of the appended claims, the present application may be practiced otherwise than as specifically described herein.

What is claimed as new and is desired to be secured by Letters Patent of the United States is:

1. An output sheet handling apparatus having a large capacity ejection mode, comprising:

a plurality of outlets including at least one straight outlet configured to eject a recording sheet;

a plurality of ejection trays including at least one ejection tray configured to receive said recording sheet from at least two outlets among said plurality of outlets;

a tray switching mechanism positioned and configured to switch one of said plurality of ejection trays in operation to another;

an outlet switching mechanism positioned and configured to switch one of said plurality of outlets in operation to another; and a controller configured to control said tray switching mechanism and said outlet switching mechanism to minimize a total distance traveled by said one of said plurality of ejection trays in operation and said another during switching in accordance with a finishing mode selected when said large capacity ejection mode is selected.

2. The output sheet handling apparatus as defined in claim 1, wherein said controller is configured to control said tray switching mechanism and said outlet switching mechanism based on location information of each of said ejection trays.

3. The output sheet handling apparatus as defined in claim 1, wherein said controller is configured to prohibit a selection of said large capacity ejection mode when each of said plurality of ejection trays is full.

4. The output sheet handling apparatus as defined in claim 1, wherein said controller is configured to make one of said plurality of ejection trays which is not full available to receive said recording sheet ejected when other ones of said plurality of ejection trays are full.

5. The output sheet handling apparatus as defined in claim 1, wherein said controller is configured to prohibit a selection of said large capacity ejection mode when one of said plurality of ejection trays has a greater loading capacity than other ones of said plurality of ejection trays and is full.

6. The output sheet handling apparatus as defined in claim 1, wherein said controller is configured to make one of said plurality of ejection trays available to receive said recording sheet ejected when said one of said plurality of ejection trays is not full and has a greater loading capacity than other ones of said plurality of ejection trays while said other ones of said plurality of ejection trays are full.

7. The output sheet handling apparatus as defined in claim 1, wherein;

said plurality of outlets comprises at least one finisher outlet located at a position lower than a position of said straight outlet and provided for ejecting a stack of recording sheets processed in a complex finishing mode;

said plurality of ejection trays comprises a first ejection tray configured to receive from one of said at least one straight outlet and said at least one finisher outlet, and a second ejection tray located under said first ejection tray and having a greater loading capacity for receiving a stack of recording sheets from said at least one finisher outlet;

when said second ejection tray is selected, said output sheet handling apparatus selectively has a normal ejection mode in which an ejection operation is stopped when said second ejection tray is full and a large capacity ejection mode in which, when said second ejection tray is full, said second ejection tray is further moved down to continue to receive one of a recording sheet and a stack of recording sheets until a full in said large capacity ejection mode is detected; and said controller is configured to move said first ejection tray to said finisher outlet and start an ejection operation when said large capacity ejection mode and a complex finishing mode are selected.

8. The output sheet handling apparatus as defined in claim 7, wherein said controller is configured to prohibit a selection of said large capacity ejection mode when said second ejection tray and said first ejection tray are full.

9. The output sheet handling apparatus as defined in claim 7, wherein said controller is configured to move said first ejection tray to said at least one finisher outlet and start said ejection operation when said second ejection tray is full and said first ejection tray is not full.

10. The output sheet handling apparatus as defined in claim 7, wherein said controller is configured to prohibit a selection of said large capacity ejection mode when said second ejection tray is full.

11. The output sheet handling apparatus as defined in claim 7, wherein said controller is configured to move said second ejection tray to said finisher outlet and start said ejection operation when said first ejection tray is full and said second ejection tray is not full.

12. The output sheet handling apparatus as defined in claim 1, wherein:

said plurality of outlets comprises at least one finisher outlet located at a position lower than a position of said at least one straight outlet and provided for ejecting one of a recording sheet and a stack of recording sheets processed in a complex finishing mode;

said plurality of ejection trays comprises a first ejection tray configured to receive from one of said at least one straight outlet and said at least one finisher outlet, and a second ejection tray located under said first ejection tray and having a greater loading capacity for receiving one of a recording sheet and a stack of recording sheets from said at least one finisher outlet;

when said second ejection tray is selected, said output sheet handling apparatus selectively has a normal ejection mode in which an ejection operation is stopped when said second ejection tray is full and a large capacity ejection mode in which, when said second ejection tray is full, said second ejection tray is further moved down to continue to receive one of a recording sheet and a stack of recording sheets until a full in said large capacity ejection mode is detected; and said controller is configured to move said second ejection tray to said at least one finisher outlet and start an ejection operation when said large capacity ejection mode is selected and a complex finishing mode is not selected.

13. The output sheet handling apparatus as defined in claim 12, wherein said controller is configured to switch an outlet in operation from said at least one finisher outlet to said straight outlet upon detecting said full in said large capacity ejection mode, and continue said ejection operation to said first ejection tray through said at least one straight outlet, and set said first ejection tray at the at least one straight outlet.

14. The output sheet handling apparatus as defined in claim 12, wherein said controller is configured to prohibit a selection of said large capacity ejection mode when said second ejection tray and said first ejection tray are full.

15. The output sheet handling apparatus as defined in claim 12, wherein said controller is configured to move said first ejection tray to said at least one straight outlet and start said ejection operation when said second ejection tray is full and said first ejection tray is not full.

16. The output sheet handling apparatus as defined in claim 12, wherein said controller is configured to prohibit a selection of said large capacity ejection mode when said second ejection tray is full.

17. The output sheet handling apparatus as defined in claim 12, wherein said controller is configured to enter said ejection operation into said large capacity ejection mode automatically when said plurality of ejection trays is full.

18. The output sheet handling apparatus as defined in claim 12, wherein:

said finisher outlet has a receiving position which is a home position of said second ejection tray; and said straight outlet has a receiving position which is a home position of said first ejection tray.

19. The output sheet handling apparatus as defined in claim 12, wherein:

said first ejection tray comprises an end fence integrally formed with said first ejection tray for jogging a trailing edge of said stack of recording sheets placed on said first ejection tray; and said output sheet handling apparatus further comprises a tray sensor mounted to said end fence and configured to detect whether said first ejection tray is full.

20. An output sheet handling apparatus having a large capacity ejection mode, comprising:

a plurality of outlet means each for ejecting a recording sheet having an image thereon, said plurality of outlet means including at least one straight outlet means for ejecting a recording sheet;

a plurality of receiving means for receiving plural recording sheets ejected from said plurality of outlet means and including at least one receiving means for receiving said recording sheet from at least two outlet means among said plurality of outlet means;

tray switching means for switching one of said plurality of receiving means in operation to another;

outlet switching means for switching one of said plurality of outlet means in operation to another; and controlling means for controlling said tray switching means and said outlet switching means to minimize a total distance traveled by said one of said plurality of receiving means in operation and said another during switching in accordance with a finishing mode selected when said large capacity ejection mode is selected.

21. The output sheet handling apparatus as defined in claim 20, wherein said controlling means controls said tray switching means and said outlet switching means based on location information of each of said receiving means.

22. The output sheet handling apparatus as defined in claim 20, wherein said controlling means prohibits a selection of said large capacity ejection mode when each of said plurality of receiving means is full.

23. The output sheet handling apparatus as defined in claim 20, wherein said controlling means makes one of said plurality of receiving means available to receive said recording sheet ejected when said one of said plurality of receiving means is not full and other ones of said plurality of receiving means are full.

24. The output sheet handling apparatus as defined in claim 20, wherein said controlling means prohibits a selection of said large capacity ejection mode when one of said plurality of receiving means has a greater loading capacity than other ones of said plurality of receiving means and when said one of said plurality of receiving means is full.

25. The output sheet handling apparatus as defined in claim 20, wherein said controlling means makes one of said plurality of receiving means available to receive said recording sheet ejected when said one of said plurality of receiving means is not full and has a greater loading capacity than other ones of said plurality of receiving means and said other ones of said plurality of receiving means are full.

26. The output sheet handling apparatus as defined in claim 20, wherein:

said plurality of outlet means including at least one finisher outlet means for ejecting a stack of recording sheets which are processed in a complex finishing mode and located at a position lower than a position of said at least one straight outlet means;

said plurality of receiving means including first receiving means for receiving from one of said at least one straight outlet means and said at least one finisher outlet means, and second receiving means for receiving a stack of recording sheets from said at least one finisher outlet means, said second receiving means located under said first receiving means and having a greater loading capacity;

when said second receiving means is selected, said output sheet handling apparatus selectively has a normal ejection mode in which an ejection operation is stopped when said second receiving means is full and a large capacity ejection mode in which, when said second receiving means is full, said second receiving means is further moved down to continue to receive one of a recording sheet and a stack of recording sheets until a full in said large capacity ejection mode is detected; and said controlling means moves said first receiving means to said at least one finisher outlet means and starts an ejection operation when said large capacity ejection mode and a complex finishing mode are selected.

27. The output sheet handling apparatus as defined in claim 26, wherein said controlling means prohibits a selection of said large capacity ejection mode when said second receiving means and said first receiving means are full.

28. The output sheet handling apparatus as defined in claim 26, wherein said controlling means moves said first receiving means to said at least one finisher outlet means and starts said rejection operation when said second receiving means is full and said first receiving means is not full.

29. The output sheet handling apparatus as defined in claim 26, wherein said controlling means prohibits a selection of said large capacity ejection mode when said second receiving means is full.

30. The output sheet handling apparatus as defined in claim 26, wherein said controlling means moves said second receiving means to said at least one finisher outlet means and starts said ejection operation when said first receiving means is full and said second receiving means is not full.

31. The output sheet handling apparatus as defined in claim 20, wherein:

said plurality of outlet means including at least one finisher outlet means for ejecting one of a recording sheet and a stack of recording sheets which are processed in a complex finishing mode and located at a position lower than a position of said at least one straight outlet means;

said plurality of receiving means including first receiving means for receiving from one of said at least one straight outlet means and said at least one finisher outlet means, and second receiving means for receiving one of a recording sheet and a stack of recording sheets from said at least one finisher outlet means, said second receiving means located under said first ejection tray means and having a greater loading capacity;

when said second receiving means is selected, said output sheet handling apparatus selectively has a normal ejection mode in which an ejection operation is stopped when said second receiving means is full and a large capacity ejection mode in which, when said second receiving means is full, said second receiving means is further moved down to continue to receive one of a recording sheet and a stack of recording sheets until a full in said large capacity ejection mode is detected; and said controlling means moves said second receiving means to said at least one finisher outlet means and starts an ejection operation when said large capacity ejection mode is selected and a complex finishing mode is not selected.

32. The output sheet handling apparatus as defined in claim 31, wherein, when said first receiving means is set at the at least one straight outlet means, said controlling means switches one of said plurality of outlet means in operation from said at least one finisher outlet means to said at least one straight outlet means upon detecting said full in said large capacity ejection mode and continues said ejection operation to said first receiving means through said at least one straight outlet means.

33. The output sheet handling apparatus as defined in claim 31, wherein said controlling means prohibits a selection of said large capacity ejection mode when said second receiving means and said first receiving means are full.

34. The output sheet handling apparatus as defined in claim 31, wherein said controlling means moves said first receiving means to said at least one straight outlet means and starts said ejection operation when said second receiving means is full and said first receiving means is not full.

35. The output sheet handling apparatus as defined in claim 31, wherein said controlling means prohibits a selection of said large capacity ejection mode when said second receiving means is full.

36. The output sheet handling apparatus as defined in claim 31, wherein said controlling means automatically enters said ejection operation into said large capacity ejection mode when said controlling means detects one of said plurality of receiving means in operation and other ones of said plurality of receiving means are full.

37. The output sheet handling apparatus as defined in claim 31, wherein:

said at least one finisher outlet means has a receiving position which is a home position of said second receiving means; and said at least one straight outlet means has a receiving position which is a home position of said first receiving means.

38. The output sheet handling apparatus as defined in claim 31, wherein:

said first receiving means includes end fence means for jogging a trailing edge of said stack of recording sheets placed on said first receiving means, said end fence means integrally formed with said first receiving means; and said output sheet handling apparatus further comprises detecting means for detecting whether said first receiving means is full, said detecting means mounted to said end fence means.

39. A method for handling output sheet by using an output sheet handling apparatus having a large capacity ejection mode, said method comprising the steps of:

providing a straight outlet for ejecting a recording sheet;

providing a finisher outlet for ejecting one of a recording sheet and a stack of recording sheets which are processed in a complex finishing mode, said finisher outlet arranged under said straight outlet;

providing a first ejection tray which is movable to said straight outlet and said finisher outlet to receive said recording sheet from one of said straight outlet and said finisher outlet;

providing a second ejection tray under said first ejection tray, said second ejection tray having a greater loading capacity than said first ejection tray and being movable to said finisher outlet to receive said recording sheet from said finisher outlet, a standby position where said second ejection tray stays at idle while said first ejection tray is in operation at said finisher outlet, and a bottom position where said second ejection tray loaded to a full capacity stays, said bottom position being under said standby position;

providing a plurality of ejection trays; and minimizing a total distance traveled by one of said first and second ejection trays in operation and one of the plurality of ejection trays during an ejection tray switching operation in accordance with a finishing mode selected when said large capacity ejection mode is selected.

40. The method as defined in claim 39, wherein said minimizing step is performed based on location information of said first and second ejection trays.

41. The method as defined in claim 39, wherein said minimizing step comprises prohibiting a selection of said large capacity ejection mode when each of said first and second trays is full.

42. The method as defined in claim 39, wherein said minimizing step comprises making one of said first and second ejection trays available to receive said recording sheet ejected when said one of said first and second ejection trays is not full and the plurality of ejection trays is full.

43. The method as defined in claim 39, wherein said minimizing step comprises prohibiting a selection of said large capacity ejection mode when one of said first and second ejection trays has a greater loading capacity than the other one of said first and second ejection trays, and said one of said first and second ejection trays is full.

44. The method as defined in claim 39, wherein said minimizing step comprises making one of said first and second ejection trays available to receive said recording sheet ejected when said one of said first and second ejection trays has a greater loading capacity than the other one of said first and second ejection trays and is not full while the other one of said first and second ejection trays is full.

45. The method as defined in claim 39, wherein:

when said second ejection tray is selected, said minimizing step comprises selecting one of a normal ejection mode in which an ejection operation is stopped when said second ejection tray is full and a large capacity ejection mode in which said second ejection tray is further moved down to continue to receive one of a recording sheet and a stack of recording sheets until a full in said large capacity ejection mode is detected when said second ejection tray is full; and said minimizing step comprises moving said first ejection tray to said finisher outlet and starting an ejection operation when said large capacity ejection mode and a complex finishing mode are selected.

46. The method as defined in claim 45, wherein said minimizing step comprises prohibiting a selection of said large capacity ejection mode when said second ejection tray and said first ejection tray are full.

47. The method as defined in claim 45, wherein said minimizing step comprises moving said first ejection tray to said finisher outlet and starting said ejection operation when said second ejection tray is full and said first ejection tray is not full.

48. The method as defined in claim 45, wherein said minimizing step comprises prohibiting a selection of said large capacity ejection mode when said second ejection tray is full.

49. The method as defined in claim 45, wherein said minimizing step comprises moving said second ejection tray to said finisher outlet and starting said ejection operation when said first ejection tray is full and said second ejection tray is not full.

50. The method as defined in claim 45, wherein said minimizing step comprises moving said second ejection tray to said finisher outlet and starting an ejection operation when said large capacity ejection mode is selected and a complex finishing mode is not selected.

51. The method as defined in claim 45, wherein said minimizing step comprises switching said ejection operation through said finisher outlet to said ejection operation through said straight outlet upon detecting said full in said large capacity ejection mode, and continuing said ejection operation to said first ejection tray through said straight outlet, when said first ejection tray is set at the straight outlet.

52. The method as defined in claim 45, wherein said minimizing step comprises prohibiting a selection of said large capacity ejection mode when said second ejection tray and said first ejection tray are full.

53. The method as defined in claim 45, wherein said minimizing step comprises moving said first ejection tray to said straight outlet and starting said ejection operation when said second ejection tray is full and said first ejection tray is not full.

54. The method as defined in claim 45, wherein said minimizing step comprises prohibiting a selection of said large capacity ejection mode when said second ejection tray is full.

55. The method as defined in claim 45, wherein said minimizing step comprises automatically entering said ejection operation into said large capacity ejection mode when one of said first and second ejection trays in operation and the other one of said first and second ejection trays are full.

56. The method as defined in claim 45, wherein:

said finisher outlet has a receiving position which is a home position of said second ejection tray; and said straight outlet has a receiving position which is a home position of said first ejection tray.

57. The method as defined in claim 45, wherein:

said providing step comprises providing said first ejection tray which includes an end fence, integrally formed with said first ejection tray, for jogging a trailing edge of said stack of recording sheets placed on said first ejection tray; and said method further comprises mounting a tray sensor to said end fence, said tray sensor for detecting whether said first ejection tray is full.

* * * * *